US010557380B2

(12) United States Patent
Atalla

(10) Patent No.: US 10,557,380 B2
(45) Date of Patent: Feb. 11, 2020

(54) HIGH EFFICIENCY POWER GENERATION APPARATUS, REFRIGERATION/HEAT PUMP APPARATUS, AND METHOD AND SYSTEM THEREFOR

(71) Applicant: Naji Amin Atalla, Londonderry (GB)

(72) Inventor: Naji Amin Atalla, Londonderry (GB)

( * ) Notice: Subject to any disclaimer, the term of this patent is extended or adjusted under 35 U.S.C. 154(b) by 135 days.

(21) Appl. No.: 15/924,973

(22) Filed: Mar. 19, 2018

(65) Prior Publication Data

US 2018/0306068 A1 Oct. 25, 2018

Related U.S. Application Data

(63) Continuation of application No. 14/401,173, filed as application No. PCT/EP2013/060264 on May 17, 2013, now Pat. No. 9,988,946.

(30) Foreign Application Priority Data

May 17, 2012 (GB) ..... 1208771.4
Mar. 1, 2013 (GB) ..... 1303775.9

(51) Int. Cl.
*F01K 25/10* (2006.01)
*F01K 7/22* (2006.01)
(Continued)

(52) U.S. Cl.
CPC ..... *F01K 25/10* (2013.01); *F01K 7/22* (2013.01); *F01K 9/003* (2013.01); *F01K 25/065* (2013.01); *F01K 25/106* (2013.01); *F25B 30/02* (2013.01)

(58) Field of Classification Search
CPC ..... F01K 25/065; F01K 25/10; F01K 25/106; F01K 7/22; F01K 9/003; F25B 30/02
See application file for complete search history.

(56) References Cited

U.S. PATENT DOCUMENTS 1,874,620 A 8/1932 Radford
4,183,220 A 1/1980 Shaw
(Continued)

FOREIGN PATENT DOCUMENTS

JP A-S60-245686 A 12/1985
JP A-H02-181002 A 7/1990
(Continued)

OTHER PUBLICATIONS

Amendment and Response to Notice to file corrected Application Papers dated Jan. 2, 2018 for U.S. Appl. No. 14/401,173, filed Feb. 21, 2018; 6 Pages.
(Continued)

*Primary Examiner* — Jesse S Bogue
(74) *Attorney, Agent, or Firm* — Daly, Crowley, Mofford & Durkee, LLP

(57) ABSTRACT

A system for recycling heat or energy of a working medium of a heat engine for producing mechanical work is described. The system may comprise a first heat exchanger (204) for transferring heat from a working medium output from an energy extraction device (202) to a heating agent to vaporise the heating agent; a second heat exchanger (240) for transferring further heat to the vaporised heating agent; a compressor (231) coupled to the second heat exchanger (240) arranged to compress the further-heated heating agent; and a third heat exchanger (211) for transferring heat from the compressed heating agent to the working medium. A heat pump is also described.

30 Claims, 36 Drawing Sheets

(51) Int. Cl.

| | |
|---|---|
| ***F01K 9/00*** | (2006.01) |
| ***F01K 25/06*** | (2006.01) |
| ***F25B 30/02*** | (2006.01) |

(56) References Cited

U.S. PATENT DOCUMENTS

| | | | | |
|---|---|---|---|---|
| 4,489,563 | A | 12/1984 | Kalina | |
| 6,195,997 | B1 * | 3/2001 | Lewis | F01K 25/065 60/648 |
| 7,062,913 | B2 * | 6/2006 | Christensen | F01K 25/08 60/651 |
| 7,287,381 | B1 * | 10/2007 | Pierson | F01K 25/08 60/651 |
| 7,827,791 | B2 * | 11/2010 | Pierson | F01K 3/265 60/653 |
| 8,302,399 | B1 * | 11/2012 | Freund | F01N 5/02 60/605.1 |
| 9,243,518 | B2 * | 1/2016 | Cook | F01K 13/02 |
| 9,988,946 | B2 | 6/2018 | Atalla | |
| 2003/0000213 | A1 | 1/2003 | Christensen et al. | |
| 2003/0213248 | A1 * | 11/2003 | Osborne | F01K 17/02 60/670 |
| 2004/0011038 | A1 | 1/2004 | Stinger et al. | |
| 2009/0320477 | A1 | 12/2009 | Juchymenko | |
| 2011/0131991 | A1 | 6/2011 | Oh et al. | |
| 2012/0036854 | A1 | 2/2012 | Vaisman et al. | |
| 2012/0131921 | A1 | 5/2012 | Held | |
| 2013/0113221 | A1 | 5/2013 | Held | |

FOREIGN PATENT DOCUMENTS

| | | |
|---|---|---|
| JP | H02 181002 A | 7/1990 |
| JP | 2009-250592 | 10/2009 |
| JP | 2010-025413 | 2/2010 |
| WO | WO 96/27739 | 9/1996 |
| WO | WO 2010/070242 A2 | 6/2010 |

OTHER PUBLICATIONS

Amendment and Response to Notice to file corrected Application Papers dated Mar. 20, 2018 for U.S. Appl. No. 14/401,173, filed Apr. 30, 2018; 5 Pages.

Final Office Action dated Sep. 1, 2017 for U.S. Appl. No. 14/401,173; 10 Pages.

International Search Report of the ISA for PCT/EP2013/060264 dated Mar. 31, 2014.

Non-Final Office Action dated Mar. 21, 2017 for U.S. Appl. No. 14/401,173; 20 Pages.

Notice of Allowance dated Dec. 22, 2017 for U.S. Appl. No. 14/401,173; 5 Pages.

PCT International Preliminary Report on Patentability of the ISA for PCT/EP2013/060264 dated Nov. 18, 2014.

PCT Written Opinion of the ISA for PCT/EP2013/060264 dated Mar. 31, 2014.

Restriction Requirement dated Oct. 24, 2016 for U.S. Appl. No. 14/401,173; 9 Pages.

Response to Restriction Requirement dated Oct. 24, 2016 for U.S. Appl. No. 14/401,173, filed Jan. 24, 2017; 10 Pages.

Response to Non-Final Office Action dated Mar. 21, 2017 for U.S. Appl. No. 14/401,173, filed Jul. 21, 2017; 14 Pages.

Response to Final Office Action dated Sep. 1, 2017 for U.S. Appl. No. 14/401,173, filed Nov. 29, 2017; 11 Pages.

Response to Rule 312 Amendment dated May 14, 2018 for U.S. Appl. No. 14/401,173; 2 Pages.

Japanese Office Action, Partial Translation, dated May 10, 2018, Patent Application No. 2015-512080, 7 pages.

Japanese Office Action, Translation, dated Jun. 30, 2017, Patent Application No. 2015-512080, 6 pages.

* cited by examiner

Figure 1 , Schematic diagram of a thermodynamic cycle used in a conventional "Rankine" power plant;

Figure 2, Schematic diagram of a thermodynamic cycle used in a "Kalina" power plant;

Figure 6, Schematic diagram of the novel heat engine "Atalla Harwen Cycle" with single component working medium system and comprising two sub-loops of the energy preservation system Figure 7, Schematic diagram of thermodynamic cycle and the novel heat engine with a binary or single component working medium system – "Atalla Harwen Cycle" plant and comprising a heating agent loop to provide energy for the separation tank reboiler Figure 13 Schematic diagram of thermodynamic cycle and the novel heat engine with single component working medium system – "Atalla Harwen Cycle" plant and comprising a low temperature reservoir energy source and vaporizer and/or condenser;

Figure 14 Multi stage (4 stages) compression of heating agent (n-Octane) showing condensate withdrawal at the end of stages with knock out tanks, Fig 15 Temperature-Entropy (T-s) diagram of Ammonia and areas of the material physical phase statuses Figure 16 Temperature-Entropy (T-s) diagram of Ammonia showing steps of a power generation loop with superheating of high pressure ammonia and isentropic expansion Figure 17 Temperature-Entropy (T-s) diagram of Ammonia showing steps of a power generation loop with expansion of high pressure ammonia from the saturation point C Temperature-entropy (T-s) diagram of ammonia Temperature-entropy (T-s) diagram of ammonia Temperature-entropy (T-s) diagram of n-octane Temperature-entropy (T-s) diagram of n-octane Temperature-entropy (T-s) diagram of n-octane Temperature-entropy (T-s) diagram of n-octane

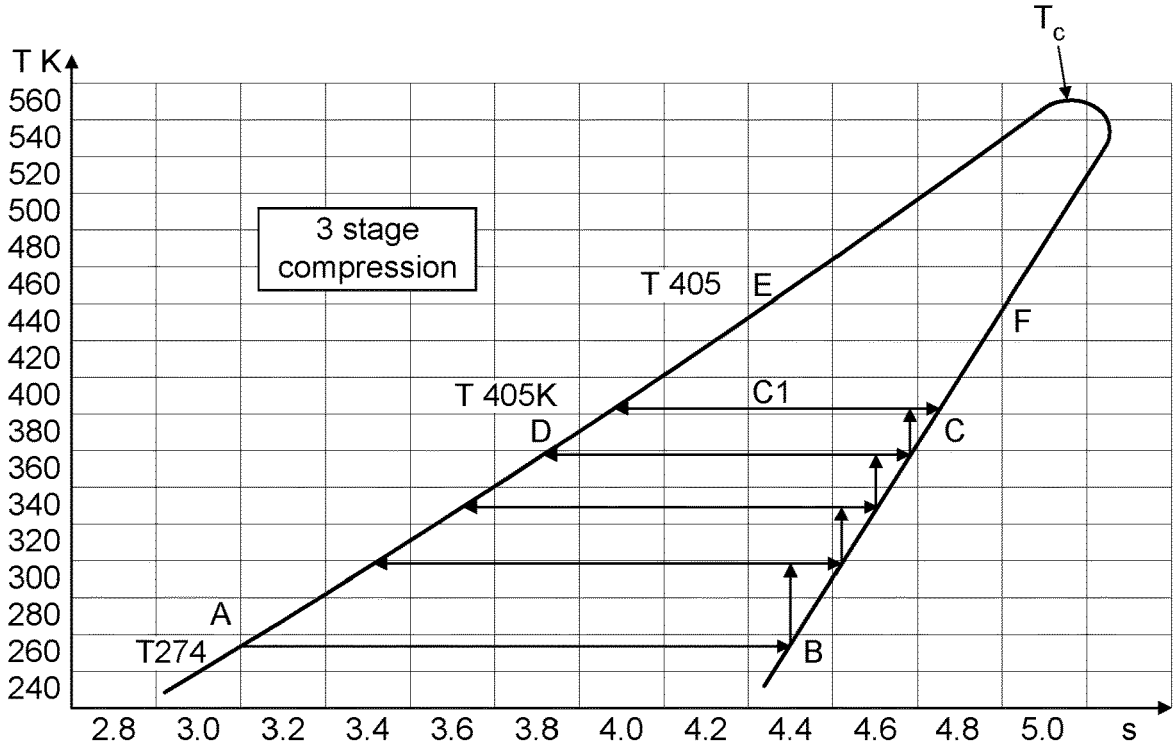
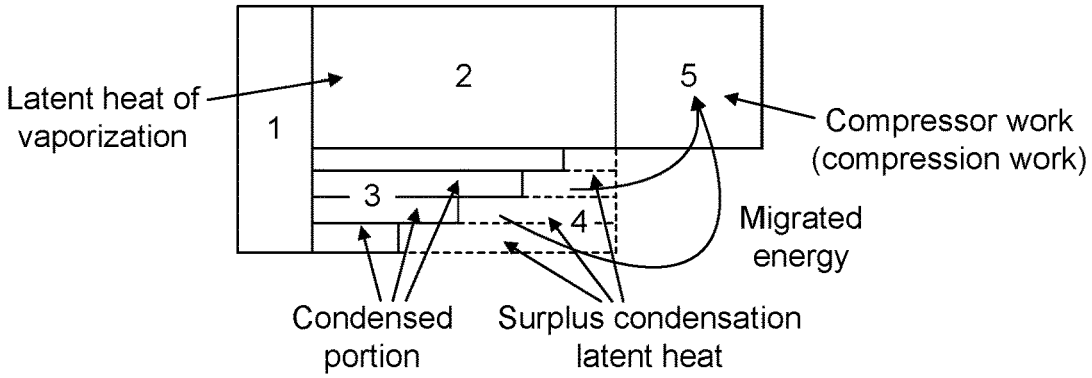
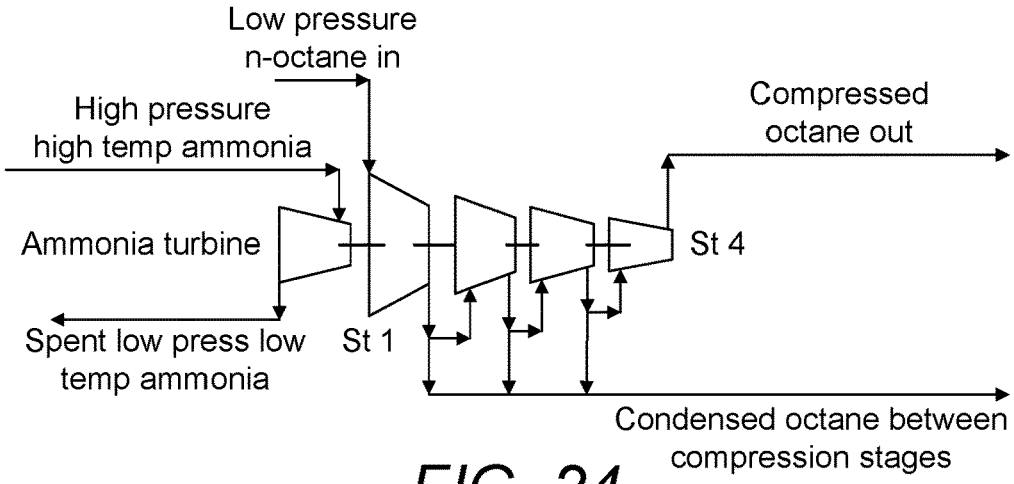
*FIG. 24*
Temperature-entropy (T-s) diagram of n-octane Temperature-entropy (T-s) diagram of n-octane Temperature-entropy (T-s) diagram of n-octane Temperature-entropy (T-s) diagram of n-octane Temperature-entropy (T-s) diagram of n-octane Temperature-entropy (T-s) diagram of n-octane Temperature-entropy (T-s) diagram of n-octane

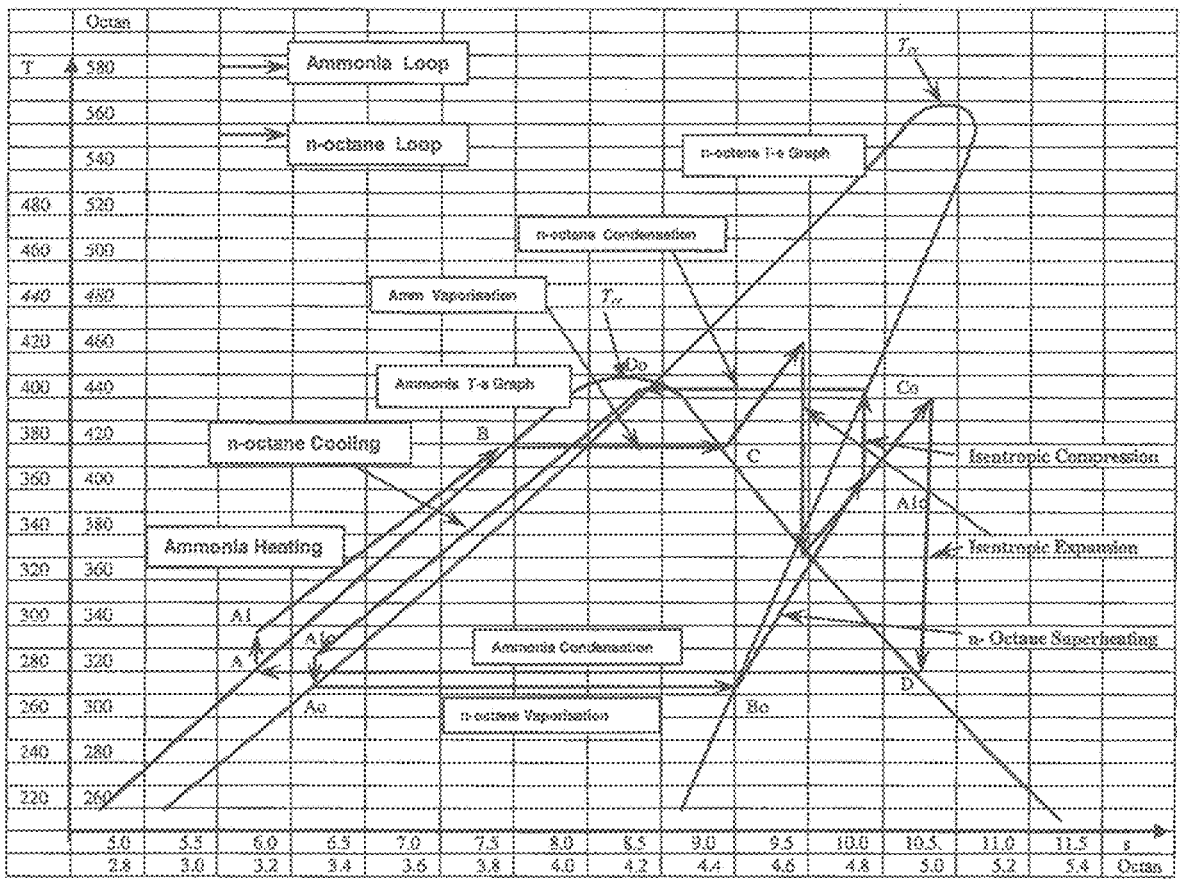
Figure 31, Superimposed temperature-entropy (T-s) diagrams of n-Octane (as the heating agent) and Ammonia (as the working medium) to form the integrated "Atalia Harwen Cycle"

Table No. 1 - Excel Modelling Data and Results

Process

Ammonia Loop

| | Vapor/Cond No 204 In Vapor | Out Liquid | Out-In | Heat Exchan No-204 In Liquid | Out Liquid | Out-In | Heat Exchan No 211 (vaporiz) In Liquid | Out Vapor | Out-In |
|---|---|---|---|---|---|---|---|---|---|
| Temp OC | 280 | 280 | 0 | 280 | 380 | 0 | 380 | 400 | |
| Pressure bar | 5.5077 | 5.5077 | | 71.35 | 71.35 | | 71.35 | 71.35 | |
| Flow Rate Kg/s | 1 | 1 | | 1 | 1 | | 1 | 1 | |
| Enthalpy kj/kg | 506 | -730.9 | -1236.9 | -730.9 | -196.5 | 534.4 | -196.5 | 575 | 771.5 |
| Enthalpy KJ/s | 506 | -730.9 | -1236.9 | -730.9 | -196.5 | 534.4 | | | |

Joint Equipment

Joint Equipment n-Octane Loop

| | Octeane Side Out Vapor | In Liquid | In-Out | Octeane Side Out Liquid | In Liquid | In-Out | Octeane Side Out Liq | In Vapor | In-Out |
|---|---|---|---|---|---|---|---|---|---|
| Temp OC | 274 | 274 | | 285 | 390 | 105 | 390 | 405 | |
| Pressure bar | 0.00466 | 0.00466 | | 1.2218 | 1.2218 | | 1.2218 | 1.2218 | |
| Flow Rate Kg/s | 3.2543 | 3.25431 | | 2.100629 | 2.100629 | | 2.320 | 2.320 | |
| Enthalpy kj/kg | 864.4 | 484.32 | 380.08 | 507.8 | 762.200 | 254.4 | 762.2 | 1094.8 | 332.60 |
| | 2813.03 | 1576.13 | 1236.9 | 1066.699 | 1601.099 | -534.4 | 1768.002 | 2539.5 | -771.5 |
| Enthalpy KJ/s | 2813.03 | 1576.13 | 1236.9 | 1066.699 | 1601.099 | -534.4 | | | |
| | | | | | | | Note | | |

Tem K
Flow Rate Kg/s
Enthalpy kj/kg

A

D

Liq 3

Liq
Liq 1
V
Liq 4

G

A 0.21795

*Figure 32*

Table No. 1 - Page 2

| | | | | |
|---|---|---|---|---|
| System Performance | | | | |
| | Power Output MW | 8.28056 | | 0.3691 |
| | Power Input MW | | | |
| | From Steam | MW | 0.1250 | |
| | From Cold Source | MW | 0.1246 | |
| | Total Power Input | | | 0.2496 |
| | Compressor Work | MW | | 0.20947 |
| Net power output MW | | | | 0.15963 |
| | System Efficiency % | | | 57.6 |
| Compressor COP | | | | 8.28844 |
| Ratio of Power Output/Compressor Work | | | | 1.7621 |

Table No. 1, Excel modelling data and results

*Figure 32A*

Table No. 1 - Page 3

Outside Stream

| Out Condens | In Vapor | |
|---|---|---|
| 450 | 450 | |
| -0.06 | -0.06176 | -125 |
| 749.2 | 2773 | 2023.8 |

Superheating 215

| In Vapor | Out Gas | Out-In |
|---|---|---|
| 400 | 426 | 26 |
| 71.35 | 71.35 | |
| 1 | 1 | |
| 575 | 700 | 125 |
| 575 | 700 | -125 |

Only Ammonia

Isentropic Expans Stage 1-202

| In Gas | Out Vapor | Out-In |
|---|---|---|
| 426 | 332 | -94 |
| 71.35 | 25 | -46.35 |
| 1 | 1 | |
| 700 | 525 | -175 |
| 700 | 525 | 154 |
| 700 | 525 | -175 |
| Isentropic Effic | | 88.0 % |

Only Ammonia

*Figure 32B*

Table No. 1 - Page 4

HIGH EFFICIENCY POWER GENERATION APPARATUS, REFRIGERATION/HEAT PUMP APPARATUS, AND METHOD AND SYSTEM THEREFOR

1—FIELD OF THE INVENTION

The invention relates to a system and method for recycling thermal heat or energy output from an energy extraction device, such as a turbine. More particularly, this invention relates to heat engines and plants for producing mechanical work or other forms of energy. Even more particularly, this invention relates to power generation apparatus and method of producing electrical energy from a variety of energy sources of relatively low to high temperatures which usually operates in a closed thermodynamic cycle.

The invention also relates to a system and method for operating a refrigeration cycle of a heat pump.

2—BACKGROUND

Current electrical power generation plants from thermal energy mostly use heat engines and systems, based on the closed-loop Rankine cycle, with water as a working medium. In such plants, a fuel is burnt or a nuclear reaction is performed and controlled to produce thermal energy which heats the pressurised water in a boiler, where it also undergoes a phase change and produce a high pressure and high temperature water vapour. The vaporised high pressure gaseous working medium is further superheated to higher temperature and then fed to a turbine and allowed to expand across the turbine to release thermal energy and produce mechanical work. The low pressure and low temperature spent working medium leaving the turbine is condensed in a condenser where it undergoes a phase change to form liquid water. This condensation step is necessary in the conventional heat engines facilities so that the liquid water can be economically pumped and pressurized for recycling back to the boiler to be vaporised again to complete and repeat the closed-loop thermodynamic cycle of the heat engine (Rankine Cycle).

The need for the condensation stage in conventional power generating plants results in loss of a significant portion of thermal energy of the burnt fuels, which is used to heat and vaporise the working medium and is lost to cooling agents, such as sea water or river water or air used to cool the condenser. Furthermore, conventional power generating plants use very high fuel combustion temperatures of over 1273 K (1000° C.) to vaporise the working medium under very high pressures of over 6.00 MPa and at temperatures of over 750 K (480° C.). Operating power generating plants at such a high temperature and pressure require that those power plants to be constructed robustly.

Efficiency of the power plants operating on Rankine cycle is generally low and particularly of those plants utilising lower level (temperature) energies, and is also much lower than the corresponding theoretical Carnot cycle. Although the current operating conventional power plants have been adverse factors and environmental requirements result in higher initial specific investment cost per KW power.

Prior art such as 'Kalina Cycle' (U.S. Pat. No. 4,489,563, dated Dec. 25, 1984) and some other patents in the field of power generation, also describe other heat engines and approaches to power generation plants from both lower and higher temperature energy sources. Those systems generally use multi-component fluids as working mediums such as ammonia-water mixtures. Although they can operate at much less harsh conditions in terms of temperature and pressure, they are characterized by relatively low thermal efficiencies as compared to the relating theoretical Carnot cycle or even Rankine cycle. This is due mainly to the unavoidable loss of significant portion of thermal energy required for operation of those power cycles to cooling agents used for cooling and condensing the Working Mediums spent vapours.

Therefore the inventor has appreciated that it is advantageous to provide a heat engine system which is capable to operate at a lower working medium vaporisation temperature (such as ammonia) than conventional power generating plants operating on Rankine Cycle which operate mainly on water as the working medium, but under similar or even higher vapour and gases pressures to the turbines. The Inventor has further appreciated that it is desirable that the heat engine is also able to operate with minimum requirement for rejection of condensation latent heat of the spent working medium to the outside environment with cooling agents or preferably that the heat engine can operate without the need for rejection of condensation latent heat of the condensing step of the conventional power cycles to the outside environment.

Embodiments of the invention seek to provide a heat engine system which can combine some of the advantageous principles and criteria to generate power, while the ultimate aim and goal of the inventor is to improve efficiency of the heat engines and produce more work and power from the energy used to operate power plants.

Embodiments of the invention can utilise various sources of thermal energy from high temperatures of over 673 K (400° C.), which are obtained from combustion of the fossil fuels, to the low level temperatures, such as that of geothermal energy of about 403 K (130° C.) and power plants waste energy (condensation) or sea water or river water of any temperature of—say over 5° C. Accordingly, embodiments of the invention may include facilities which can process the induced thermal energy and generate power and facilities which can partially or fully preserve and recycle the latent heat of condensation of the working fluid within the boundaries of the thermodynamic cycle of the proposed heat engine. The recycled heat can then supplement the induced energy to vaporise more working medium to be fed to the power turbine and generate further power and improve efficiency of the novel heat engine.

3—SUMMARY OF THE INVENTION

The invention is defined in the appended claims to which reference should now be made.

In one aspect of the present invention, a system for recycling heat or energy of a working medium of a heat engine for producing mechanical work or other forms of energy is described. The system comprises heat exchanging means (204) for transferring heat from a working medium output from an energy extraction device (202) to a heating agent to vaporise the heating agent; second heat exchanging means (240) for transferring further heat to the vaporised heating agent; compression means (231) coupled to the second heat exchanging means (240) arranged to compress the further-heated heating agent; and third heat exchanging means (211) for transferring heat from the compressed heating agent to the working medium. The second heat exchanging means may transfer further heat to the vaporised heating agent from heating agent output from the first heat exchanging means.

This has the advantage that it avoids the need for a large number of separate compression stages and withdrawal facilities for the working medium condensate at the end of each of those stages, while utilizing the entire amount of the condensation energy, rather than rejecting it outside the system.

In some embodiments, heat exchangers are used. Usually, each heat exchanger has a first input, a second input, a first output and a second output. Embodiments of the invention find application as a heat engine for producing mechanical work comprising the energy recycling system previously described. The heat engine may comprise a turbine, such as a single or multi-stage turbine for producing mechanical work. The working medium output from the energy extraction device may be referred to as a spent working medium i.e. it comprises only a vapour or a vapour-liquid phase.

The further heating of the vaporised heating agent may be referred to as to superheating the heating agent. In some aspects, a single heat exchanging means may be provided rather than having a heat exchanging means and second heat exchanging means.

In a further aspect of the present invention, a high performance heat pump is disclosed which may use a heating agent such as n-Octane. The heating agent may be a refrigerant.

Heat pumps embodying the invention may have an improved Coefficient of Performance (CoP) compared to prior art heat pumps. The Coefficient of Performance may be defined as the quantity of energy delivered to the hot reservoir per unit of work input.

Embodiments of the invention may have a CoP, for example, of about 8 compared to conventional heat pumps which may have a CoP of about 1.5 under similar conditions of temperature.

Heat engines embodying the invention may have efficiencies in the range of 55% to 57% compared with conventional engines having efficiencies of up to 45%.

The working fluid used by embodiments of the invention may be any material with suitable thermodynamic properties, such as ammonia, ammonia-water mixtures, etc. The energy preserving and recycling materials (heating agents) can also be any material with suitable thermodynamic properties, such as n-octane, n-heptane, iso-octane, amylamine, butylformate, etc.

Pure ammonia and Ammonia-water mixtures have suitable thermodynamic properties and have been selected as a working fluid (as an example) for embodiments of invention, while n-octane has suitable thermodynamic properties and been selected as the heating agent fluid (also as an example) for the energy preservation and recycling system embodying the invention.

In some embodiments, two fluids and two operation loops for energy preservation and recycling are utilized.

Further, some embodiments recycle the entire energy of the spent working fluid by absorbing the energy of the spent working medium, even at very low temperatures such as below 7° C. and preferably by lifting the temperature of the absorbed waste energy to a very high level of the hot temperature reservoir to be used, preferably repeatedly, to vaporized working medium and generate power.

Some embodiments comprise a heat exchanger 256 and absorb energy from very low temperature level reservoirs sources, into the system and lift its temperature to the high temperature reservoir and generate power from it.

Some embodiments superheat the heating agent prior to feeding to the compressor, to minimize work or power requirements per unit weight of heating agent.

Embodiments of the invention may be applicable to any system which generates waste heat, and will recycle and preserve the waste heat.

Some embodiments work with relatively low temperature sources such as the spent working medium, even at very low temperatures (below 7° C.). Embodiments of the invention may include two integrated loops, which may comprise a work and preferably power producing loop; and energy recycling and preservation loop.

Embodiments of the invention may therefore recycle waste energy thereby preserving it within a thermodynamic cycle.

The main characteristic features and aspects of the present invention are that, it comprises heat preservation and recycling system which absorbs latent heat of condensation of the waste working medium from the work producing device and increase its temperature and recycle the absorbed heat back into the heat engine, this achieved by vaporizing heating agent in a heat exchanger where it absorbs the released latent heat of condensation of the waste working medium. The vaporised heating agent is preferably superheated and fed to a compressor, which compresses it and increases the corresponding temperature of the heating agent vapours. The high temperature heating agent is fed to a heat exchanger where it heats and vaporises the pressurised liquid working medium. The recycled heat of the waste working medium is added to the fresh induced heat to vaporize more working medium and produce further mechanical work and improve efficiency of the system. After releasing the recycled heat to the working medium, heating agent condenses and cools down and is depressurised and fed back to the heat exchanger to absorb latent heat of the waste working medium and repeat the heat recycling loop. Accordingly, the heat preserving and recycling system operates in a closed loop (first loop) and repeats the heat recycling process in a continuous manner.

The vaporized working medium from both fresh and recycled energy sources is preferably further superheated and fed to the mechanical work producing devices where it expands and produces mechanical work, and becomes the waste working medium at the outlet from the device. The wasted working medium is then condensed in a heat exchanger by vaporizing liquid heating agent, and the working medium condensate is pressurized by a pump to be fed back to the heat exchanger where it is heated and vaporized by the recycled and fresh heat energy and repeats the cycle. Therefore the mechanical work producing system also operates in a closed loop (second loop).

The proposed novel mechanical work (and power) producing heat engine therefore, includes operating facilities for at least two (2) operating closed loops, which can receive energy from outside and interact with each other in a manner to form a closed thermodynamic cycle, and generate power, and they are:

Mechanical work and energy (power) generation loop,

Energy preservation and recycling loop,

Furthermore, each of these two loops, can in turn, comprise more than one full operating closed sub-loops, which interact internally with each other to perform the ultimate function and role of the said main loop. Each loop or sub-loop can utilise a single component or multi component material as its working fluid (medium) to perform and achieve the aim of power generation or energy preservation recycling and.

Aspects of the present invention with a single component working medium are described according to the embodiments shown in FIG. 3, and aspects of the invention with multi component working medium version, are shown in FIG. 4. Embodiments of the two versions (variations) are similar in most aspects of construction and the involved operation facilities, but also have minor differences which are mentioned and described as applicable. These minor differences may not warrant separate names for the invention cycle for each working medium type, and is named "Atalla Harwen Cycle", "Atalla Harnessing and Recycling Waste and Water Energy Cycle" for either single component or multi-component working medium.

The embodiment characteristics and features of the interacting two loops to generate net power are made possible by the careful selection of the suitable materials for the power generating working medium and energy preservation and recycling heating agent and the corresponding suitable technological facilities and operation conditions of both loops. However, suitable thermodynamic properties of the heating agents for energy preservation and recycling loop can be contrasting with the suitable properties for working mediums for mechanical work and power generation, as they are required to perform different functions and are explained in sections of this report.

Each loop has joint facilities with the other loop mainly to exchange thermal energy between the working medium fluid and energy preservation and recycling heating agent, and some specific dedicated belonging facilities to perform the other required specific function of that loop, and is explained in the detailed description section.

In this summary, aspects of the present invention shown in FIG. 3, with the single component working medium is described, without stressing on belonging of specific features of the system to the separate operating loops, at this stage.

According to aspects of the present invention, there is provided a heat engine for producing mechanical work or other forms of energy, comprising means for one stage or progressive cooling and condensing to a liquid, vapours of a spent (waste) working medium (WM) produced by the engine as a result of the production of mechanical work. Spent working medium is also produced from the turbine of the energy preservation and recycling system compressor (heating agent) and superheating turbine and high pressure liquid ammonia pump turbine, if used. Operating conditions of all these stream of spent ammonia are controlled so that they can be mixed together at a specific pressure for subsequent processing. Condensation of the spent ammonia streams is conducted in a manner so that minimum or preferably no rejection of latent heat energy to outside environment of the operating thermodynamic cycle is involved. This is achieved by using and forcing the liquid heating agent n-octane to vaporize at the other side of the heat exchange surface of the condenser and absorb the latent heat of condensation of working medium.

The condensed working medium is fed to the hold tank, from where it is withdrawn and pressurized by a pump to the required pressure of the high pressure high temperature working medium at the inlet to the power generation turbine $P_1$. The pressurized liquid working medium is progressively heated and partially or fully vaporized in a series of heat exchangers at a significantly higher temperature by the effect of latent heat of condensation of the counter current direction vapours of n-octane, the heating agent of the energy preservation and recycling loop (heat pump).

Vapour-liquid mixture of the working medium, if not fully vaporized in the heat exchangers, is then fed to a flash separation tank or column to separate high pressure and high temperature vapours from the liquid. Vaporization of the required amount of working medium is completed in the flash separation column by means of a circulation loop of a pump and reboiler, with internal or external energy source. Vaporization temperature of the high pressure single component working medium in the separation flash tank is constant and depends only on the pre-selected vaporization pressure of the working medium (ammonia). However, the top vaporization temperature of the multi component working medium, such as ammonia-water mixture, depends on the selected pressure in the separation tank and the lean solvent concentration at the bottom of the separation column (tank).

The separated higher pressure and higher temperature working medium ammonia vapour may further be superheated in a heat exchanger (super heater) to improve the overall efficiency of the novel thermodynamic "Atalla Harwen Cycle". The superheated high pressure and high temperature working medium vapour is split into two or more streams. One main stream is fed to the power turbine to extract mechanical work or other forms of energy and as a result, produce the low pressure low temperature spent working medium and repeat the cycle. Similarly, the other main stream is fed to the turbine of the energy preservation and recycling system compressor (heat pump), as the source of providing the required mechanical power, to operate the energy preservation and recycling loop. Other streams can also be used: One such stream for the superheating boosting compressor, another stream to operate the working medium liquid high pressure pump, or other pumps and booster compressors, etc.

However, if the high pressure and high temperature working medium is fully vaporized in the heat exchanger upstream of the flash separation tank then, it can then by-pass the flash separation column (tank) and be fed directly to the super heater and split to the different turbines and pumps as explained above.

Condensation of the saturated spent working medium vapours is accomplished in the designated heat exchanger (condenser) of the spent working medium by utilising an energy preservation and recycling system loop (heat pump) with a suitable heating agent (in this case n-octane). The energy preservation and recycling system is arranged to allow vaporization of the liquid and cold heating agent n-octane in condenser of the spent working medium, under selected low pressure and temperature of the cold reservoir. The heating agent vaporizes and absorbs latent heat of condensation from the condensing working medium vapours on the hot side of the heat exchange surface. The vaporized heating agent n-octane is superheated in a super heater to a sufficiently high temperature, so that when compressed in the system compressor to the required high pressure will preferably not condense inside the compressor. Superheating of the low pressure heating agent in the said super heater is accomplished by utilizing several vapours and liquids streams of higher temperature of the compressed same heating agent n-octane, and the combined stream of the liquid heating agent is cooled down to the lowest possible temperature at the outlet from the super heater. The superheated low pressure heating agent is then compressed by the energy preservation and recycling system compressor in one stage or multi stages, to a sufficiently higher pr-selected pressure, which also raises condensation saturation temperature of the pressurised heating agent n-octane to a convenient level of the hot reservoir. The high condensation saturation temperature of the energy preserving and recycling agent is such that it is suitable to be used in another heat exchanger or vaporizer, to heat and vaporize as much as possible of the pressurized and heated liquid working medium prior to feeding to the flash separation tank. If the working medium is fully vaporized in the said heat exchanger (vaporiser), it can be directly fed to the super heater downstream of the flash separation tank. The condensed heating agent in the working medium vaporizer is a hot condensate and is then cooled to the lowest possible temperature by heating up the counter current flowing and pressurized cold liquid working medium ammonia from the pump, downstream of the working medium ammonia hold tank. The cooled heating agent streams from both the super heater of the low pressure vapours n-octane and liquid working medium ammonia heater are fed to the heating agent n-octane hold tank. The cold heating agent is withdrawn from the hold tank, depressurized and fed to the spent working medium condenser to be vaporized again and repeat the energy preservation and recycling system loop. The lower temperature of the cooled returned heating agent to the hold tank prior to de-pressurization and vaporization stage, improves both system efficiency and Coefficient of Performance (COP) of the energy preservation and recycling system compressor (heat pump).

It is preferred that a stream of the high pressure and high temperature superheated working medium is used to drive a turbine which in turn operates the energy preservation and recycling system compressor. It is also possible however, that the entire amount of superheated working medium ammonia is fed to the power turbine to generate electricity and then use electrical motor to operate the energy preservation and recycling system (compressor). Such arrangement will result in additional losses in the form of efficiency of the electric motor and other associated heating losses.

Conditions of the spent working medium ammonia from the energy preservation and recycling system compressor drive turbine are controlled to be similar to conditions of the spent working medium ammonia from the power turbine and both spent materials are mixed for condensation in a joint condenser.

When using multi component working medium, the hot and high pressure lean solvent is withdrawn from the bottom of the flash separation tank and is cooled in a heat exchanger by a portion of the cold rich solvent in the counter current direction through the said heat exchanger. The cooled lean solvent is then depressurized and mixed with the low pressure spent working medium vapours, which are then fully condensed by the effect of vaporizing heating agent in the condenser, as in the case with single component working medium.

Design, construction and interaction of the two loops of the novel power cycle is carefully arranged and operated, so that the two loops can properly and effectively interact both internally and with each other, and perform the required functions. For example, if condensation of vapour phase of spent working medium ammonia is required at low temperature end of the operation cycle, there is provided liquid phase of heating agent n-octane under conditions ready for vaporization at a lower temperature at the opposite side of the heat transfer surface (cold side). While vaporizing in the heat exchanger, it absorbs the released latent heat of the condensing working medium. At the high temperature end (side) of the "Atalla Harwen Cycle" the condensed liquid and cold working medium ammonia has been pressurised by the pump, ready to be heated and requires vaporization. There is then provided the vaporized and pressurized energy preservation heating agent n-octane with a suitable higher temperature, and is ready to condense and release its latent heat of condensation to vaporize the pressurized and heated working medium at the opposite side of heat exchange surface and at a little lower temperature. Flow rates of the working medium ammonia is set for the specified power generation capacity of the heat engine, for example at one kg/s, and the flow rate of the heating agent n-octane is controlled in each piece of joint equipment in a manner to ensure the supply or withdrawal of the required thermal energy by the working medium stream of one kg/s in the opposite side of the heat exchange, and also to ensure the minimal or preferably, no need for an outside cooling agents (sea water or river water) to reject energy to outside of the operation cycle.

By having such a heat engine comprising means for energy preservation and recycling through the condensation of the spent working medium vapours to a liquid at a low cold temperature by the effect of vaporizing a liquid energy preservation agent (heating agent) at even a lower temperature in the other side of the heat exchange surface, and use of the condensed cold working medium in another heat exchanger as a cooling means for the hot and condensed heating agent from the high temperature vaporizer of the high pressure working medium, means for elevating temperature of the vaporized heating agent from lower levels of the cold temperature reservoir of the working medium condensation to higher usable vaporization levels of the high temperature reservoir and partially or fully vaporizing working medium with the recycled and fresh sources of energy, the scheme can minimize and/or preferably avoid the need for the spent working medium condensation (condenser) with an outside cooling agent, which if utilised, results in significant energy losses to the external cooling agent as required by systems operating according to the prior art.

Overall efficiency of the novel heat engine is therefore improved, compared to that of the conventional Rankine cycle or Kalina cycle based heat engines. This is because no significant amount of induced energy is lost (rejected to outside the cycle) due to the use of a condenser with extensive amounts of external cooling agent.

The spent working medium ammonia produced by the engine as a result of power generation, is usually a gaseous spent (waste) working medium. However, the waste (spent) working medium ammonia may be partially condensed to liquid and mainly stays as gaseous.

Embodiments of the invention can operate at a lower temperature mode and in a less harsh environment than that of conventional power plants operating on Rankine Cycle. Furthermore, conventional power plants may be readily modified to include a heat engine according to embodiments of the invention.

4. BRIEF DESCRIPTION OF THE DRAWINGS

An embodiment of the invention will now be described, by way of example only, with reference to the accompanying drawings in which:

FIG. 24 shows Temperature-Entropy (T-s) diagram of n-Octane showing steps of the energy preservation loop with Multi stage (4 stages) compression of n-octane from the saturation state at point B and withdrawal of condensate at the end of each stage;

FIG. 31 shows superimposed Temperature-entropy (T-s) diagram of n-octane (as the heating agent) and ammonia (as the working medium) to form the integrated "Atalla Harwen Cycle"; and FIGS. 32, 32A, 32B, 32C, and 32D show the pages of a Table No. 1 representing a model power plant process and operation according to embodiments.

5—DETAILED DESCRIPTION OF THE PREFERRED EMBODIMENTS OF THE INVENTION

Figure 1:
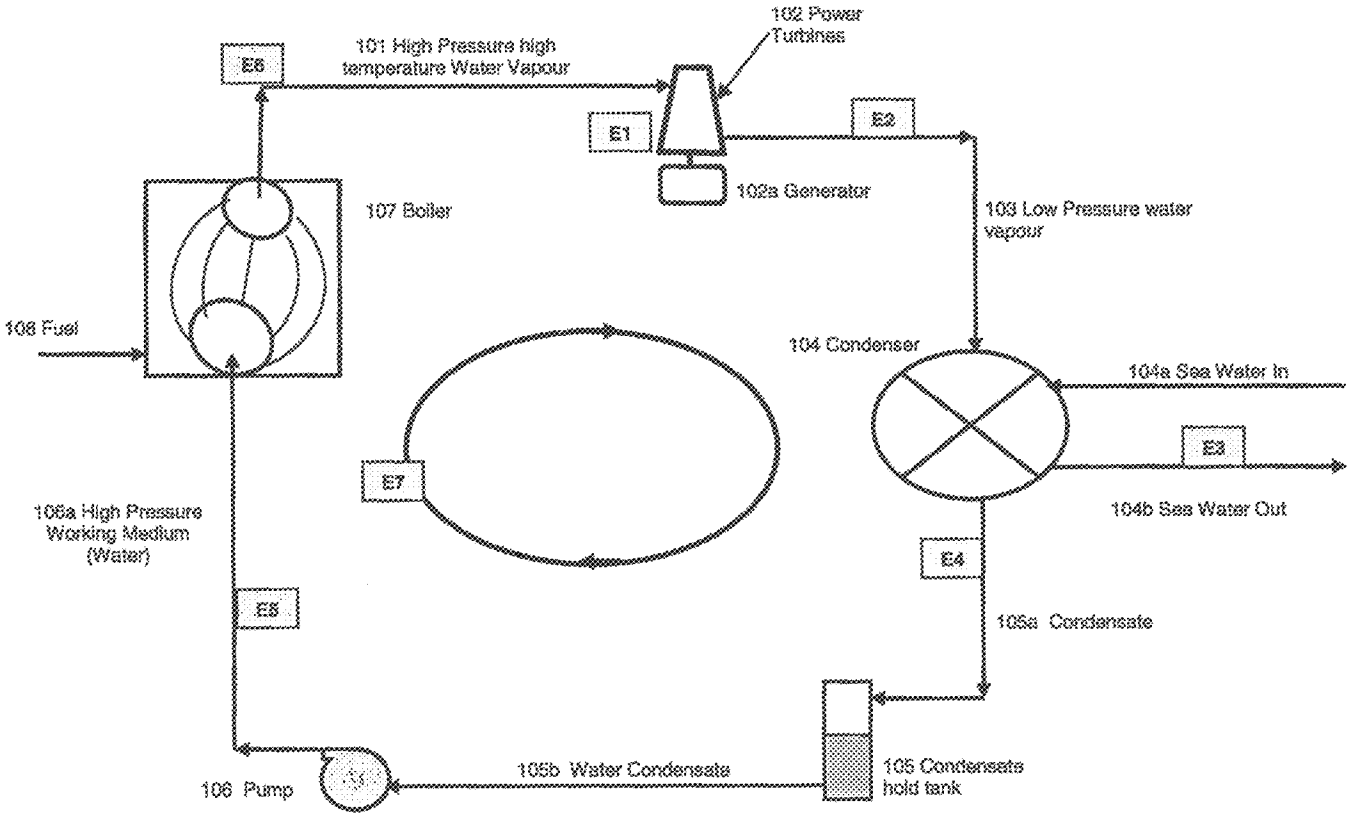
FIG. 1 shows a schematic diagram of a thermodynamic cycle used in a conventional Rankine power plant.

In the drawings, like features have been given like reference numerals. Referring now to FIG. 1, represents the typical conventional power generation unit operating on Rankine cycle. The main steps performed by a conventional power generation plant are:

a—Working medium pressurization, b—High pressure working medium vaporization in the boiler, which is heated by the direct fuel firing, c—Superheating of the high pressure and vaporized working medium from the direct firing, d—Feeding the superheated high pressure and high temperature working medium to the turbine, e—Isentropic expansion of the working medium through the turbine, mechanical work and power generation and production of the spent low pressure and low temperature working medium f—Condensation of the spent working medium in the condenser, which is cooled by an outside coolant such as sea water, g—Feeding the condensed working medium to the hold tank, h—Withdrawal of the liquid working medium and pressurization by the pump, And repeat the cycle, These operation steps will now be described in details.

Liquid water 105*b* is withdrawn from the hold tank 105 and is pumped by a pump 106 from a low pressure to a sufficiently high pressure by inputting energy. The high pressure liquid water enters a boiler 107 and is vaporized under high pressure and at high but constant saturation temperature by inputting energy released from the burnt fuel 108. This results in a phase change of the water from a liquid to a high pressure and high temperature saturated water vapour, which typically is at this stage has a temperature of 573 K to 623 K (300 to 350° C.) degrees Celsius and pressure of 4.0 to 10 MPa (40 to 100 bar), The saturated high pressure and high temperature water vapour produced from the boiler 107 is further superheated by energy of the released fuel burning, to a higher temperature of about 823 K (550° C.) under the same pressure of 4.0 to 100 MPa. The superheated high pressure and high temperature water vapour 101, is fed to a turbine 102. In the turbine 102, the superheated water vapour (gas) undergoes isentropic expansion and a portion of its internal thermal energy is converted to mechanical work. Water Vapours expansion in the turbines can be in one stage or in several, but mostly 2, stages. The lower pressure and lower temperature spent water vapour 103 leaving the turbine 102, which typically at this stage has a temperature of 323 to 373 K (50 to 100° C.), and a pressure of 0.025 to 0.1 MPa (0.25 to 1.0 bar abs), is then condensed to a liquid in condenser 104, resulting in a phase change and energy rejection or loss to the cooling medium 104*b* (sea water). In the condenser 104, water vapour condenses from a volume of about 1.7 to 5.0 $m^3$/kg to a liquid volume of 0.001 $m^3$/kg under pressure of 0.10 MPa (1.0 bar abs), and this process results in the loss of the latent energy of vaporization of about 2300 kJ/kg of water (560 kcal/kg) to the returned sea water 104*b*. This is a significant amount of lost energy to the outside environment (coolant) and results in lower efficiencies of the power plants operating on Rankine cycle, which are typically between 33% to 40%, and for super high pressure systems, efficiency can be up to 45%.

Figure 3:
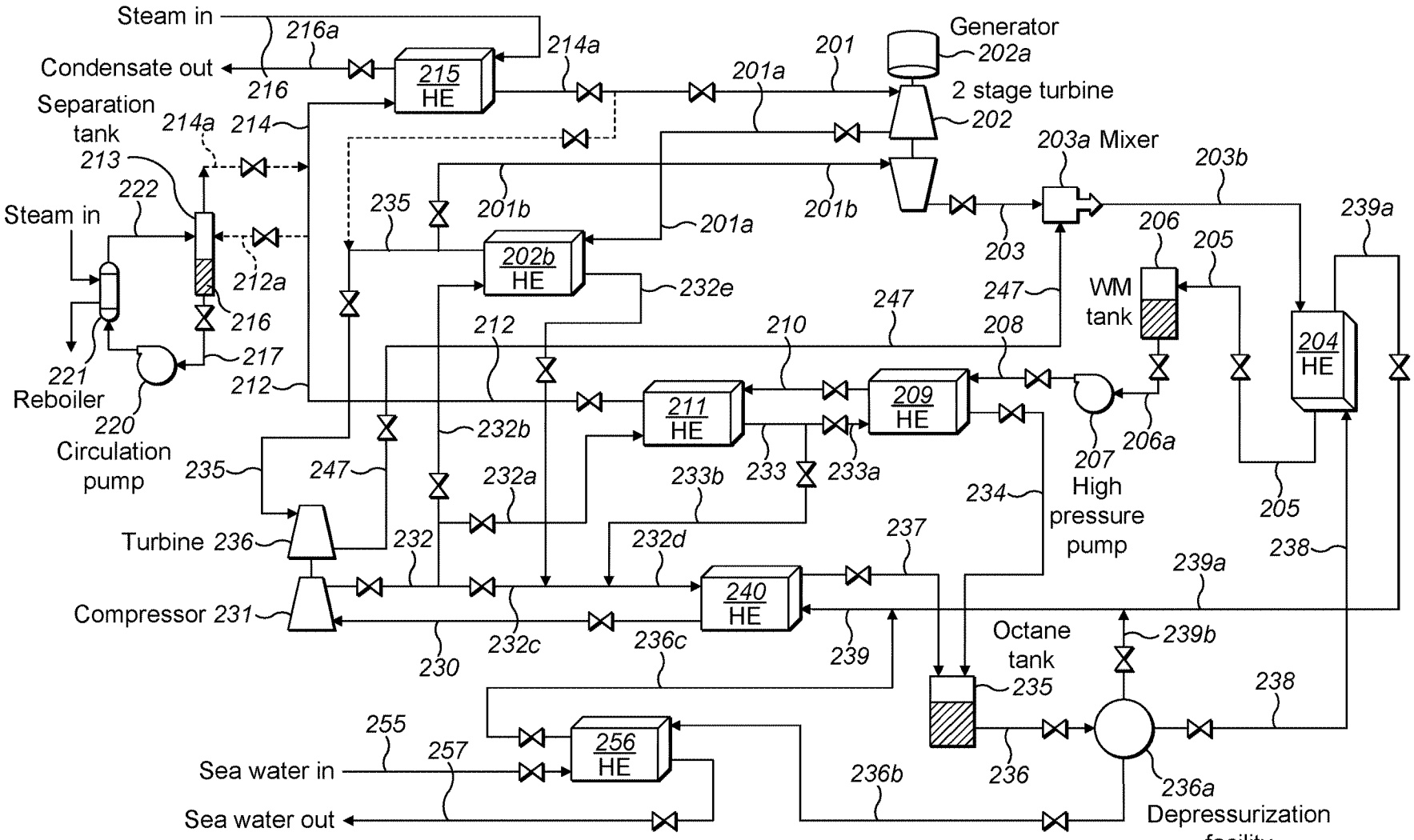
FIG. 3 shows schematic diagram of thermodynamic cycle and the novel heat engine with single component working medium system—"Atalla Harwen Cycle"

Referring now to FIG. 3, it represents the typical conventional power plant operating on Kalina cycle, operating with an ammonia-water mixture as the working medium. The main steps performed by a conventional power generation plant operating on Kalina cycle are similar to those of Rankine cycle, in terms of:

High pressure pumping of the liquid working medium 106*a*,

Vaporization of the liquid working medium in a boiler or heat exchanger and formation of a high pressure gaseous working medium, 107*a*

Feeding the high pressure and high temperature gaseous working medium to a turbine 102*a* and extraction of useful work or other forms of energy, Condensation of the spent working medium in a heat exchanger 104*a*, with the outside coolant (loss of energy to the outside environment)

Feed the condensed working medium 104*ca* to the hold tank 105*aa*,

Withdraw the liquid working medium 105*ba* and pressurise it in the pump 106*a*, And repeat the cycle, The main differences between these two conventional power cycles, Rankine and Kalina cycles are described as follows:

Kalina cycle operates with much lower energy source temperature in the boiler 107*a*, Kalina cycle has a higher turbine 102*a* back pressure of over 0.5 MPa (5 bar), to allow for condensation of ammonia-water working medium mixture vapours in the sea water condenser 104*a*, Kalina cycle includes recycling of the hot lean solvent 107*ca* from separator 107*ba*, which is cooled, depressurized and then mixed with the spent working medium 103*a*, and the vapour-liquid mixture is then fed to the sea water condenser (heat exchanger) 104*a*. The process involves cooling the recycled lean solvent to the sea water condenser temperature with fully condensed working medium vapours and the mixture becomes a rich solvent which is heated again to the top temperature of the high pressure vapours leaving the boiler, Kalina cycle also has few additional pieces of equipment, such as:

Lean solvents heat exchangers 106*a* and 105*aa*,

Separation tank 107*ba* for separation of high pressure high temperature working medium vapours from the lean solvent liquid, Due to the lower temperature of the energy source and narrower operation range of temperature of the Kalina cycle and other embodied factors, efficiency of power plants operating on Kalian cycle is generally much lower than efficiencies of power plant operating on Rankine cycle. The option to use Kalina cycle in favour of Rankine cycle in the power generation plants is therefore, confined to cases where temperature of the energy source is relatively low and cannot provide the suitable conditions for high pressure working medium water vaporization as required for plants operating on Rankine cycle.

Figure 2:
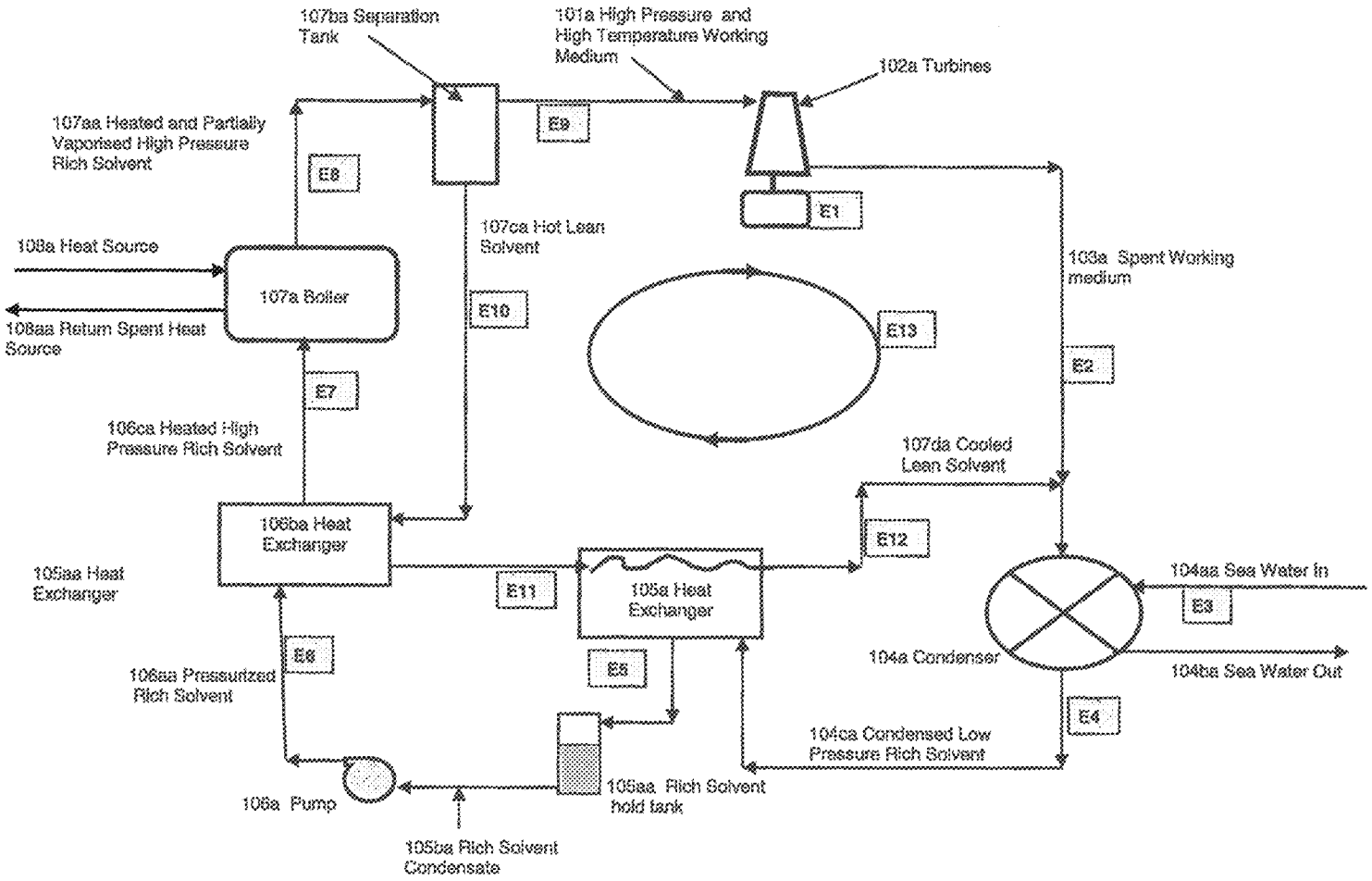
FIG. 2 shows a schematic diagram of a thermodynamic cycle used in a conventional 'Kalina' power plant.

Referring now to FIG. 2, a heat engine 200 with a single component working medium according to embodiments of the invention, and referring to FIG. 4 a heat engine 300 with a multi component working medium according to other embodiments of the invention will be described;

Embodiments of the two variations of the proposed novel heat engine 200 and 300 are similar in most aspects of construction and operation, but also have minor differences, which are mentioned as applicable. The main embodiment aspects and features of the proposed power cycle (plant) for either type of working mediums, is that the involved heat engine comprises two (2) individual but actively interacting closed loops, which are Work and power generation closed loop facilities, Energy preservation and recycling closed loop facilities.

Furthermore, any of these two loops can include one or more sup-loops which can be similar or different in configuration. Sub-loops of each main loop, interact with each other to perform the ultimate role and functions of the corresponding main loop. This embodiment is particularly applicable to the energy preservation and recycling loop and less likely for power generation loop. Characteristics features and performance of the interacting sub-loops and main loops to generate net power are made possible by the careful selection of suitable materials (operation fluids), techno-mechanical facilities and operation conditions of both main loops and sub-loops, including:

Working medium (single or multi component) for the power generation loop,

Solvent of the working medium in the cases of multi component working mediums,

Energy preservation and recycling loop fluid (heating or cooling agent),

Approximate temperature elevation level, between the cold and hot reservoirs,

Number of sub-loops of each main loop, if applied,

Superheating level of the working medium and heating agent, where applicable,

Number of expansion stages of the power turbines,

Number of compression stages of the energy preservation and recycling compressor, Mechanical equipment selection and proper sequential arrangement, Etc.

Working mediums which are suitable to be used in the power generation loop of the novel system can be:

Single component material such as ammonia or any material with suitable thermodynamic properties close to those of ammonia, Water is used mainly as the working medium in Rankine cycle plants, where fuel burning temperature can reach very high levels suitable for vaporization of water under high pressures and condensation temperature of the spent water vapours from the turbines, is sufficiently high to allow the use of sea water or river water or atmospheric air as the coolants, Multi component fluid for working medium, which comprises a mixture of two or more low and high boiling materials with favourable thermodynamic properties and wide range of inter-solubility, such as ammonia-water mixture (also used in Kalina cycle), Multi component fluid for working medium, which comprises a mixture of various hydrocarbons, various freons, or other materials, When using multi component fluids as working mediums such as ammonia-water mixtures, difference between the boiling temperature of the lower boiling working medium component (WM) and solvent is preferably more than 100 degrees K.

Energy preservation agents (or heating agents) which are suitable to be used in this invention for the energy preserving and recycling loop may be any material with suitable thermodynamic properties, such as:

n-Octane, n-Heptane, n-Hexane

Butylformte,

Diethylamine,

Pentylamine,

Pentylalcohol, etc,

Some important thermodynamic properties of these energy preserving and recycling agents (materials) are highly desired and are carefully selected to be contrasting with the same thermodynamic properties of working mediums of the power loop (ammonia and water vapours). For example, value of the exponent (k) in the adiabatic equation of state of gases is very important:

$$PV^k = \text{Constant} \qquad \text{Eq 1}$$

Where:

P—is the gas pressure at the start of intended process

V—is the gas volume at the start of intended process k—is the adiabatic expansion exponent The adiabatic expansion exponent k is expressed in terms of ratio of the specific heats of gas under constant pressure ($C_P$) to specific heat of the said gas under constant volume ($C_V$), as follows:

$$k = C_p / C_V \qquad \text{Eq. 2}$$

While it is desired that the value of expansion exponent (k) to be as high as possible for the working mediums (ammonia and water) and preferably close to that of ideal gases of:

$$(k) = 1.4$$

For ammonia (k)=1.310 at temperature of about 288 k (15° C.) and

For water vapours (k)=1.315 at temperature of about 388 k (115° C.)

For ammonia-water mixtures (k) is expected also to be similar and is =1.315

It is desired that the expansion exponent (k) or (n) in the generalised adiabatic equation of state, is as low as possible and preferably below:

$$(n) \leq 1.065$$

For n-octane (n)=1.0227 at temperature of about 298 k (25° C.)

These thermodynamic characteristics are explained later in this report.

Components and processes of the two main loops of the novel power scheme interact with outside environment and with each other to create the necessary conditions for the aimed energy preservation and recycling within the operation cycle and generation of more useful mechanical work and power. Each loop has some joint facilities with the other loop mainly for thermal energy exchange and some specific dedicated belonging facilities to perform other required function for completing operation of the involved closed loop. Embodiments of the FIG. 3 for the single component working medium and in FIG. 3 for the multi component working medium of this invention show typical components of the two loops and are explained below.

Embodiments of the heat engine 200 or 300 comprise a mechanical work and power generation loop and an energy preservation and recycling loop, and the power generation Loop comprises dedicated means 202 or 302 for converting potential energy of the vapours pressure of expanding working medium to mechanical work, means 206 or 306 for storing (holding) condensed liquid working medium, means 207 or 307 for pumping and pressurizing liquid working medium, means 213 or 313 for the flash separation of the high pressure and high temperature working medium vapours 214 or 314, from the liquid working medium 216 or lean solvent 316, means 215 or 315 for heat exchange (super heating), means for conveying the high pressure and high temperature working medium 208 or 308, or the spent (waste) working medium 203 or 303, from one component of the heat engine 200 or 300, to another component of the same heat engine 200 or 300, and in the case of multi component working medium heat engine 300, comprises further means of heat exchange 319, embodying the invention, and the mechanical work and power generation loop of the heat engine 200 or 300 further comprises joint means with energy preservation and recycling loop for heat exchange 204, 209, 211 and 202*b* or 304, 309, 311 and 302*b* and means 246 or 346 for providing mechanical work and drive for the compressor 231 or 331. In the embodiments 200 or 300 a line, or pipe, or tube or other means for conveying the working medium vapours and liquid connects the turbines 202 and 246 or 302 and 346 to the working medium hold tank 206 or 306 and separation flash tank 213 or 313 respectively, via various heat exchangers.

Figure 4:
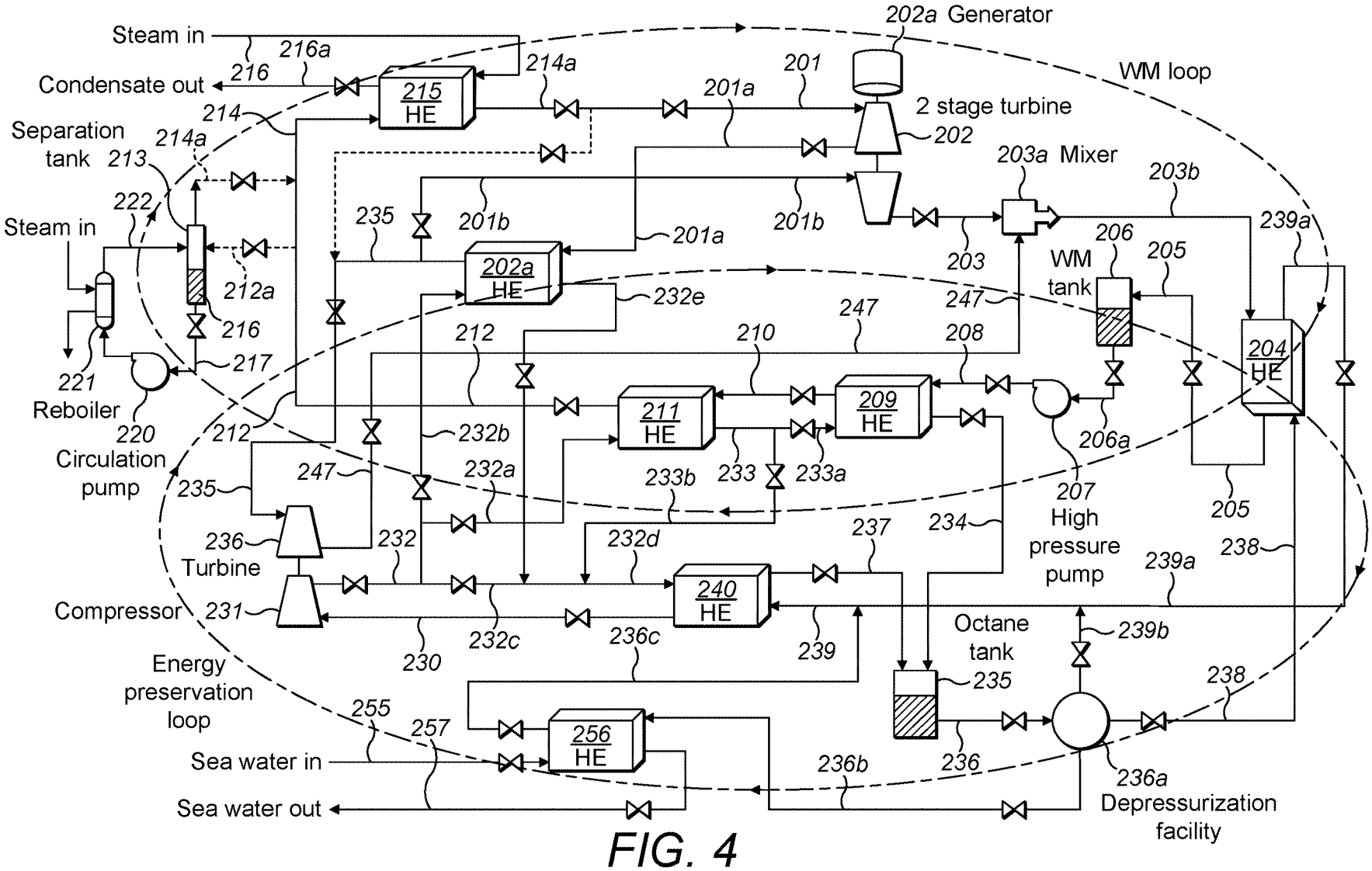
FIG. 4 shows schematic diagram of thermodynamic cycle and the novel heat engine with single component working medium system—"Atalla Harwen Cycle"
Figure 5:
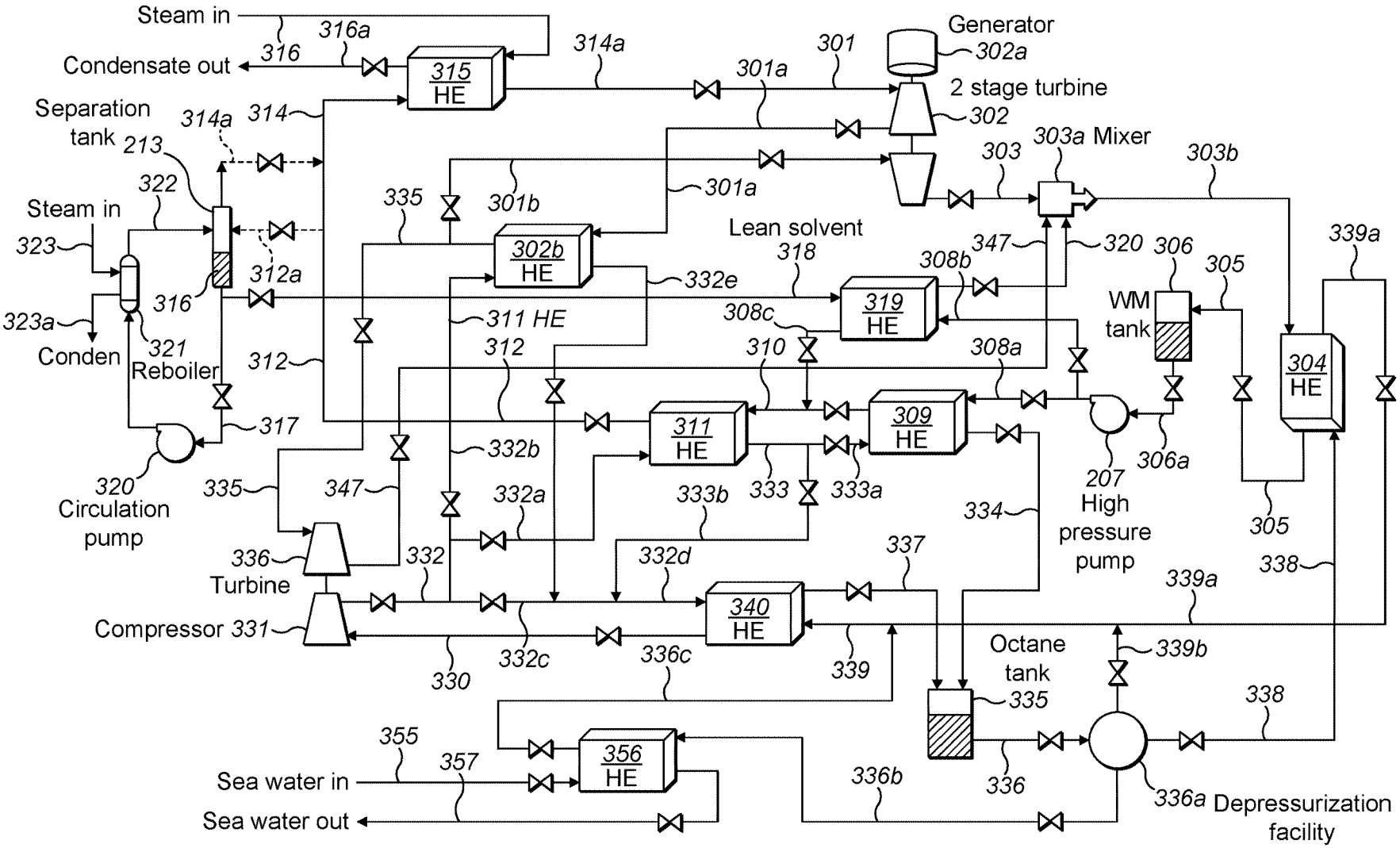
FIG. 5 shows schematic diagram of thermodynamic cycle and the novel heat engine with a binary component working medium system—"Atalla Harwen M Cycle"

In the embodiments shown in FIG. 2 or FIG. 4, the heat engine 200 or 300 further comprises an energy preservation and recycling loop which comprises dedicated means 240 or 340 for superheating the vaporised low pressure heating agent, means 231 or 331 for compressing the superheated heating agent, means 235 or 335 for receiving and storing the condensed heating agent, and the energy preservation and recycling loop of the heat engine 200 or 300 further comprises joint means with power generation loop for the heat exchange 204, 209 and, 211 and 202*b* or 304, 309, 311 and 302*b* and means 246 or 346 for providing mechanical work and drive for the compressor 231 or 331.

In the embodiments 200 or 300 a line, or pipe, or tube or other means for conveying the heating agent vapours and liquid connects the compressor 231 or 331 to the heating agent hold tank 235 or 335 via various heat exchangers, and a line, or pipe, or tube or other means for conveying the working medium vapours connects the turbines 246 or 346 to the working medium line from the heat exchange 215 or 315 to the spent working medium vapours and liquid line from the turbine 202 or 302 respectively, The main difference between embodiments of the invention with single component and multi component working mediums, shown in FIGS. 2 and 3, is the extra set of heat exchanger 219 of the lean solvent, with the multi component working medium.

It is reasonable therefore for simplification, to describe and explain the invention embodiments shown in FIG. 3 for the single component working medium and the selected set of operation conditions, in sufficient details, to represent also the embodiments shown in FIG. 4 for the multi component working medium, with all equipment and streams of embodiments shown in FIG. 4, to be designated reference numbering 300, instead of 200, and with comments where applicable.

In the embodiments shown in FIG. 2, the heat engines 200 comprises facilities of both the mechanical work and power generation loop and energy preservation and recycling loop, and the power generation loop comprises a mixer 203*a* which is arranged to receive streams of the low pressure and low temperature spent working medium (in this example ammonia) 203, and 247 from the turbines 202 and 246 and any other streams of the spent working mediums such as the vent vapours and booster compressors turbine from alternative embodiments which are explained later in this section, and the combined stream of the spent working medium 203*b* is fed to heat exchanger-condenser 204. Condensation temperature of the working medium vapours (pure ammonia), depends on its condensation saturation pressure in the condenser 204. For example, under a selected pressure of 0.55077 MPa (5.5077 bar), condensation temperature of pure ammonia is about 280 K (7° C.). The condensed working medium 205 is fed to the hold tank 206, and the volume of the hold tank 206 is sufficiently large to store the necessary quantities of the working medium for the smooth and continuous operation of the novel system. Liquid working medium ammonia 206*a* is withdrawn from the hold tank 206, pumped by the pump 207 and pressurized in one stage or several stages to the required pressure $P_1$ (for example to 7.25 MPa-72.5 bar) which is suitable for the selected vapour pressure of the working medium ammonia at the inlet to turbines 202 and 246, which is selected at pressure of 7.135 MPa (71.35 bar) and allow for the flow and mechanical losses. After pumping, the cold working medium is heated and partially or fully vaporized by the effect of hot streams of the heating agent in the heat exchangers 209 and 211, and is fed to the separation flash tank 213. Other arrangements of the heat exchanger can also be made which can perform same or similar heat exchange functions. If for example the working medium is fully vaporized in the heat exchanger 211, it can by-pass the flash separation tank and be fed directly to the super heater 215.

The separation flash tank (or column) 213, which is arranged to receive the high pressure heated and partially or fully vaporized vapour-liquid mixture of the single component working medium (pure ammonia) 212, and to separate the vaporized portion of working medium 214 from the liquid working medium 216 at the bottom of the separation flash tank 213. The separation flash tank 213 is also provided with a liquid circulation pump 220 and reboiler 221 to circulate liquid working medium through the reboiler which provides the necessary external or internal energy for vaporization of the required additional amount of working medium to ensure supply of the necessary quantities of the working medium for operation of the turbines 202 and 246. Top temperature of vaporization of the high pressure working medium in the separation tank, which is also temperature of the liquid working medium at the bottom of the separation tank, depends on constant pressure of vaporization (saturation) of the working medium in the separation flash tank 213. For example if the pressure of vaporization of the working medium "ammonia" inside the separation flash tank is selected and set at 7.135 MPa (71.35 bar), the corresponding vaporization constant temperature of ammonia will be about 380 K (107° C.).

Volume of the separation flash tank (column) 213 is sufficiently large to provide suitable space for the ready flashing and separation of the vaporized working medium from the liquid single component or multi component working medium. The vaporized saturated working medium (ammonia) 214, at high pressure and high temperature leaves the separation tank from a suitable exit and can further be superheated (optionally but preferably) in the heat exchanger 215 by the effect of a low, medium or high pressure steam 216, or internal higher temperature energy source.

The high pressure and high temperature superheated working medium (ammonia) 214*a* at the outlet from the super heater 215 is divided into two main streams, which are:

1. Stream 201 of the superheated working medium is fed to the turbines 202, where it is allowed to expand and produce mechanical work or other forms of energy, which includes the net energy output of the novel system power plants, 2. Stream 245 of the superheated working medium is fed to the turbine 246, to provide the required power (mechanical work) which operates the energy preservation and recycling system compressor 231, Other arrangements of these streams can also be made which can perform same functions of mechanical work provision and/or power generation. If for example the turbine 202 is a multi stage unit with interim superheating and have sufficient energy for provision of mechanical work for compressor 231, then the stream 245 can be made and provided after the first stage of expansion as shown in FIG. 3, the embodiments of the heat engine 200.

Other streams of the high pressure and high temperature superheated working medium 214*a* at the outlet from the super heater 215, can also be provided to operate the high pressure liquid working medium ammonia pump 207, or for further boosting and elevation of temperature of a portion of the energy preserving agent from stream 232, or others. However, these streams are expected to be much smaller than the said two main streams and spent working medium from those streams is added to the spent working medium from the turbines 202 and 246 for condensation in the heat exchanger 204, and repeating the mechanical work and power generation loop.

The gaseous working medium ammonia 201 entering the turbine 202 is usually a high pressure gas having typical pressure $P_1$ of above 7.135 MPa (71.35 bar) and a temperature $T_1$ of above 400 K (127° C.). Any other suitable pressure and temperature of the working medium can be selected at the inlet to the turbines 202 and 246, which depend on many factors and considerations of specific conditions of each case. The gaseous working medium ammonia is allowed to undergo isentropic expansion in the turbine 202 under controlled conditions, and provides rotational mechanical work, or other types of mechanical work, which may be used to generate electrical power in a generator 202*a*, or perform other types of work. The spent working medium ammonia exits the turbine 202 under significantly reduced but controlled pressure $P_2$ and at a corresponding lower temperature of $T_2$. For example of ammonia as the working medium, if the outlet pressure (back pressure) from the turbine 202 is selected at 0.55077 MPa (5.5077 bar), then the corresponding saturation temperature of the spent working medium will be about 280 K (7.0° C.). Working medium stream 245 undergoes similar conditions when fed to turbine 246 and provides mechanical work for the energy preservation compressor 231. Any other suitable back pressure of the spent working medium can be selected at the outlet of the turbines 202 and 246, which depend on many factors, and will determine the corresponding outlet temperature of the working medium.

Turbines 202 and 246 can be of one or more stages of working medium expansion, and in this particular case it is selected of two stage expansions with interim superheating. In the first stage high pressure and superheated high temperature ammonia is expanded from 71.35 bar to 25 bar and exits the first stage 201*a* which is still at high pressure. It is then fed to the super heater 202*b* to be superheated again by a stream of the hot vapours of the heating agent stream. The interim super heated ammonia is then fed to the second stage of the turbine 202 and is expanded to the final spent working medium 203 which exits the turbine 202 under significantly reduced but controlled pressure $P_2$ and at a corresponding lower temperature of $T_2$, As mentioned above. Selection of superheating temperature and the number of expansion stages are made to minimize and preferably eliminate condensation of ammonia inside the turbine in both stages of expansion, and is described in the thermodynamics section. It is possible to feed the outlet from the super heater 202*b* mainly to the turbine 246 and the excess amount of the working medium ammonia to the $2^{nd}$, stage of the turbine 202, as shown in the embodiments of FIG. 3.

Conditions of the spent working medium from the outlet of turbine 246 are controlled and are preferably the same as those from turbine 202, so that the two streams can be joined again. The spent working medium streams from turbines 202 and 246 (and others if applied) are mixed in the mixer 203*a* and the combined stream 203*b*, is transferred again to the heat exchanger/condenser 304 to be condensed 205, sent to the working medium hold tank 206, to be fed to the high pressure pump 207 and repeat the power generation loop (internal cycle).

In the embodiments shown in FIG. 2, the heat engine 200 further comprises an energy preservation and recycling system (based on heat pump principle) with a compressor 231 driven by an electric motor or preferably driven by a turbine 246 which is operated by the high pressure working medium to provide the required mechanical work. Compressor 231 can be one stage or multi stages and receives the low pressure low temperature vaporized heating agent (in this example n-octane) 230 from the heat exchanger (super heater) 240, and compresses it to a suitable high pressure at the outlet of the compressor, stream 232. Pressurisation level of the energy preservation and recycling heating agent (n-octane) is selected in a manner so that it will increase the corresponding condensation saturation temperature of the pressurized n-octane to a level, when it is condensed at the selected high pressure, the released condensation latent heat energy of the heating agent, is suitable for use in the heat exchanger 211, to heat and partially or fully vaporize the high pressure working medium (ammonia) 210 in the heat exchanger 211. The pressurized heating agent n-octane 232 at the outlet from the compressor 231 is divided into several streams which are used in different parts of the heat engine 200 for different purposes, and they are (in this particular example):

a—Stream 232*a* which is used in the heat exchangers 211 and 209, b—Stream 232*b* which is used in the heat exchanger (super heater) 201*b*, c—Stream 232*c* which is used in the heat exchanger (super heater) 240, Main portion of the pressurized heating agent n-octane stream 232*a* is fed to the heat exchanger 211, where it condenses (changes phase to liquid) and releases its latent heat which is used to heat and partially or preferably, fully vaporize the pressurized and heated working medium (ammonia) stream 210, entering heat exchanger 211 from the other inlet. Condensed and hot heating agent (n-octane) 233*a* is fed to the heat exchanger 209 and is cooled in one stage or progressively, to the lowest possible temperature, by the effect of the counter flowing pressurized and cold liquid working medium ammonia 208 on the other side of the heat exchange surface, to improve efficiency and 'Coefficient of Performance (COP)' of the energy preservation and recycling compressor (heat pump principle). The cooled heating agent 234 from the heat exchanger 209 is fed to the heating agent hold tank 235.

Heating agent stream 232*b* is fed to the super heater 202*b* to superheat the partially expanded working medium ammonia 201*a* from $1^{st}$ stage of turbine 202. In the heat exchanger 202*b*, heating agent 232*b* condenses (changes phase to liquid), and releases its latent heat to be used for super heating the partially expanded working medium ammonia 201*a* (interim heating in the heat exchanger 202*b*) and the superheated ammonia 201*b* is fed back to the $2^{nd}$ stage of turbine 202. The condensed heating agent 232*e* which is at the saturation high temperature is mixed with other streams and fed to the super heater 240.

Stream 232*c* along with the condensed high temperature streams 232*e* and 233*b*, are fed to the super heater 240 to superheat the low pressure energy preservation and recycling heating agent (n-octane) vapours stream 239 to a sufficiently high temperature so that when it is compressed in the compressor 231, there is minimal or preferably no condensation of the heating agent n-octane inside the compressor. Liquid heating agent (n-octane) 237 from the corresponding outlet of the heat exchanger 240 is cooled to the lowest possible temperature and is also fed to the heating agent hold tank 235. Lower cooling temperature of the liquid n-octane is achieved by utilizing the very low temperature vaporized heating agent n-octane from the working medium condenser 204, which is at temperature of only about 274 K (1.0° C.), in the other side of the heat exchange surface. Volume of the hold tank 235 is also sufficiently large to store the necessary quantities of the energy preserving agent (heating agent) for the smooth and continuous operation of the novel system The cold energy preservation and recycling agent n-octane 236 is then withdrawn from the hold tank 235, and depressurized in the facility 236*a* to a lower level, stream 238, suitable to be used in the heat exchanger 204 to cool and condense the spent working medium ammonia vapours 203*a* in one stage or in more than one stage. The depressurized liquid heating agent n-octane 238 vaporizes (changes phase to vapours) at temperature of about 274 K (1.0° C.) in the heat exchanger 204 and receives the released condensation latent heat energy from the condensing saturated vapours of the spent working medium ammonia 203*b* which is at temperature of about 280 K (7° C.) on the other side of the heat exchange surface, and accomplish condensation of the saturated working medium to liquid 205. Depressurization of the cold liquid heating agent n-octane causes also the flash vaporization of a small portion of n-octane 239*b*, which absorbs (compensates) the energy loss of the flashing and decreasing temperature of n-octane liquid—say from temperature of 283 K (10° C.) to 274 K (1.0° C.). Excess portion of the depressurised liquid working medium 236*b*, which is not required in the heat exchanger 204 (as is explained in the thermodynamics section of the processes), and is at temperature of 274 K (1.0° C.) is fed to the sea water heat exchanger 256 and is vaporized 236*c* by the effect of higher temperature sea water at about 284 K (12.0° C.) plus. All streams of the low pressure vapour of the heating agent (n-octane) 239*a*, 239*b* and 236*c* are joined in one stream 239 and is fed to the heat exchanger (super heater) 240.

In the heat exchanger 240 the low pressure n-octane vapours are heated to a sufficiently higher temperature that when it is compressed in compressor 231, minimum or preferably no condensation of the heating agent (n-octane) will take place. Amount of thermal energy in the said streams 239*a*, 239*b* and 236*c*, is sufficient to super heat the low temperature n-octane stream 239, from 274 K (1.0° C.) to over 355 K (82° C.), which is the desired temperature prior to feeding to the compressor 231, as will be shown in the modelling example, The superheated n-octane vapours stream 230 is fed to compressor 231 to be compressed to the required pressure of stream 232 and repeat the energy preservation and recycling loop.

In the embodiment shown in FIG. 2 of the heat engine, an example of the expected operation component of the heat exchanger sets 204 and its functions are presented. The combined low pressure vapours 203*b* of the single component spent working medium (ammonia) streams 203 and 247 flow from the mixer 203*a* and are fed to the heat exchanger 204 from one inlet, where the vapours are cooled and condensed which can be in one stage or stage wise manner and the ammonia condensate 205 leaves the heat exchanger 204 from the corresponding outlet and is fed to the working medium hold tank 206. The spent working medium ammonia vapour 203 is cooled and condensed in the heat exchanger 204, and even though its saturation condensation temperature is only 280 K (7° C.), it actually represents the hot side of the heat exchanger. Liquid and colder energy preservation and recycling heating agent n-octane 238, is withdrawn from the hold tank 235 via depressurization facility 236*a*, at temperature of 274 K (1.0° C.) and is fed to the other inlet of heat exchanger 204 and is vaporized by effect of the hotter and condensing working medium ammonia vapours 203 at temperature of 280 K and the heating agent absorbs the condensation latent heat of condensing ammonia. The vaporized heating agent n-octane 239*a* leaves heat exchanger 204 from the corresponding outlet at temperature of about 274 k (1.0° C.), and the heat exchange side of the heating agent n-octane represents therefore, the cold side of the tube surface of heat exchanger 204.

If the heat exchanging material on either side of the heat transfer surface is a single component pure material (for this example pure ammonia), then the condensation temperature is constant under specific pressure, such as ammonia condenses at temperature of 280 K under the pressure of 5.5077 bar. Vaporization temperature of the single component pure material coolant (energy preservation and recycling agent, n-octane) at the opposite side of the heat exchange surface is also constant under specific corresponding pressure, such as vaporization temperature of 274 K, under constant pressure of 0.00466 bar. However, in the case of multi component working medium such as ammonia-water mixture in one side of the heat exchange surface, then condensation temperature of the working medium will be a range, which reflects concentration of the high boiling solvent water in the condensed mixture at the start and end of the condensation process. For example condensation of the working medium vapours of ammonia-water mixture starts from temperature of 298 K (25° C.) and ends up at temperature 280 K (7.0° C.) under a constant pressure of about 5 bar. Such a range can actually provide a better temperature difference (delta T) for the heat exchange process. In another example, if working medium stream (303*b*) is involved, which is a multi component material such as ammonia-water mixture with a specific concentration of water in ammonia, then if condensation temperature starts from temperature of about 325 K (62° C.) under the pressure of 0.75 MPa (7.5 bar), then condensation of the entire stream 303*a* will be completed at about 294 K (21° C.).

In general, movement and transport of all the involved liquids, gaseous and vapour streams, such as 201, 203, 205, 206*a*, 208, 210, 212, 214, 230, 232, 233, 236, 237, 238 239, 245, 247, 250, 252, 255 and 257 between those heat exchangers and apparatus is accomplished through the lines or pipes or tubes.

In summary, embodiments of the heat engine 200 comprises feature which include means for storing (holding) liquid working medium 206, means for pressurizing liquid working medium 207, means for the flash separation of the high pressure and high temperature working medium vapours 213 from the liquid working medium 217, means for converting energy of the vapour's pressure to mechanical work 202, means for the heat exchange 204, 209, 211, 215, 202*b*, 240 and 256, means for energy preservation and recycling agent compression 231, means for providing mechanical drive 246, means for storing (holding) liquid heat preservation agent 235 and lines or pipes or tubes or other means for conveying the high pressure and high temperature working medium 208, or the spent (waste) working medium 203, or the pressurized heating agent vapours 232 or the liquid heating agent 236, from one component of the heat engine 200 to another component of the heat engine 200 embodying the invention.

With this arrangement of embodiments of the operation cycle, latent heat of condensation (thermal energy) of the low temperature spent working medium ammonia vapours in the heat exchanger 204 is preserved, boosted and recycled (transferred) from heat exchanger 204 to heat exchangers 211 and 209. The purpose of this energy preservation and recycling loop is therefore, to preserve and recycle as much as possible, preferably the entire amount, of the condensing thermal energy (latent heat) from the condensing spent working medium, boost its temperature level and return it to be used and re-used for heating the pressurized and cold liquid working medium ammonia streams 208, 210 and 211 to the highest possible temperature and also to vaporize a portion or full amount of the working medium ammonia in the heat exchanger 211, and produce more mechanical work and power from the induced energy into the system.

In the embodiment shown in FIG. 4 of the heat engine 300, there is the variation of heat engine operation with a multi component working medium, such as ammonia-water mixture. As mentioned earlier, generally, most aspects of this embodiment of the heat engine are similar to the embodiment of FIG. 3 of the engine with single component working medium, with the following main construction and mainly operation differences:

There is a rich solvent 305 instead of the pure single component (pure) material 205, There is lean solvent 317 circulation loop instead of the single component material 217 circulating loop, There is the additional lean solvent heat exchanger 319, In an alternative embodiment shown in FIG. 4 the heat engine 200 further comprises an energy preserving system with two sub-loops No 1 and No 2, and can have more than two sub-loops, and each of the sub-loop 416 and 417 and other sub-loops, is an integrated, separate and distinctly operating closed loop. Each sub-loop performs a portion of the main loop of absorbing the latent heat of condensation of the spent working medium 203*b* in the heat exchanger 204 and elevating temperature of the vaporized heating agent A from the level of cold reservoir of vaporization of heating agent (A) stream 238 in the heat exchanged/condenser 204, to the final compressed heating agent temperature of the final sub-loop, in this case heating agent (B) stream 432, at the outlet of compressor 431, which is the high temperature of the hot reservoir, and is suitable to be used in the heat exchanger/vaporizer 211, to heat and vaporize the single component working medium 210 or rich solvent 310.

In more details, compressor 231 of the sub-loop No. 1 elevates temperature of the vaporized heating agent A stream 239 from the heat exchanger/condenser 204, the cold reservoir temperature, to a pre-selected level suitable interim temperature to be used in the heat exchanger 405 to heat and vaporize heating agent B stream 436*d*, which is then fed to compressor 431 of the sub-loop No 2 to be compressed to a suitable level pressure and elevate temperature of the outlet stream 432 to the level of the high temperature hot reservoir of the heat engine 200, which is suitable to be used in the heat exchanger 211, to heat and vaporize the pressurized single component working medium 210, and the corresponding outlet stream 212, is fed to the separation flash tank 213. The condensed heating agent A stream 233*a* is fed to the heat exchanger 209 to heat the pressurized liquid working medium 208, and the resulting cooled heating agent A stream 234, is fed to the hold tank 235, and then to the heat exchanger/vaporized 204, to be vaporized by the hotter condensing spent working medium from the turbines 202, and repeat the sub-loop No. 1 function. The condensed heating agent B streams 436 and 437 are fed to the hold tank 435 and then to the heat exchanger/vaporized 405 to be vaporized by the hotter condensing heating agent A from the compressor 231 and repeat the sub-loop 2 function, Compressor of the energy preservation sub-loop No 1 is powered by the turbine 246 and compressor of the energy preservation sub-loop No 2 is powered by the turbine 446 which receives the high pressure and high temperature working medium stream 445 from the stream 214*a*, from the super heater 215, and the spent working medium 447 is added to other streams of working medium and condensed in the heat exchanger 204 or 304. Other arrangements of such scheme can be suggested and made and they will perform the required ultimate function of preserving and recycling as much as possible to the latent heat of condensation of the spent working medium in the heat exchanger 204.

Figure 6:
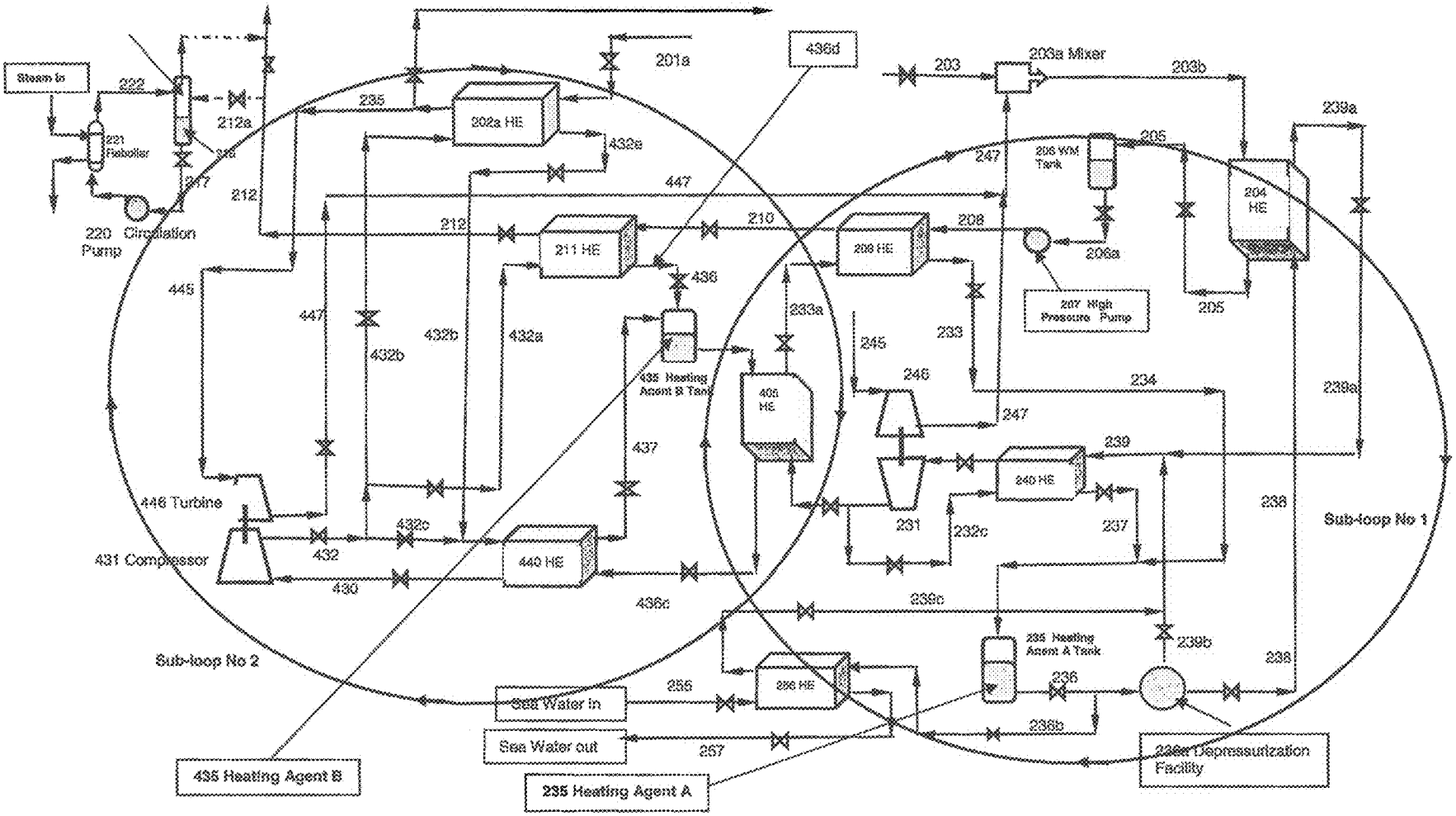
FIG. 6 shows schematic diagram of the novel heat engine "Atalla Harwen Cycle" with single component working medium system and comprising two sub-loops of the energy preservation system.

In an alternative embodiment shown in FIG. 6 the heat engine 200 further comprises means to deliver the high temperature vapours of heating agent 501 from the outlet of the energy preservation and recycling system compressor 231 to a heat exchanger or reboiler 221 of the single component working medium or lean solvent circulating loop of the separation flash tank 313. Temperature of the condensing vapours of the heating agent should be higher than the required temperature of the single component working medium or lean solvent at the bottom of the flash separation tank 213, by 10° C. to 15° C. to effect efficient heat transfer and boiling of the single component working medium or lean solvent. The condensed heating agent 502 is returned and added to the condensed heating agent 232*e* from heat exchanger 202*a* to be fed to the heat exchanger 240 (super heater) for cooling down to the suitable lowest level and fed to the hold tank 235 and repeat the energy preservation and recycling loop (heat pump cycle). Operating such a scheme shall be within the boundaries of keeping the overall material and heat balance of the system (cycle)

Figure 7:
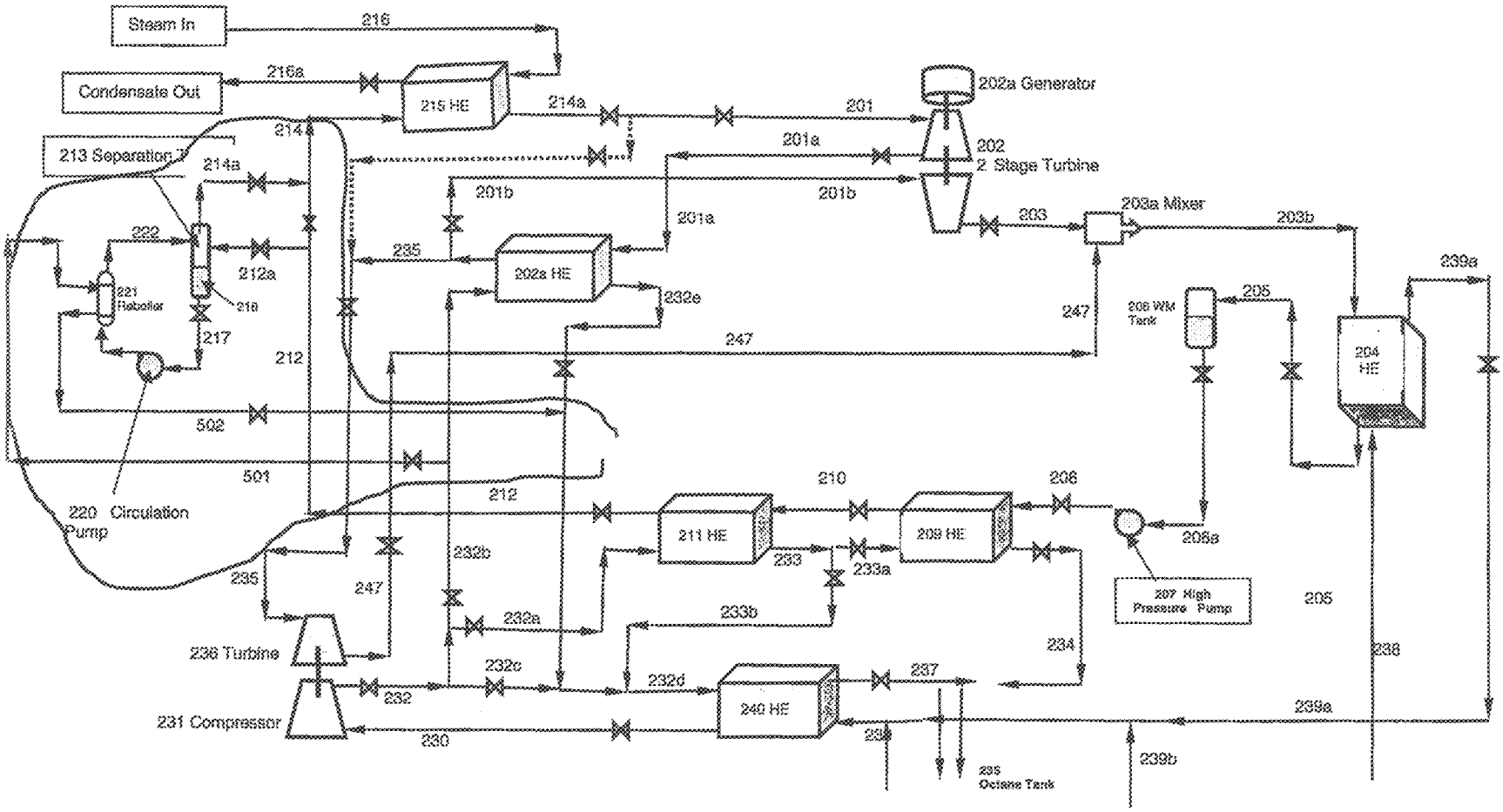
FIG. 7 shows schematic diagram of thermodynamic cycle and the novel heat engine with a binary or single component working medium system—"Atalla Harwen Cycle" plant and comprising a heating agent loop to provide energy for the separation tank reboiler.

In an alternative embodiment shown in FIG. 7 the heat engine 200 further comprises an energy preservation sub-loop system (also operating on heat pump principle), to produce and deliver higher level thermal energy to the high pressure and vaporized working medium 214 interring heat exchanger 215 for superheating the single component or multi component working medium. The energy preservation sub-loop comprises a booster compressor 602 which receives a stream of the vaporized high pressure heating agent 601 from the outlet of compressor 231 and further compresses it to a suitable higher pressure and proportionally increase condensation saturation temperature of the heating agent 603 at the outlet of the compressor 602. The high pressure and high temperature heating agent 603 is fed to the super heater 215, instead of the live medium or high pressure steam, to increase temperature of the working medium 214 to the required level. Heating agent 603 condenses in the super heater 215 and exits the said heater 604, which is then added to the condensed streams of heating agent 233 and fed to the heat exchanger 209 for cooling down to the suitable lowest level and sent to the hold tank 235. From the hold tank, the cold heating agent 237 is withdrawn and depressurized to the suitable level and is fed to the heat exchanger 204, and repeats the energy preservation main loop and sub-loop (heating internal cycle). Working medium turbine 607 is utilised to provide the necessary mechanical power for compressor 602, and receives a stream of high pressure high temperature super heated working medium 606 and the spent working medium 608 is added to the other spent working medium streams 203 and 247 to be condensed in the heat exchanger 204, and repeat the power generation loop (internal cycle). Operating such a scheme shall also be within the boundaries of keeping the overall material and heat balance of the system (cycle)

Figure 8:
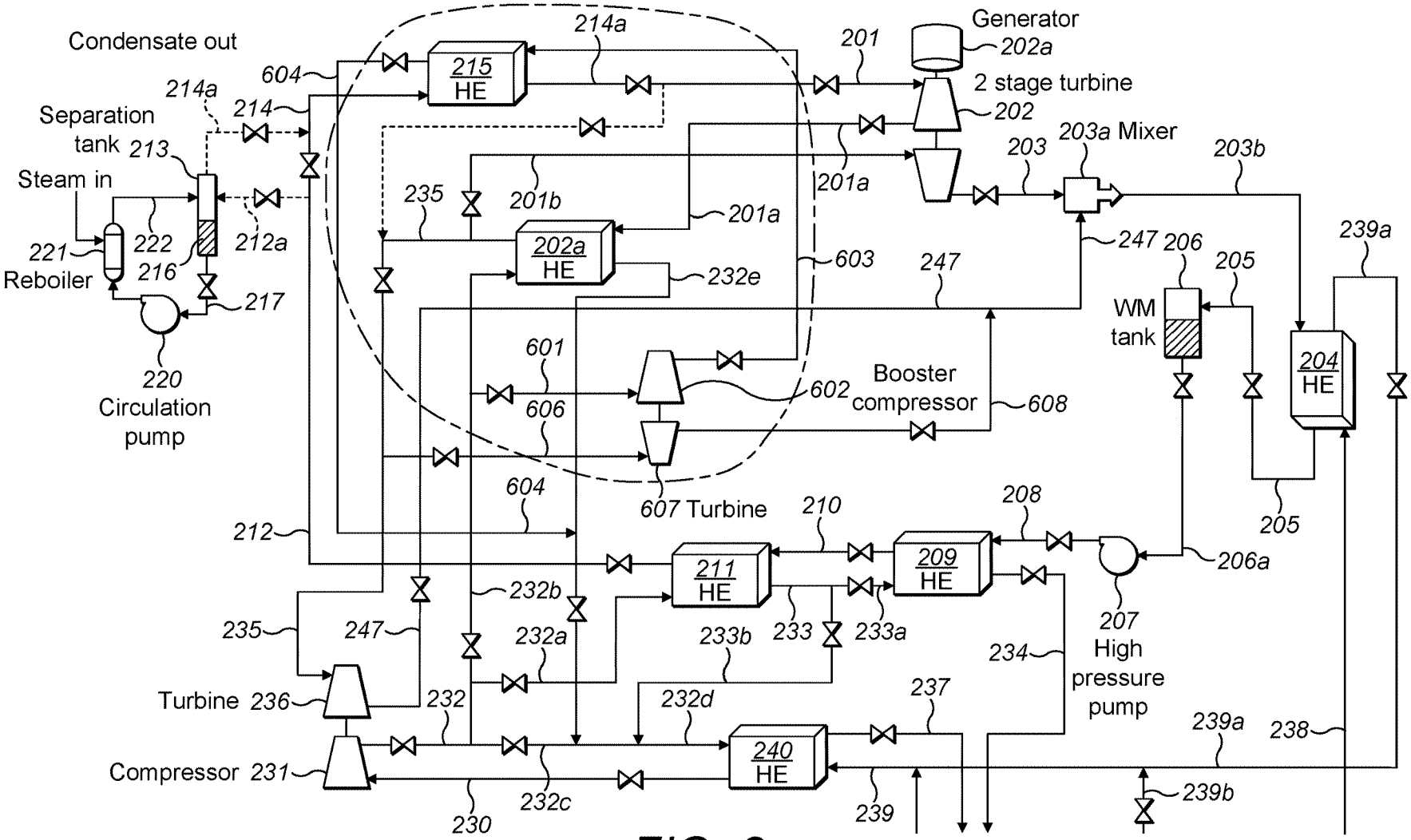
FIG. 8 shows schematic diagram of thermodynamic cycle and the novel heat engine with a binary or single component working medium system—"Atalla Harwen Cycle" plant and comprising a super heater compressor system.

In an alternative embodiment shown in FIG. 8, the heat engine 300 further comprises a dual liquid pump 701, which receives the high pressure lean solvent 702 from the outlet of the heat exchanger 319. The high pressure lean solvent drives the dual liquid pump 704 to pump and pressurize a portion of the low pressure rich solvent 705 which is received from the rich solvent hold tank 306. The spent low pressure lean solvent 703 leaves the dual liquid pump and is mixed with other low pressure streams 303, 347 and 352 to be fed to the heat exchangers 304. The pressurized rich solvent 706 leaves the dual liquid pump and is added to the rich solvent stream 308*a* and 308*b*, which are pressurized by the electric pump 308. Stream 308*a* is fed to the heat exchanger 309 while stream 308*b* is fed to the heat exchangers 319. After these heat exchangers the two streams are combined and fed to the heat exchanger 311 and then to the separation flash tank 313.

Figure 9:
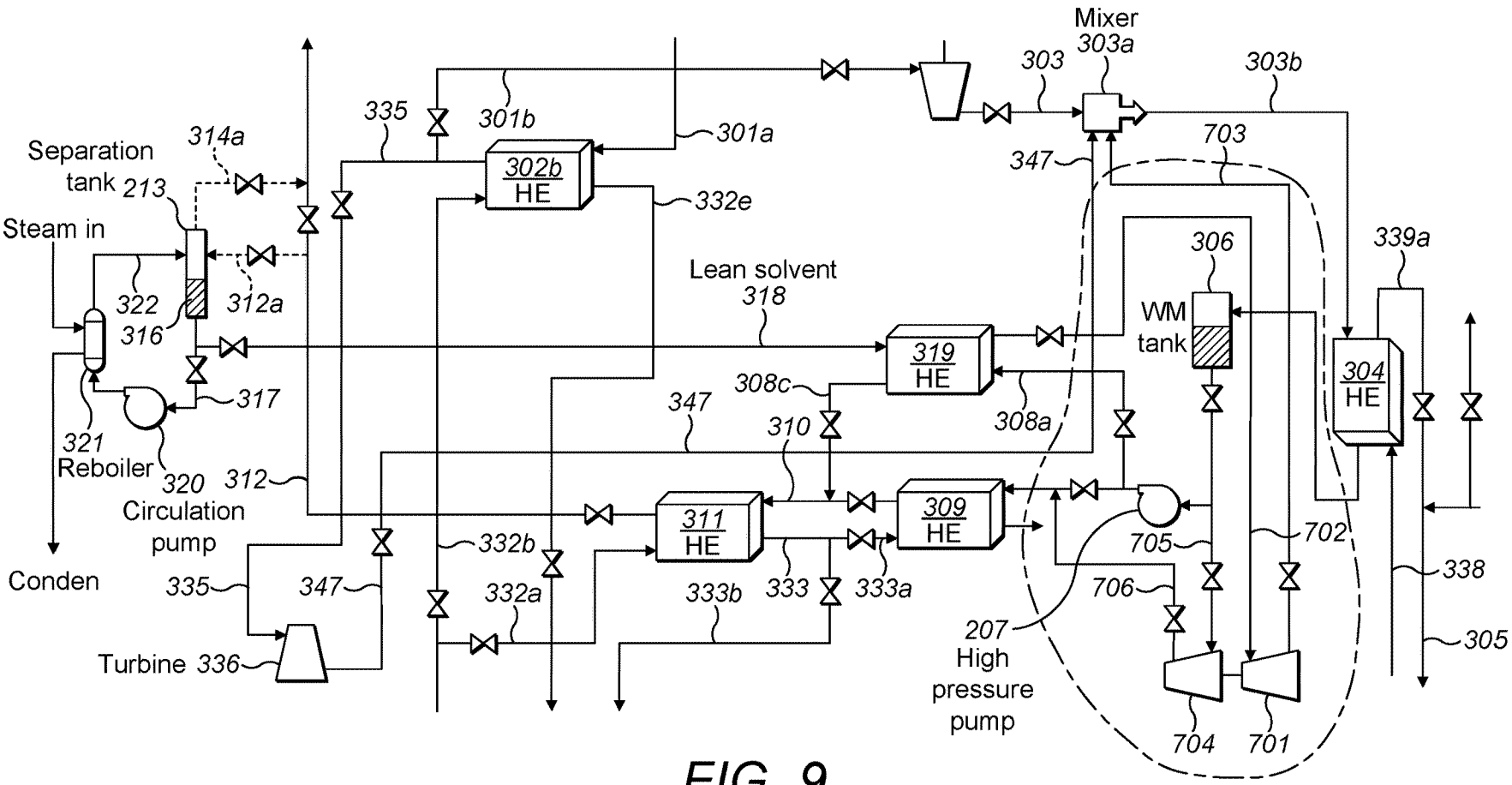
FIG. 9 shows schematic diagram of the novel heat engine "Atalla Harwen Cycle" with a binary component working medium and comprising a dual liquid pump for pumping working medium.

In an alternative embodiment shown in FIG. 9 the heat engine 200 further comprises a vent 801 from the top or any other suitable point of the working medium hold tank 206, which is used to control pressure inside the single component or rich solvent hold tank. The vented vapours of the working medium 801 are fed to the booster compressor 802, which is driven by electric motor but also can be driven by a turbine similar to that of the booster compressor 602 of the embodiment 600 of the heat engine, and increases pressure of the re-compressed vent vapours to a level suitable to be added to the other spent working medium streams 203, 247, 608, etc. The controlled reduction of the liquid working medium pressure and hence, temperature of the single component but particularly the rich solvent can be used to improve operation control and efficiency of the novel system.

Figure 10:
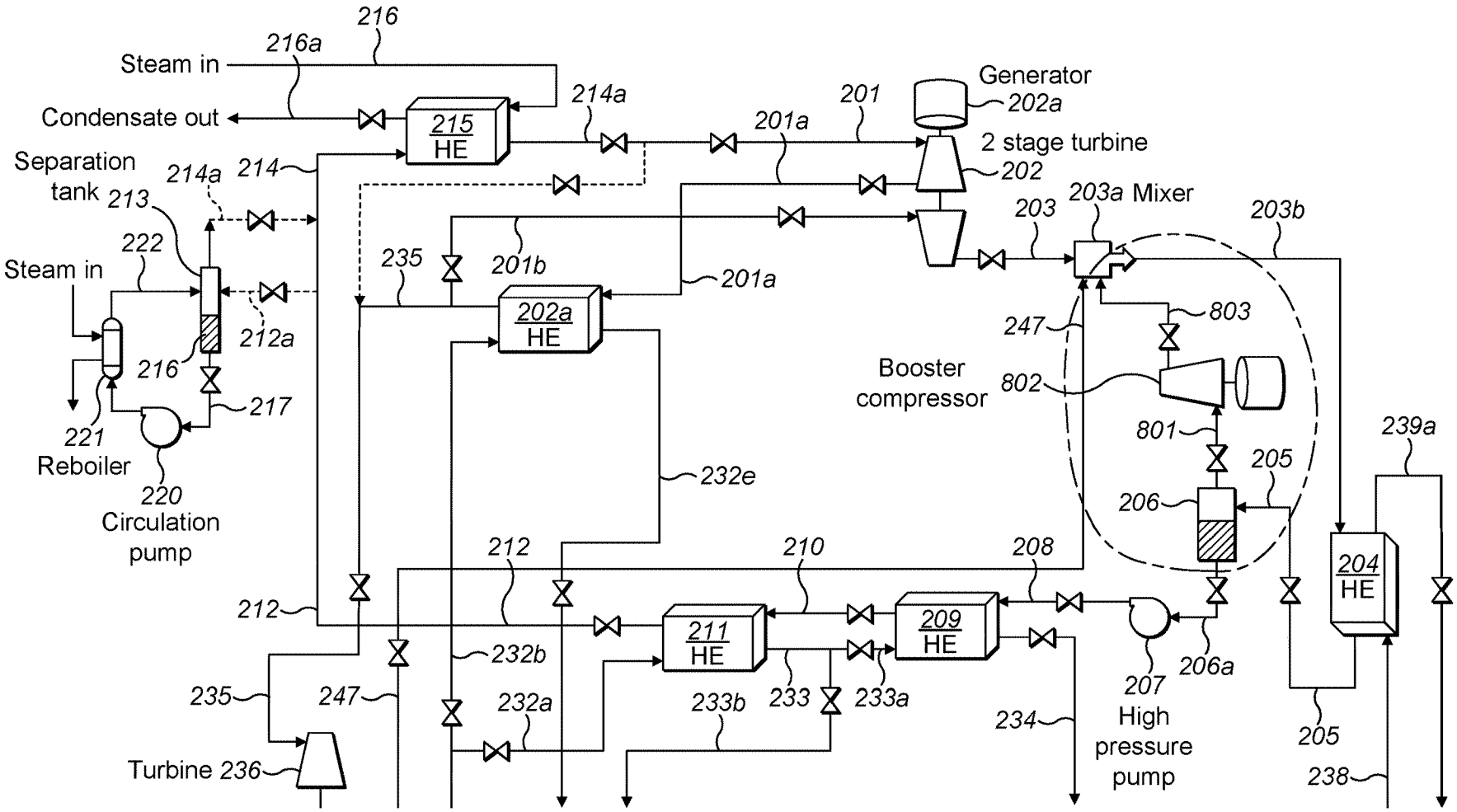
FIG. 10 shows schematic diagram of the novel heat engine "Atalla Harwen Cycle" with single component working medium system (ammonia) and comprising a booster compressor for the vent ammonia from the hold tank 206.

In an alternative embodiment shown in FIG. 10 the heat engine 200 further comprises a direct fired heat exchanger 900, which is used to superheat the high pressure and high temperature saturated working medium 214 from the outlet of the flash tank separator 213. The high pressure and high temperature working medium stream 901 (or 214) is fed to the heat exchanger 900 which is heated by a direct fire of burning some suitable fuel 904 and air 905 to provide the required energy. The superheated working medium 902 to the required temperature is fed to the power turbine 202, 246, 607, etc as required by the heat engine. This embodiment can supplement and/or substitute the super heater 215.

Figure 11:
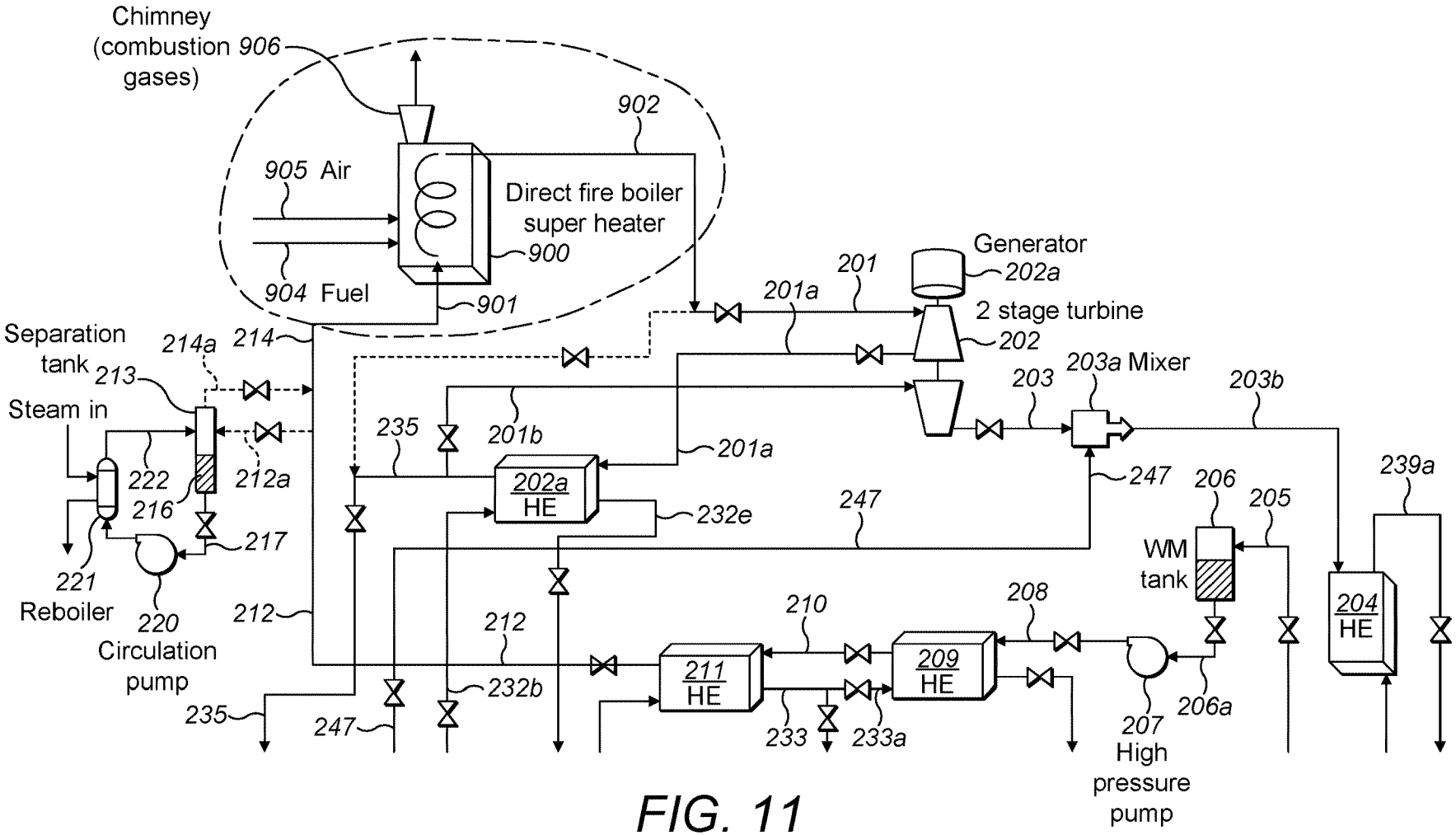
FIG. 11 shows schematic diagram of the novel heat engine "Atalla Harwen Cycle" with single component working medium system (ammonia), and comprising a direct fired super heater.

In an alternative embodiment shown in FIG. 11 the heat engine 200 further comprises a direct fired boiler 1000, which is used to generate suitable pressure steam 1002 to be used to super heat the working medium high pressure and high temperature stream 214 in the heat exchanger (super heater) 215. Treated water and condensate 1005 is withdrawn from the hold tank 1004, pumped by the pump 1006 and is fed 1001 to the boiler 1000, which is heated by a direct firing of suitable fuel 1007 with supply of air 1008. The generated steam 1002 is fed to the super heater 215 to provide the required energy for superheating the high pressure and high temperature saturated working medium 214. Condensed water 1003 is fed back to the hold tank to be treated, pressurized by the pump and repeat the heating loop.

Figure 12:
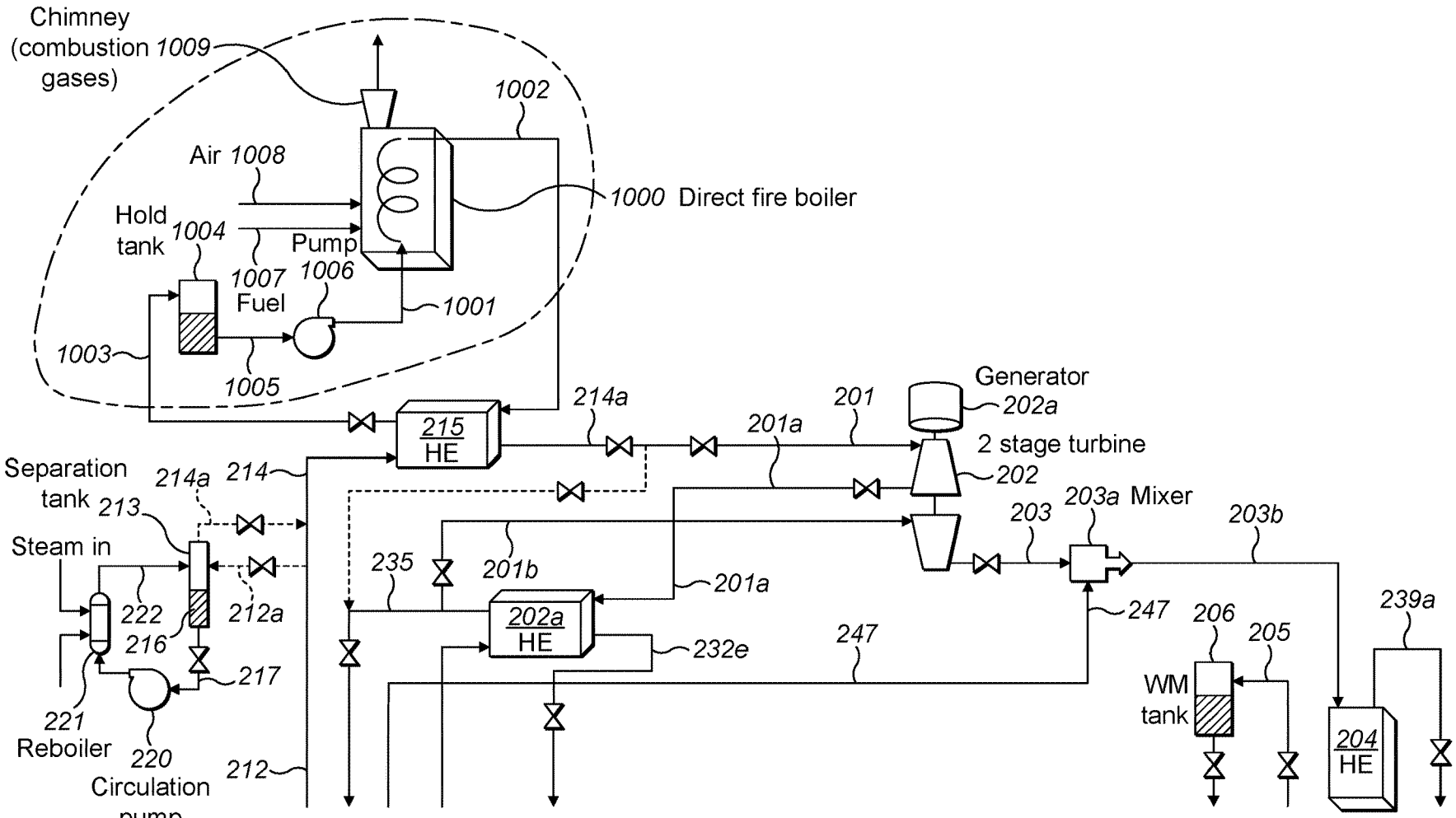
FIG. 12 shows schematic diagram of the novel heat engine "Atalla Harwen Cycle" with single component working medium system (ammonia), and comprising a direct fired heater (boiler) and steam generated super heater and/or a source of outside energy into the system.

In an alternative embodiment shown in FIG. 12, the heat engine 200 further comprises a heat exchanger (256) arranged to receive higher temperature heating agent vapours 1105 from compressor 231 and pass through the heat exchanger 256 and condense the heating agent vapours 1106 by a colder sea water stream 255. The condensed heating agent 1106 is added to the heating agent hold tank 235. The hotter sea water stream 257 from the heat exchanger 256 is returned to the ocean or sea.

The alternative embodiment shown in FIG. 12 of the heat engine 200 can therefore be a dual function feature of both vaporization of the cold depressurized liquid heating agent (n-octane) from hold tank 235, via depressurization facilities 236*a*, as described in the report body, and condenser of the compressed heating agent vapours from the compressor 231, as described above.

Figure 13:
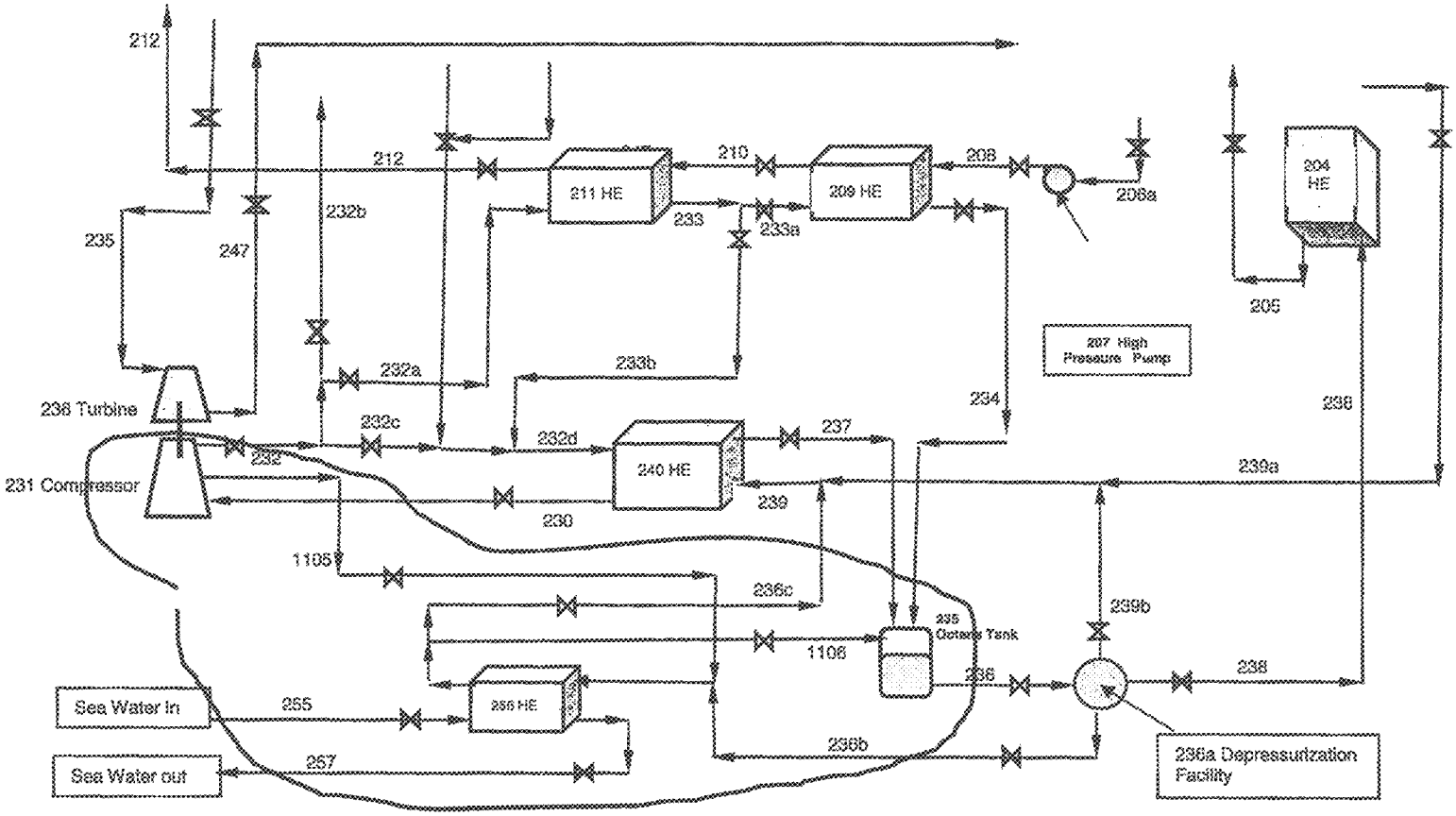
FIG. 13 shows schematic diagram of thermodynamic cycle and the novel heat engine with single component working medium system—"Atalla Harwen Cycle" plant and comprising a low temperature reservoir energy source and vaporizer and/or condenser.
Figure 14:
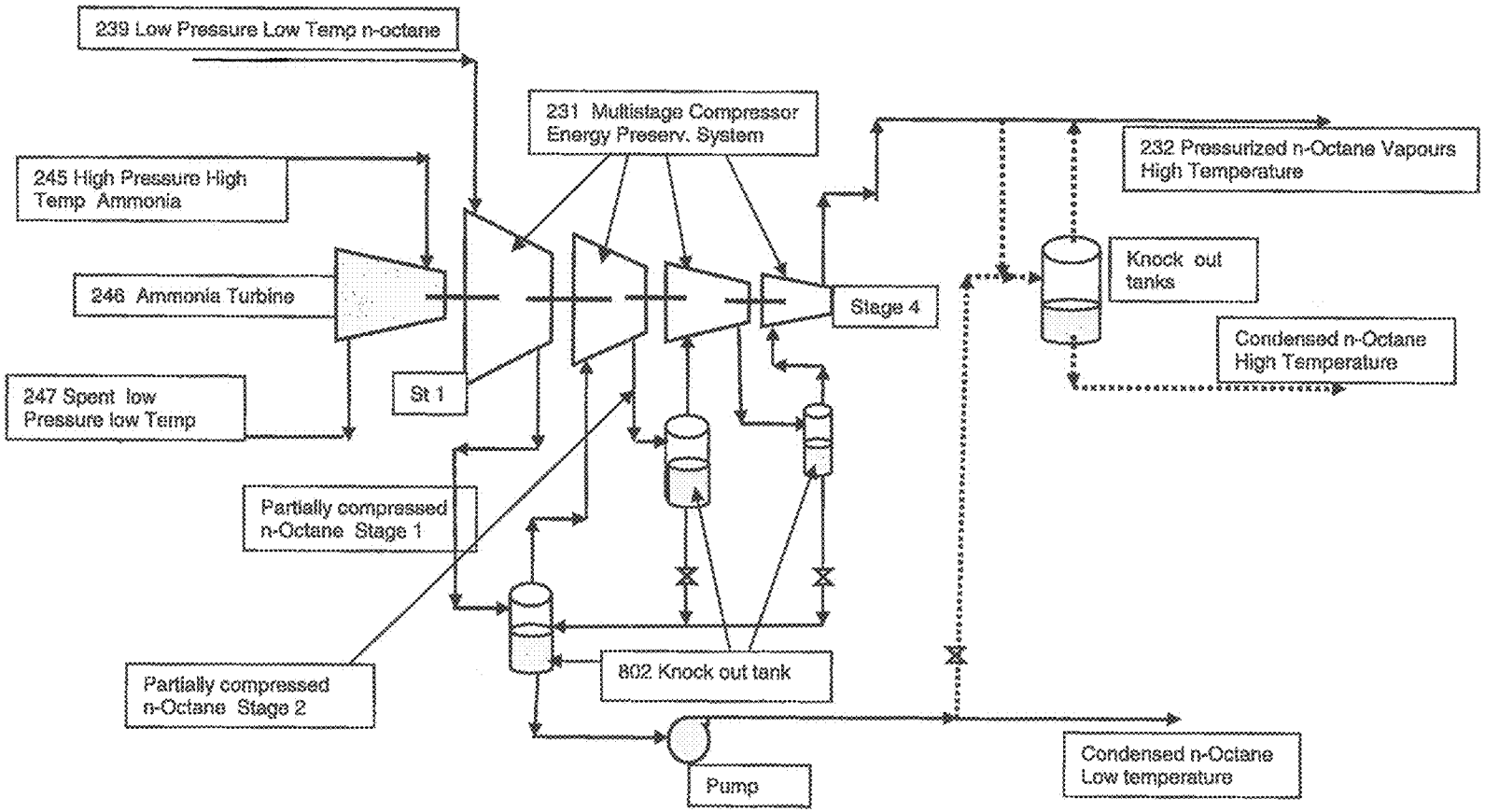
FIG. 14 shows multi stage (4 stages) compression of heating agent (n-Octane) showing condensate withdrawal at the end of stages with knock-out tanks.

The embodiment shown in FIG. 13 of the heat engine 200 comprise means of a multi stage compressor, with knock out tanks for withdrawal and separation of the condensed working medium at the end of each compression stage,

6—SUITABLE FLUIDS (MATERIALS) FOR THE NOVEL POWER PLANT SYSTEMS

Materials which are suitable for use as "working fluids" in this invention can be pure components, multi-components or mixtures of components and are selected and aimed for performing functions of either of the two main loop fluids which are;

a) Working mediums for the mechanical work and power generation loop
b) Heating and cooling agents for the energy preservation and recycling loop As the functions and operational behaviours of the two groups of materials are desired and expected to be contrasting with each other, they are therefore, different groups of materials. The favourable and desirable thermodynamic properties, operational behaviours and characteristics for one group of materials (working mediums) can be the most undesirable properties and characteristics for materials of the other group (heating and cooling agents), as described below.

6.1 Suitable Materials for "Working Mediums"

Materials which are suitable to be used working mediums in the mechanical work and power generation loop of the novel system can be:

- Single component material such as ammonia or any material with suitable thermodynamic properties close to, or better than, those of ammonia,
- Water is used mainly as the working medium in Rankine cycle plants, where fuel burning temperature can reach very high levels and condensation temperature of the spent water vapours from the turbines, is sufficiently high to allow the use of sea water or river water or atmospheric air as the coolants,
- Multi component fluid for working mediums, which comprises a mixture of two or more low and high boiling materials with favourable thermodynamic properties and wide range of inter-solubility, such as ammonia-water mixture,
- Multi component fluids for working medium, which comprises a mixture of various hydrocarbons, various freons, or other materials, When using multi component fluids as working mediums such as ammonia-water mixtures, difference between the boiling temperature of the lower boiling working medium component (WM) and solvent is preferably more than 100 degrees K.

Pure Ammonia, pure water vapours and ammonia-water vapour (gas) mixtures have suitable thermodynamic properties and enthalpy-concentration data and diagrams for pure ammonia, pure water and ammonia-water, under a wide range of pressures and temperatures are readily available in the technical literature and are considered to be reasonably reliable. Therefore, pure ammonia and ammonia-water mixtures have been considered as suitable materials and selected for use in this invention.

During the isentropic expansion in the turbines ammonia, water and their mixtures vapours exhibit a longer theoretical and actual isentropic expansion path in terms of temperature drop range (between the inlet and outlet temperatures), due to the high value of exponent (k) in the adiabatic equation of state of those gases per the equation of state:

$$PV^k = \text{Constant} \quad \text{Eq 1}$$

Where:

P—is the gas pressure at the start of intended process

V—is the gas volume at the start of intended process k—is the adiabatic expansion exponent The adiabatic expansion exponent k is expressed in terms of ratio of the specific heats of gas under constant pressure ($C_P$) to specific heat of the said gas under constant volume ($C_V$), as follows:

$$k = C_p/C_v \quad \text{Eq. 2}$$

For ammonia (k)=1.310 at temperature of about 288 k (15° C.) and

For water vapours (k)=1.315 at temperature of about 388 k (115° C.)

For ammonia-water mixtures (k) is expected also to be similar and is =1.315

At higher temperatures of over 380 K for ammonia and over 450 K for water vapours, value of the exponent (k) decreases and can be significantly lower than 1.315. At lower temperatures of below 300K, value of (k) increases to more than 1.315, for both ammonia and water vapours. This characteristic is very useful in extracting more work and energy from the expanding ammonia and water vapours (gases) through the turbines and is explained in thermodynamic analysis section of this report.

As mentioned earlier, pure ammonia and Ammonia-water mixtures have suitable thermodynamic properties and have been selected as a working fluid (as an example) for this invention, Pure Ammonia for the single component system configuration Ammonia-water mixtures for the multi-component system configuration 6.2 Suitable Materials for "Heating Agents":

The use of energy preservation and recycling system (heat pump principle) in the novel power plant models is aimed at preserving and recycling as much as possible and preferably the entire amount of the induced thermal energy within the operation cycle (saving energy). The amount of energy which can be economically preserved and recycled within the proposed power system depends on many factors, but particularly depends on the physical and thermodynamic properties of the employed heating agent and the selected operation conditions of the loop, such as:

a) Value of exponent (n) in the generalized adiabatic equation of state (replaces k):

$$PV^n = \text{Constant}, \quad \text{Eq. 1a}$$

It is preferred that the value of exponent (n) should be as low as possible, and preferably below 1.0655, to achieve better system efficiency (as is explained in the thermodynamic analysis section), b) Latent heat of vaporization of the heating agent at the cold reservoir temperature $T_{cold}$, It is preferred that the heating agent has high latent heat of vaporization of—say more than 380 kj/kg (90.77 kcal/kg) or higher, at the cold reservoir temperature, c) Suitable boiling point of the selected material at the cold reservoir temperature $T_{cold}$, including those under vacuum, Most materials with low value of the adiabatic exponent (n) in equation of state of materials have high molecular weight and high boiling point. Such materials would likely require to be vaporized under vacuum at suitable temperatures of the cold reservoir, d) Freezing or solidification point, It is important that the freezing point of the selected heating agent (pure material or mixture) should be sufficiently (at least few degrees K) below the temperature of the cold reservoir to avoid any unexpected system freezing, e) Required operation temperature range for elevating energy from the cold reservoir temperature $T_{cold}$, to the hot reservoir temperature $T_{hot}$, Required range of temperature increase should be such that the energy preservation and recycling system compressor "Coefficient of Performance COP" (heat pump principle) is preferably maintained at above 7, f) Use of superheating process for pre-heating the cold heating agent vapours prior to feeding to the energy preservation and recycling system compressor (heat pump), if necessary, g) Operation conditions, which should be selected to avoid un-acceptable levels of condensation of heating agent inside the compressor during compression process, There are many materials with suitable thermodynamic properties, which can be used as heating and cooling agent such as:

| | | |
|---|---|---|
| n-Octane | C8H18 | CH3—(CH2)6—CH3 |
| n-Heptane | C7H16 | CH3—(CH2)5—CH3 |
| Iso-octane | CH3—CH(CH3)—CH2—CH2—CH2—CH2—CH3 | |
| Diethyl ether | CH3—CH2—CO—CH2—CH3 | |
| Diethyamine | CH3—CH2—NH—CH2—CH3 | |
| n-Butylamine | CH3—CH2—CH2—CH2—NH2 | |
| n-Pentylamine | CH3—CH2—CH2—CH2—CH2—NH2 | |
| n-Pentyl Alcohol | CH3—CH2—CH2—CH2—CH2—O—H | |
| n-Bytylformate | CH3—CH2—CH2—CH2—O—COH | |
| Diethyl ketone | CH—CH2—CO—CH2—CH3 | |
| Azeatropes of different suitable materials | | |
| Mixtures of suitable materials | | |
| Etc | | |

Some important thermodynamic properties of these materials for selection as energy preserving agents are highly desired and selected to be contrasting with the same thermodynamic properties of working mediums of the mechanical and power generation loop (ammonia and water vapours). For example, value of the exponent (k) or (n) in the equation of state of vapours and gaseous:

$$PV^n = \text{Constant} \quad \text{Eq. 1a}$$

While it is desirable that the value of exponent (n) for the working medium, to be as high as possible and close to the ideal gas value of 1.40, however, in the case for the energy preservation and recycling agents (heating agents), it is desired that the value of exponent (n) to be as low as possible and ideally should be below: n=1.065, Such a low value of exponent (n) entails that the isentropic compression and expansion processes of the involved heating agent materials will demonstrate different behaviours from those of the working mediums, which are selected to have a high value of exponent (n) preferably at higher than 1.315. Detailed explanations are given in the next section of thermodynamic analysis of the working mediums and heating agents.

Enthalpy, entropy, specific volumes, etc. data for pure n-octane and many other similar materials under a wide range of pressures and temperatures are readily available in the technical literature and are considered to be reasonably reliable. Pure n-octane has suitable thermodynamic properties and has been selected (as example) for use as the heating agent in this invention.

7. THERMODYNAMIC ANALYSIS OF THE INVENTION, NOVEL POWER PLANT

Within the "Atalla Harwen Cycle"

Detailed analysis of the invention is conducted, in conjunction with figures: 3, 4, 5, 6, 7, 8, 9, 10, 12, 13, 14, 15, 16, 17, 18, 19, 21, 22, 23, 24, 25, 26, 27, 28, 29, 30 and 31 and is described below.

The invention embodiments shown in FIG. 4 are for the single component working medium and are taken as the example reference and basis for the novel system (power plant) calculations and analysis. An example of the suitable single component working medium is "pure ammonia" and has been selected as the working medium (WM) for the system analysis and calculations. An example of the suitable single component energy preservation and recycling system material (heating agent HE) is n-octane and has been selected for the system analysis and calculations.

To simplify the flow of calculations and analysis and cover the novel plant operation, parameters and interaction of each individual piece of equipment with other components, and then combine the entire integrated embodiments of the heat engine 200 shown in FIG. 3, the calculations are made for a selected flow rate of the working medium ammonia through the turbine (or turbines) of one (1.0) kg/s. This is also the flow rate of ammonia through all other components of the mechanical work and power generation loop.

To further enable the calculations, an example set of the required suitable and independent operation parameters and conditions has also been selected for the working medium ammonia progressing through the mechanical and power generation loop of the power plant.

The corresponding required flow rate and suitable operation conditions of the energy preservation and recycling agent n-octane (heating agent) through each joint piece of equipment of the heat engine 200 between the two loops, is calculated and fixed to satisfy the flow rate of 1.0 kg of working medium ammonia, taking into consideration parameters of ammonia at the inlet and outlet of each involved piece of equipment. Flow rate and suitable operation conditions of n-octane through the other pieces of equipment which are specific to only energy preservation and recycling loop, has been calculated and adjusted to provide a reasonable "example" of the novel power plant operation and means to complete the closed loop and conduct the required evaluation.

A set of basic realistic assumptions has been made as required, to further enable calculation of the other necessary operation parameters of each individual piece of equipment of the heat engine 200.

Figure 32C:
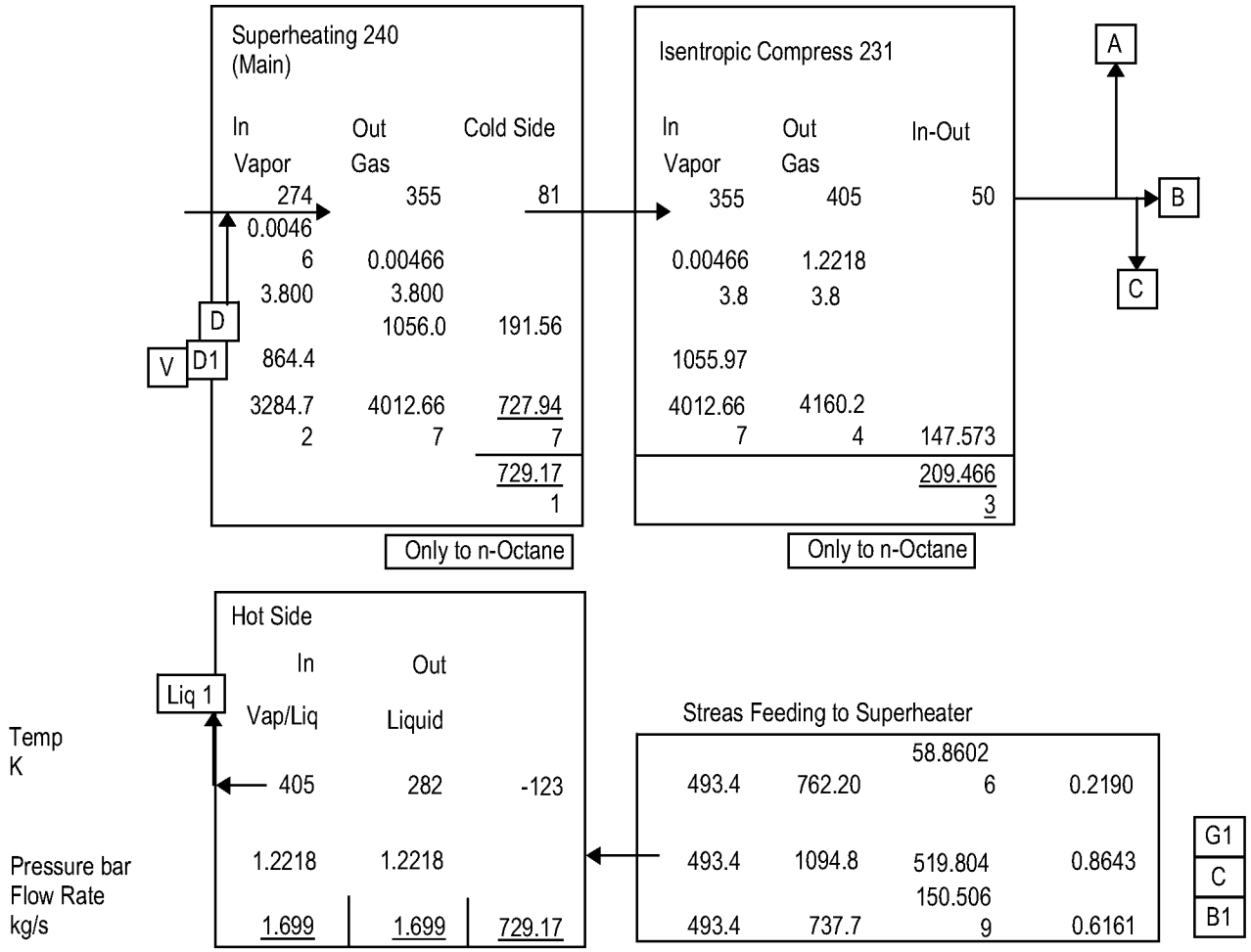
Figure 32D:
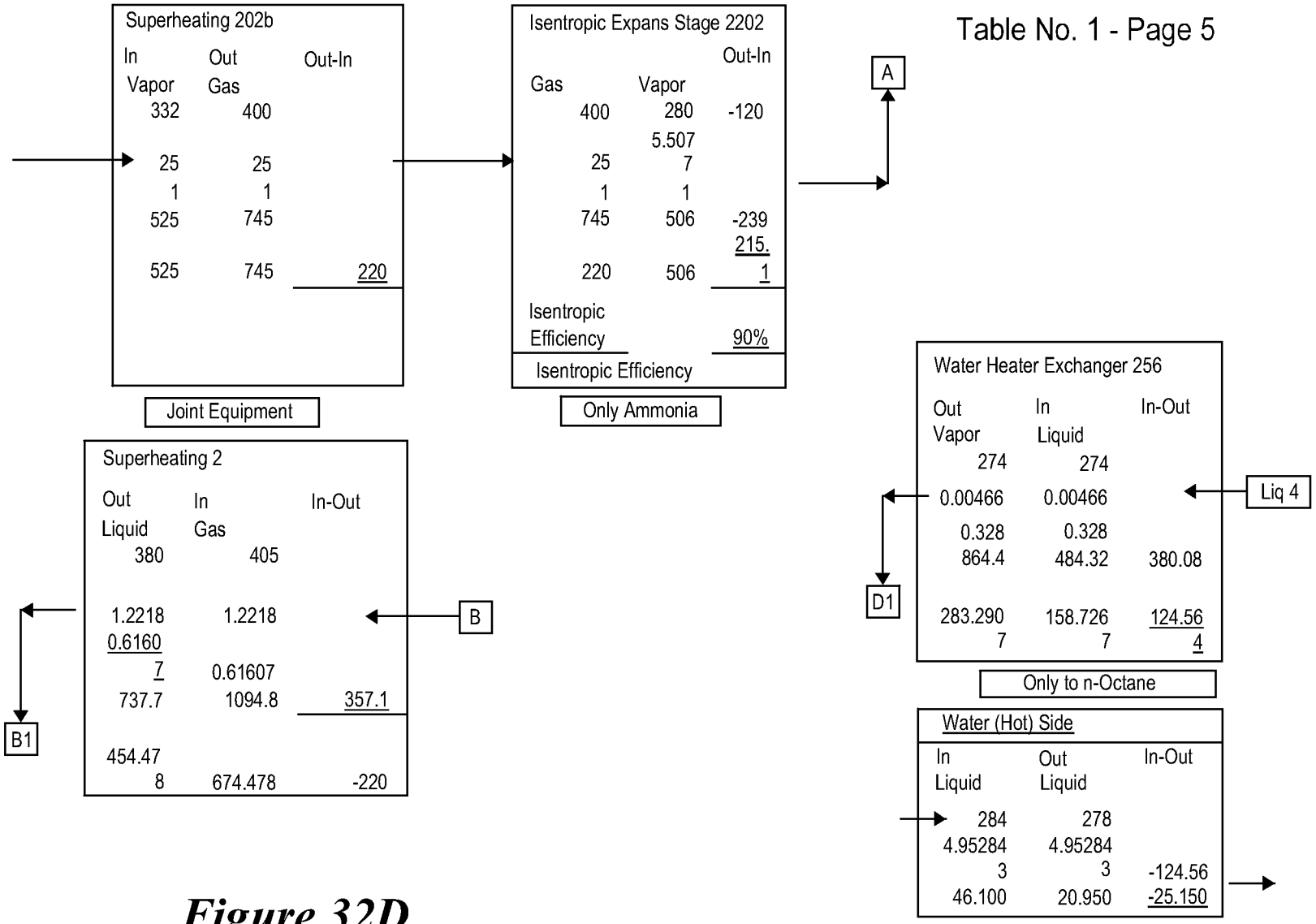

For this purpose an Excel program was also constructed and built for modelling and calculation the novel power plant process operation data and parameters, which covered all the plant equipment, based on the made assumptions, with the aim to calculate mass and energy balance of those individual pieces of equipment and the overall system and produce the calculation results. Table 1, reproduced in FIGS. 32 through 32D, shows the modelling results.

The list of all assumptions is also shown with the excel model calculations.

System performance in terms of the lifted amount of energy from the low temperature reservoir to the high temperature reservoir and usefully used per unit power of the system compressor (COP) is also analysed to assess the overall merits, criteria and validity of the proposed power plant.

For the better understanding and evaluation of the process thermodynamics and their impacts, a detailed analysis and calculation of parameters of all components of the two loops is made and analysed below, which also reflect and complement the Excel program modelling results and approach to the parameters calculations and findings.

A—Analysis of Mechanical Work and Energy Generation Loop:

As shown earlier, from the adiabatic equation of state of ammonia:

$$PV^k = \text{Constant} \quad \text{Eq 1}$$

And:

$$k = C_p/C_v \quad \text{Eq. 2}$$

However, in the generalized equation of state for any vaporized material or gas, (k) is replaced by (n) and the adiabatic equation expression is:

$$PV^n = \text{Constant} \quad \text{Eq 1a}$$

Further related and simplified equations of state:

$$\frac{P_2}{P_1} = \left\{\frac{V_1}{V_2}\right\}^n \quad \text{Eq 3}$$

$$\frac{T_2}{T_1} = \left\{\frac{V_1}{V_2}\right\}^{n-1} \quad \text{Eq 4}$$

Where $P_1$ is the gas pressure at the start of compression process $P_2$ is the gas pressure at the end of compression process $V_1$ is the gas volume at the start of compression process $V_2$ is the gas volume at the end of compression process $T_1$ is the gas temperature at the start of compression process $T_2$ is the gas temperature at the end of compression process And:

$$n = \text{Ln}(P_2/P_1)/\text{Ln}(V_1/V_2) \quad \text{Eq 5}$$

Equations 3 and 4 express conditions of adiabatic and also isentropic expansion or compression of the ammonia vapours, as the process takes place without energy introduction into the expanding system from outside and therefore there is not expected a change of it's overall entropy As indicated earlier, any assumed set of operating conditions and parameters, which is considered suitable for the mechanical work and power generation loop, will dictate the corresponding set of operation conditions, the size and operation mode of the energy preservation and recycling loop and is therefore, discussed first.

Figure 15:
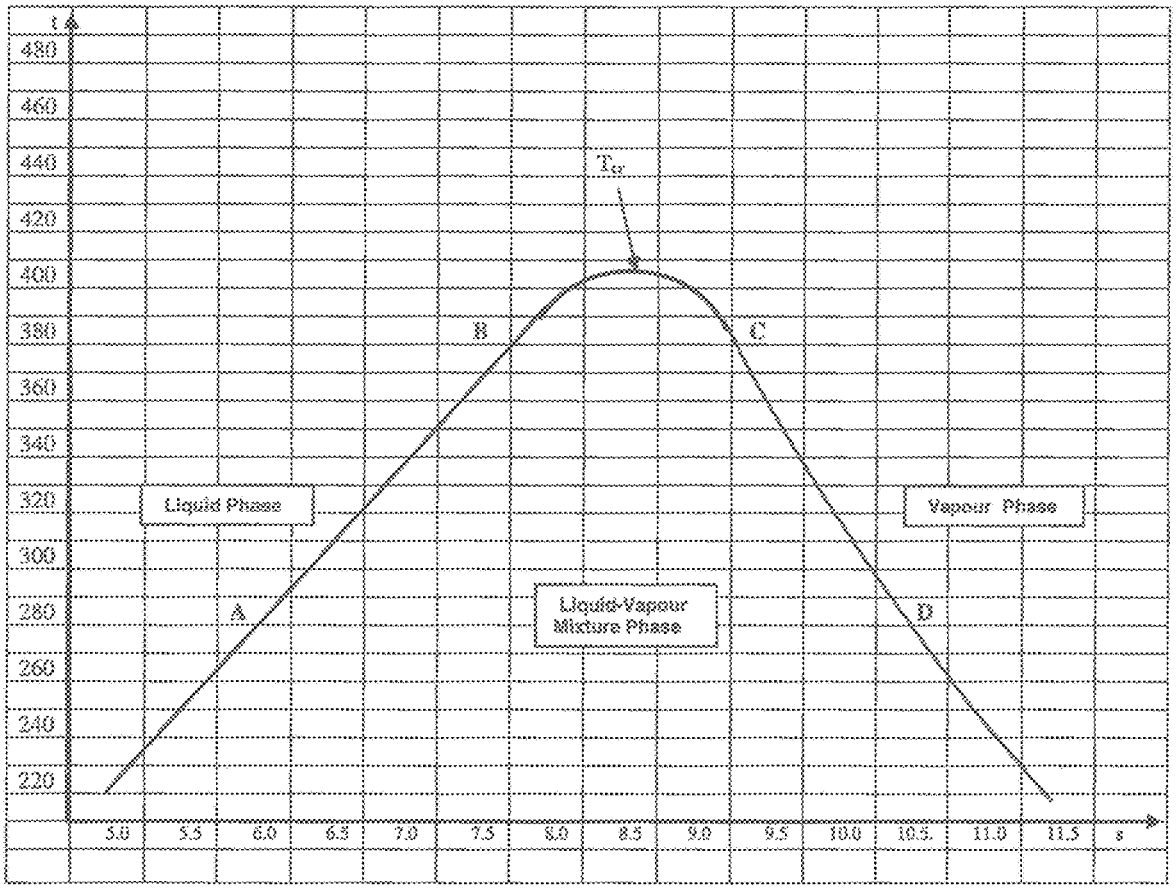
FIG. 15 shows Temperature-Entropy (T-s) diagram of Ammonia and areas of the material physical phase statuses.

Referring to FIG. 15, it shows temperature-entropy (T-s) diagram of pure ammonia and regions of its phase existence and inter-changes, which are:

a—Liquid phase region, where ammonia is always in liquid form, b—Mixed Liquid-Vapour phase region, where ammonia exists in an equilibrium state of mixed liquid and vapour, phase, c—Vapour phase region, where ammonia is always in vapour form, The diagram shows that while entropy of liquid ammonia increases with increasing saturation temperature line A-B-$T_{cr}$, entropy of the ammonia vapours decreases with increasing saturation temperature, line D-C-$T_{cr}$. There is expected therefore only one saturation temperature (point) where entropy of both liquid and vapour phases of ammonia converge and are equal, and that point is at the critical temperature ($T_{cr}$). However, if the fully vaporized ammonia is superheated from any point on the saturation vapour line $T_{cr}$-C-D, entropy of the superheated ammonia gas increases with increasing temperature. Entropy Path of the superheated ammonia gas moves (flows) in the same direction (and somehow parallel) with the entropy path of liquid ammonia and diverges widely with entropy path of the saturated vapours. The formed intersect angel of the superheated and saturated vapours entropy lines is generally obtuse for ammonia and close or much wider than 90° degrees. Such diverging entropy lines of the superheated and saturation phases of ammonia gas elongate the isentropic expansion path and, if superheated to a sufficiently high temperature, create the opportunity for extracting more energy from those expanding gases. These are typical thermodynamic characteristics of the vapours and gases (materials) of low molecular structure (fewer atoms) and weight, such as, water vapours, ammonia, methane, carbon monoxide, etc.

In the selected example, these favourable thermodynamic properties of ammonia are utilised for power generation from the expanding ammonia gas and vapour from the selected high pressure of 7.135 MPa (71.35 bar) to the lower pressure of spent vapours of 0.55077 MPa (5.5077 bar) through the turbines 202 FIG. 3, which can be of one stage or multi stage turbine.

Figure 16:
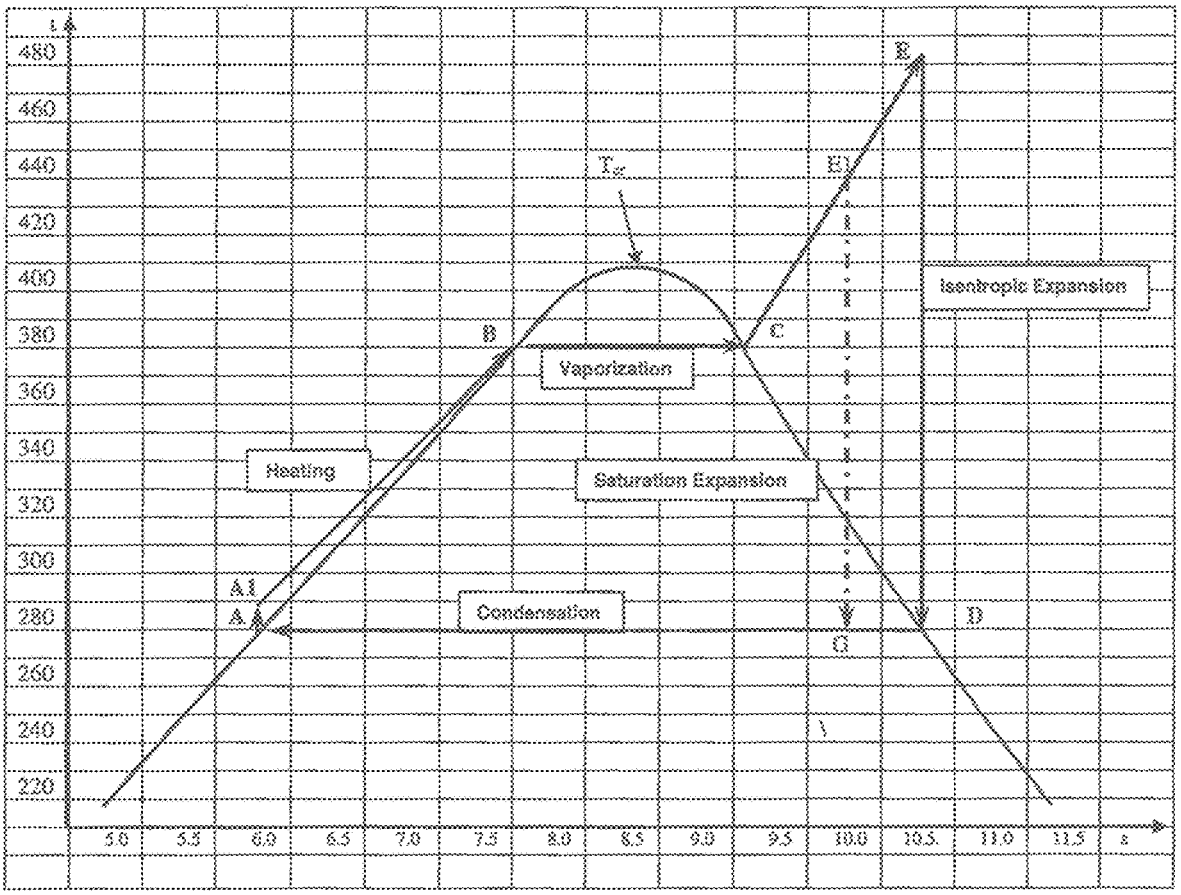
FIG. 16 shows Temperature-Entropy (T-s) diagram of Ammonia showing steps of a power generation loop with superheating of high pressure ammonia and isentropic expansion.

Referring to FIG. 16, it shows T-s diagram of ammonia and the envisaged steps of the involved thermodynamic power generation closed loop, which includes:

| | |
|---|---|
| Pumping of liquid ammonia | A-A1, |
| Heating of liquid ammonia | A1-B, |
| Vaporization of ammonia | B-C, (phase change under constant high pressure) |
| Superheating of ammonia | C-E, |
| Isentropic expansion of ammonia (one stage turbine), E-D, and, | |
| Condensation of the spent ammonia to liquid and back to point A, D-A, (Phase change under constant low pressure) | |
| Completed one cycle and start the next cycle of ammonia pumping and repeat steps of the power generation loop, again and again. | |

However, in conditions of this selected example, ammonia turbine is selected as a two stage type with interim superheating, and the turbine produces mechanical work and generates electrical power from both stages of ammonia expansion. Selection of suitable operation conditions of the mechanical work and power generation loop, within the thermal conditions of the available energy source in terms of amount of energy and temperature, the novel power plant can be operated to achieve high isentropic efficiency. Depending on the energy source temperature and the possible superheating will affect the isentropic efficiency of the expansion process. In there in no possibility of superheating above the saturation temperature of 390 k (117° C.), then the system isentropic efficiency will be very low (probably below 70%) and there is expected significant condensation of ammonia inside the tyurbine. However, if temperature of the energy source allows superheating of the high pressure ammonia vapours to a level, when it undergoes isentropic expansion through the turbine, then final temperature of the expanded ammonia vapours will co-inside with the saturation temperature of ammonia vapours at the selected exit pressure of the spent vapours from turbine, isentropic efficiency can actually reach 100%, based on the calculations from equation of state, as follows:

$$PV^n = \text{Constant},$$

And:

$$\frac{P_2}{P_1} = \left\{\frac{V_1}{V_2}\right\}^n$$

$$\frac{T_2}{T_1} = \left\{\frac{V_1}{V_2}\right\}^{n-1}$$

For ammonia and water vapours exponent: n=k=about 1.312-1.245

In the temperature range of 295 K-400 K

If ammonia vapours are expanded from the saturation pressure of—say 71.35 bar to 5.5077 bar in a turbine per the processes of FIG. 15*a*, then temperature drop across the turbine will be, per equations 3 and 4, and assumptions of:

Saturation temperature of ammonia under 5.5077 bars is 280 K,

Saturation temperature of ammonia under 71.35 bars is 380 K,

Average value of n (k) in these conditions=1.285

$$\frac{P_2}{P_1} = \frac{5.5077}{71.35} = \left\{\frac{V_1}{V_2}\right\}^n,$$

and $$Lg(5.5077/71.35) = n \times Lg(V_1/V_2), \text{ And: } Lg(V_1/V_2) = (-1.124237/1.2850 = -0.865994$$

$$(V_1/V_2) = 0.13633874$$

And:

$$\frac{T_2}{T_1} = \left\{\frac{V_1}{V_2}\right\}^{n-1}$$

$$T_1 V_2$$

$$T_2 = 380 \times (013633874)\hat{}0.285 = 380 \times 0.5665988 = 215 \text{ K}$$

$$T_2 = 215 \text{ K}$$

However, saturation temperature of ammonia vapours under the pressure of 5.5077 bar, is only about 280 K, which means that the theoretical calculated final expansion temperature is significantly lower than the saturation temperature under the final expansion pressure, by:

$$280 - 215 = 65 \text{ K}$$

It is also expected that the temperature of the expansion process of ammonia vapours inside the turbine from the saturation pressure of 71.35 bar to saturation pressure of 5.5077 bar, will follow temperature of the saturation path from point C to D FIG. 15*a*. The full theoretical isentropic expansion path has therefore been shortened (reduced) by 65 K, as the expansion process terminates and ends at 280 K instead of 215 K. Reduction of the isentropic expansion path and efficiency of the expansion process is:

$$\frac{T_2}{T_1} = \left\{\frac{V_1}{V_2}\right\}^{n-1}$$

$$\frac{280}{390} = (0.13633874)\text{^}(n-1)$$

$(n-1)$=(Log 0.736842)/(Log 0.13633874)

$n-1$=−01326255/−0.8653807=0.1532568

$n$=1.1532568

Isentropic efficiency($\eta_{is}$) is (about):

$(\eta_{is})$=(0.1532568/0.285)×100=53.77%

And accordingly:

$$\frac{T_2}{T_1} = \left\{\frac{V_1}{V_2}\right\}^{n-1}$$

$$\frac{T_2}{380} = (0.13633874)\text{^}(0.1532568)$$

$T_2$=380×0.7368423=280 K

To sustain the continued expansion process from the saturation conditions of 71.35 bar and temperature of 380 K, to 5.5077 bar, with the corresponding saturation temperature of 280 K, significant amount of ammonia vapours have to condense and release its latent heat into the remaining and expanding ammonia gas. According to the available data of ammonia, about 26.25% of ammonia vapours will need to condense to reach the expansion pressure of 5.5077 bar. Such a high required theoretical condensation of ammonia inside the turbine will lead to significant reduction of the expansion volume of ammonia, proportionate reduction in the produced mechanical work and reduction of the isentropic efficiency of the process.

The main reasons for ammonia condensation during expansion process from the saturated conditions is (probably) that, entropy of ammonia vapours increases with decreasing temperature, and require large amount of energy to sustain the expansion and cooling process. The stored compression energy of the compressed ammonia vapours is not sufficient to satisfy both performance of the required expansion mechanical work ($W_{ex}$) expressed as:

$(W_{ex})=P\,dV$

And entropy ($E_{en}$) increase (energy) within the expansion boundaries of the process:

$(E_{en})=Tds$

The deficit amount of energy is satisfied from the released latent heat of condensation of the condensed portion of ammonia vapours and the process continues to the preselected outlet back pressure of ammonia vapours from the turbine, in this example 5.5077 bar.

Hence, for the expanding ammonia from pressure of 71.35 bar to reach saturation pressure of 5.5077 bar and temperature of 280 K, without condensation of ammonia inside the turbine, requires superheating of ammonia to the temperature of about 496.5 K, according to the published technical literature on ammonia. At this superheated temperature of 496.5 K,

| | |
|---|---|
| Entropy of the superheated ammonia is | 10.235 kj/kg · K |
| Entropy of the saturated ammonia at 280 K, also is | 10.235 kj/kg · K |

Superheating temperature per equation of state:

$$\frac{P_2}{P_1} = \left\{\frac{V_1}{V_2}\right\}^{n}$$

And:

$$\frac{T_2}{T_1} = \left\{\frac{V_1}{V_2}\right\}^{n-1}$$

Hence:

$$\frac{P_2}{P_1} = \frac{71.35}{5.5077} = \left\{\frac{V_2}{V_1}\right\}^{n},$$

$Lg(71.35/5.5077)=n\times Lg(V_2/V_1)$, And: $Lg(V_2/V_1)$= (1.1532568/1.2750=0.90451514

$(V_2/V_1)$=8.02629536

And:

$$\frac{T_2}{T_1} = \left\{\frac{V_1}{V_2}\right\}^{n-1}$$

$T_2$=280×(8.02629536)^0.275=280×1.773134=496.5 K $T_2$=496.5 K

The calculated required superheating temperature 496.5 K, is reasonably close to that of the published ammonia technical data, and is calculated from the full value of exponent n=1.275, in the equation of state of gases and vapours (within a much higher temperature range). Coinciding the final expansion temperature of ammonia with the theoretical calculated temperature at 100% exponent value, means full 100% utilisation of the expansion process and no losses to the effect of working medium ammonia condensation inside the turbine. Temperature drop (delta T) during the isentropic expansion of ammonia from 71.35 bar to 5.5077 bar, is:

Delta $T$=496.5−280=215.5 K

Required superheating energy ($E_{sup}$) is calculated from ammonia enthalpy at the start saturation ($h_{sat}$) conditions and end of superheating process ($h_{sup}$):

$(h_{sat})$=452.7 kj/kg and $(h_{sup})$=940 kj/kg, Hence:

$(E_{sup})$=930−452.7=477.3 kj/kg (114.02 kcal/kg)

During the isentropic expansion of ammonia through the turbine, the introduced superheating thermal energy accounts for:

a. Preventing ammonia condensation inside the turbine during expansion process, and remains as vapour at the outlet spent conditions from turbine at the back pressure of 5.5077 bar and saturation temperature of 280 K, and the required amount of energy is:

500−452.7=47.3 kj/kg (11.299 kcal/kg)

b. Providing for the expected turbine mechanical work from ammonia isentropic expansion, and the amount of energy is:

940−500=440 kj/kg (105.11 kcal/kg)

Hence, the involved isentropic expansion process and the expansion temperature range of ammonia gas is significantly elongated and widened. If such expansion conditions can be provided in the actual industrial practice, it shall result in extraction of significant amount of net energy from unit weight of the expanding ammonia gas. Mechanical work extraction from the full amount of the expanding ammonia gases continues to the end of the process without any condensation, volume reduction (shrinkage) and entropy split-disruption between liquid and vapour phases. Theoretical thermal efficiency ($\eta_{th}$) of the system is:

$$(\eta_{th}) = \frac{440}{1600} \times 100 = 27.5\%$$

This efficiency is considered reasonably high for such systems operating at the involved low level temperature of energy source.

It is expected therefore that the isentropic efficiency to increase with the reduced condensation of ammonia inside the turbine and to be at maximum (theoretical 100%), when there is no condensation of the working fluid inside the turbine.

On the other hand if ammonia vapours are compressed (isentropic), there is expected a higher temperature of the compressed materials above the saturation temperature of the final compression pressure. If ammonia is compressed from the saturation pressure of—say 5.5077 bar (point D on the T-s diagram FIGS. 16 and 17) then the compression path will only be along the superheating line D-E and the final temperature of compression will correspond to a saturation pressure on the line C-D. If for example, the final compression pressure is 71.35 bar, then the final compression temperature of ammonia gas will be 496.5 K, which is the expected superheating level and well above the saturation temperature of 380 K, per the equation:

$$\frac{T_2}{T_1} = \left\{\frac{V_1}{V_2}\right\}^{n-1}$$

$$\frac{T_2}{280} = (8.02629536)\text{^}(0.275),$$

and:

$T_2$=280×1.77313443=496.5 K $T_2$=496.5 K

The main reason for the superheating of ammonia during isentropic compression process from the saturated conditions is that ammonia vapours entropy decreases with increasing temperature, and releases extra energy into the compressing system. Compression work energy ($W_{comp}$) expressed as:

$(W_{comp})=P\ dV,$

Plus the entropy energy release ($E_{entr}$):

$(E_{entr})=Tds$

Are more than the required internal energy increase (dU) of ammonia per every increased of temperature degree K.

$$dU=Tds-PdV \qquad \text{Eq 6}$$

The surplus amount of energy is released into the compressed ammonia vapours and superheats the vapours into gas and the process continues to the pre-selected outlet pressure of ammonia vapours from the compressor, in this example 71.35 bar.

If ammonia vapour is compressed (isentropic) from the pressure of 5.5077 bar (FIG. 17 point D) to 71.35 bar, then the compression process can take two paths, which are:

a—Direct isentropic path from the saturation pressure point D of 5.5077 bar which will be along the line D-E and ammonia is superheated at any of the points on the path D-E. There is no increase of the amount of ammonia vapours and gases from the initial starting amount at point D, and the process proceeds as described above, b—The path along the saturation line D-C, which requires continuous addition (injection) of liquid ammonia into the compressor to suppress the superheating effect of compression. A continuous amount of liquid ammonia is vaporized to absorb the superheating energy and then these vapours will also be superheated in the subsequent compression process stages and require more liquid ammonia until reaching the final pressure at point C.

Exact amount of liquid ammonia which is required to be injected into the compressor during the isentropic compression process, to suppress the superheating of the compressed ammonia vapours while reaching the final pressure of 71.35 bar and the saturation temperature of 380 K (point C), is equal to the amount of ammonia which would condense if the final amount of the high pressure and saturated ammonia vapours at 71.35 bar (at point C), are expanded back to the pressure of 5.5077 bar (at point D). Starting conditions of required injection liquid ammonia, pressure and temperature, should be same as the vapour conditions of 5.5077 bar pressure and temperature of 280 K. There is therefore a significant increase of ammonia vapours amount (weight) from the initial vapour amount at the start of compression process. To have—say one kg of ammonia at the end of compression from point D to point C, FIG. 16, the vapour ammonia point D will be about 0.74 kg and the amount of liquid (condensate) ammonia at point G about 0.26 kg. When the vapours are compressed and the condensate injected and the final compression pressure reaches 71.35 bat at point C the amount of ammonia vapours will be one kg.

Figure 17:
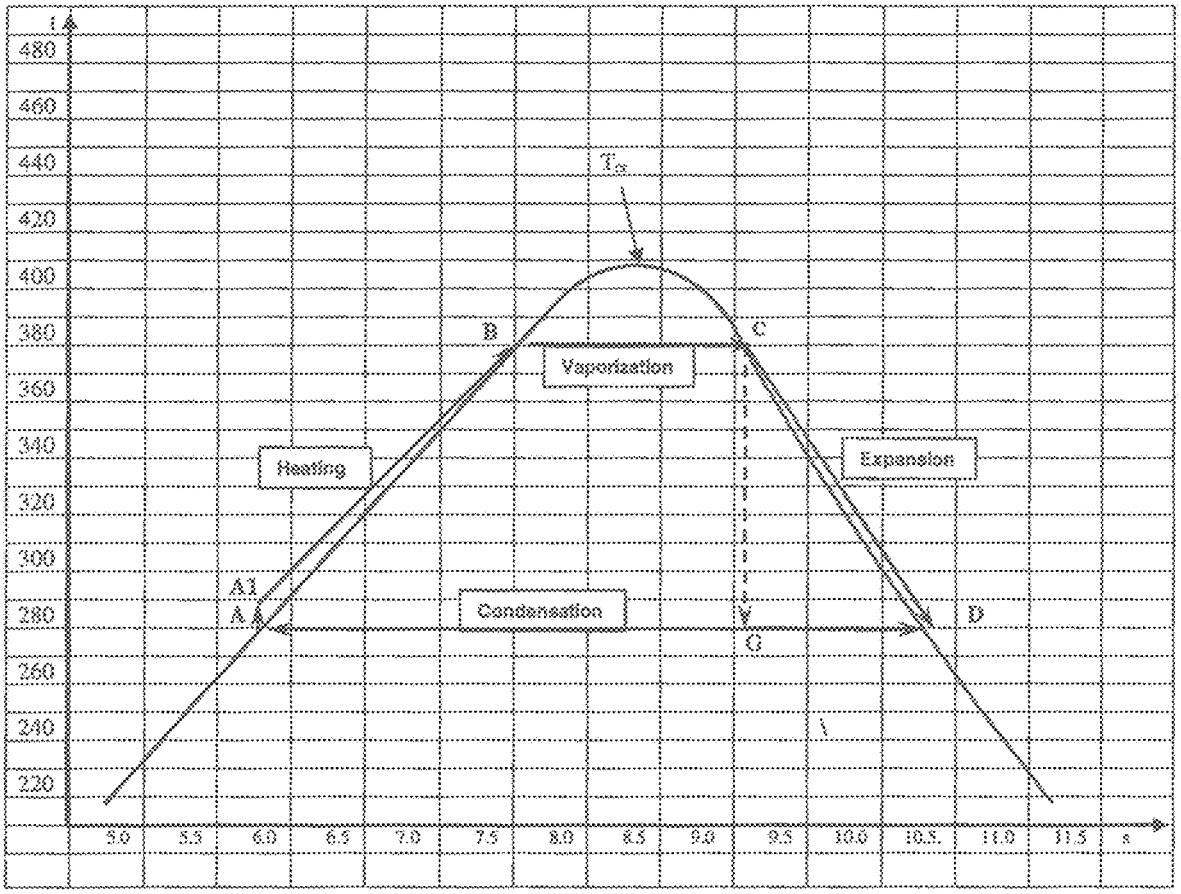
FIG. 17 shows Temperature-Entropy (T-s) diagram of Ammonia showing steps of a power generation loop with expansion of high pressure ammonia from the saturation point C.
Figure 18:
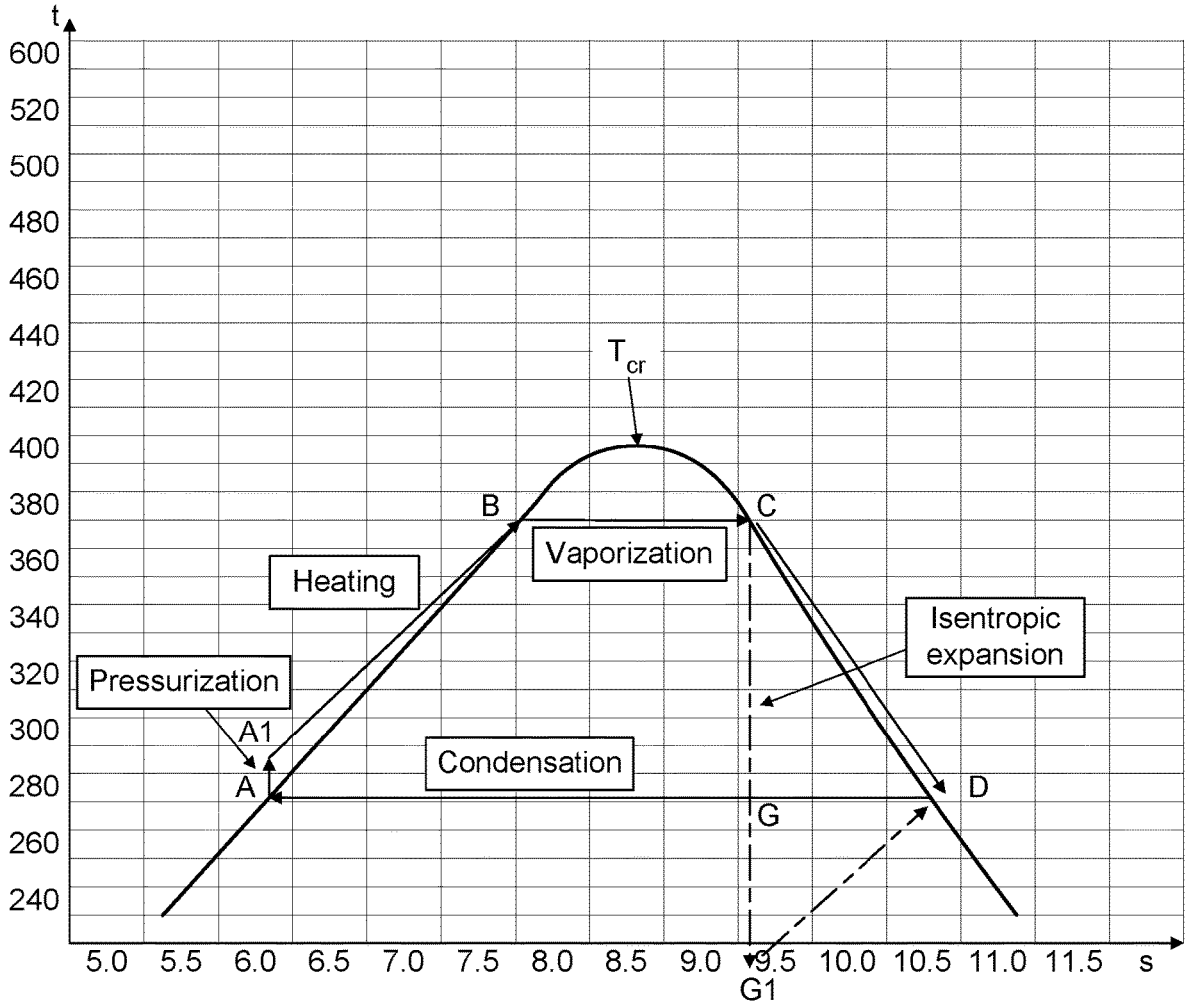
FIG. 18 shows Temperature-Entropy (T-s) diagram of Ammonia showing steps of a power generation loop with expansion of high pressure ammonia from the saturation point C.

Such a compression FIG. 17 will also require a significant amount of energy to:

Increase enthalpy of—say one kg of ammonia from point D to point C,

Vaporize over 25%, or about 0.25 kg per one (1.0) kg of ammonia vapours at point C, Referring to FIG. 18, Point G represents the theoretical temperature of expansion at less than 100% isentropic efficiency and Point G1 represents the theoretical temperature of expansion at 100% isentropic efficiency.

According to ammonia properties the required amount of energy (compressor work) ($W_{comp}$) will be the difference between enthalpy of ammonia at the inlet ($h_{ainl}$) and ($h_{aout}$) outlet points of the compressor, and is:

$$(W_{comp})=(h_{aout})-(h_{ainl})$$

$$(W_{comp})=200-452.7=-252.7 \text{ kj/kg } (-60.367 \text{ kcal/kg})$$

Most of this work (energy) is actually required for heating and vaporization of 0.25% liquid ammonia ($W_{liq}$), which is:

$$(W_{liq})=(-730.9-452.7)\times 0.25=-295.9 \text{ kj/kg } (-70.688 \text{ kcal/kg})$$

While the vapour portion will actually loose some of its enthalpy ($W_{vaol}$), which is:

$$(W_{vapl})=(506-452.3)\times 0.75=40.275 \text{ kj/kg } (-9.621 \text{ kcal/kg})$$

And:

$$-295.9-(-40.275)=255.6 \text{ kj/kg } (61.066 \text{ kcal/kg})$$

The two calculated values are reasonably close.

This is also a significant amount of power (work) for compression, and ammonia is therefore considered as a more suitable working medium for power generation.

Figure 19:
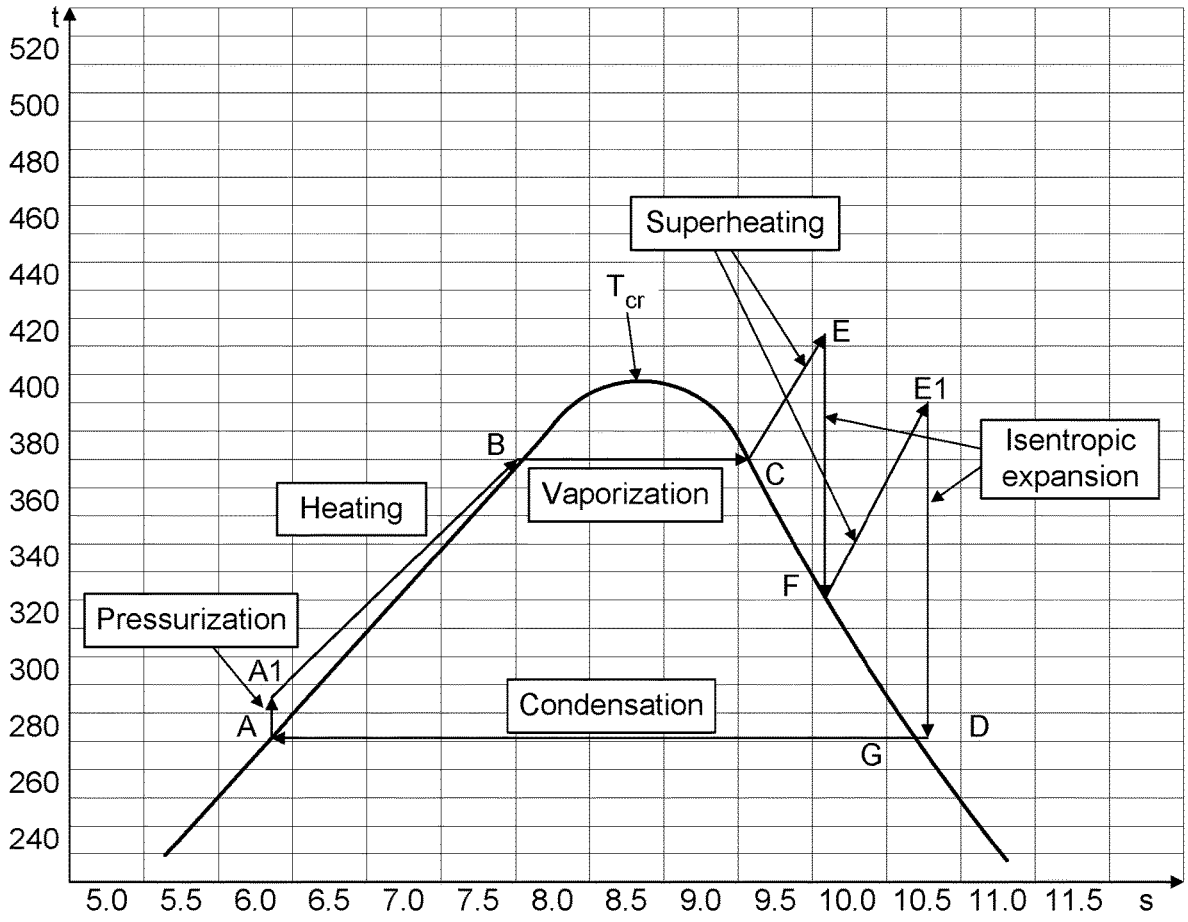
FIG. 19 shows Temperature-Entropy (T-s) diagram of Ammonia showing steps of a power generation loop with superheating of the high pressure vaporized ammonia with two stage ammonia expansions and interim superheating.

A.1 Power Generated from Ammonia Circulation:

Referring to FIG. 19, a diagram is shown of ammonia including steps of a power generation loop with superheating of the high pressure vaporized ammonia with two stage ammonia expansion and interim superheating.

According to the embodiments of heat engine 200, and the assume conditions of ammonia expansion in a two stage turbine, the generated power is:

Stage No1:

| | | | |
|---|---|---|---|
| Pressure in | 71.35 bar | Temperature in | 426 K |
| Pressure out | 25.0 bar | Temperature out | 331 K |
| Isentropic efficiency | 88% | | |
| Generated power | 154 kj/s or (kj/kg) | | |

Stage No2:

| | | | |
|---|---|---|---|
| Pressure in | 25.0 bar | Temperature in | 400 K |
| Pressure out | 5.5077 bar | Temperature out | 280 K |
| Isentropic efficiency | 90% | | |
| Generated power | 215.1 kj/s or (kj/kg) | | |

Total power ($W_{gen}$) produced by both stages of the ammonia expansion is:

$$(W_{gen})=154+215.1=369.1 \text{ kj/s or (kj/kg)}$$

$$(W_{gen})=369.1\times 0.001=369.1 \text{ MW}$$

B—Analysis of Energy Preservation System Loop,

Now the energy preservation and recycling loop with a suitable heating agent is explained and analysed. This loop is the most crucial novelty part of the proposed power system, and the selected heat agent as the working fluid for this loop is n-octane. This loop, when joined with the power generation loop (superimposed on) shall form the proposed novel "Atalla Harwen Cycle".

Figure 20:
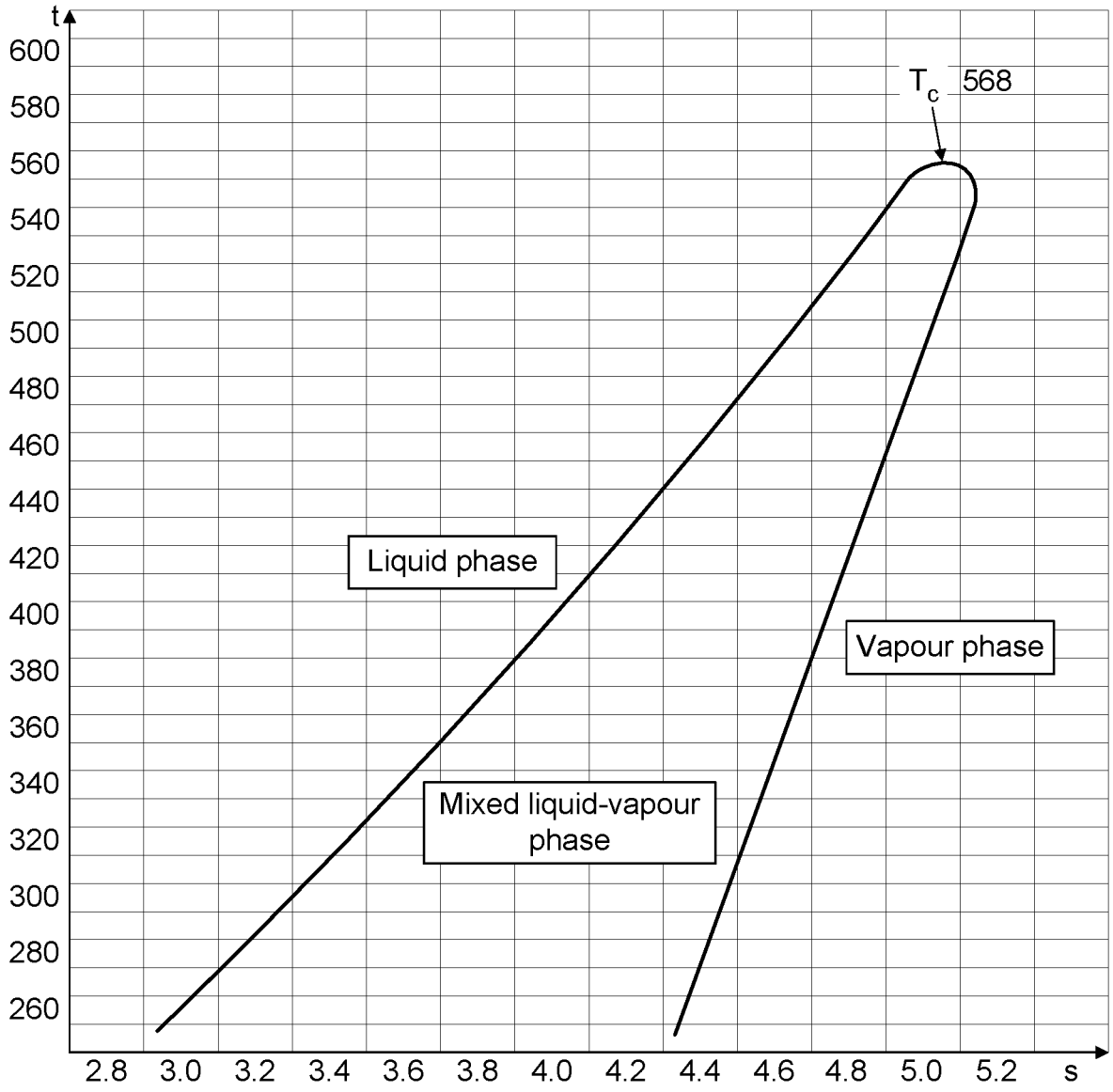
FIG. 20 shows Temperature-Entropy (T-s) diagram of n-Octane and areas of the material physical phase statuses.

FIG. 20 shows a Temperature-entropy (T-s) diagram of n-octane and areas of the material physical phase spaces. FIGS. 21, 22, 23, 24, 25, 26, 27, 28, 29 and 30 show different variations of the temperature-entropy (T-s) diagram of n-Octane.

Figure 21:
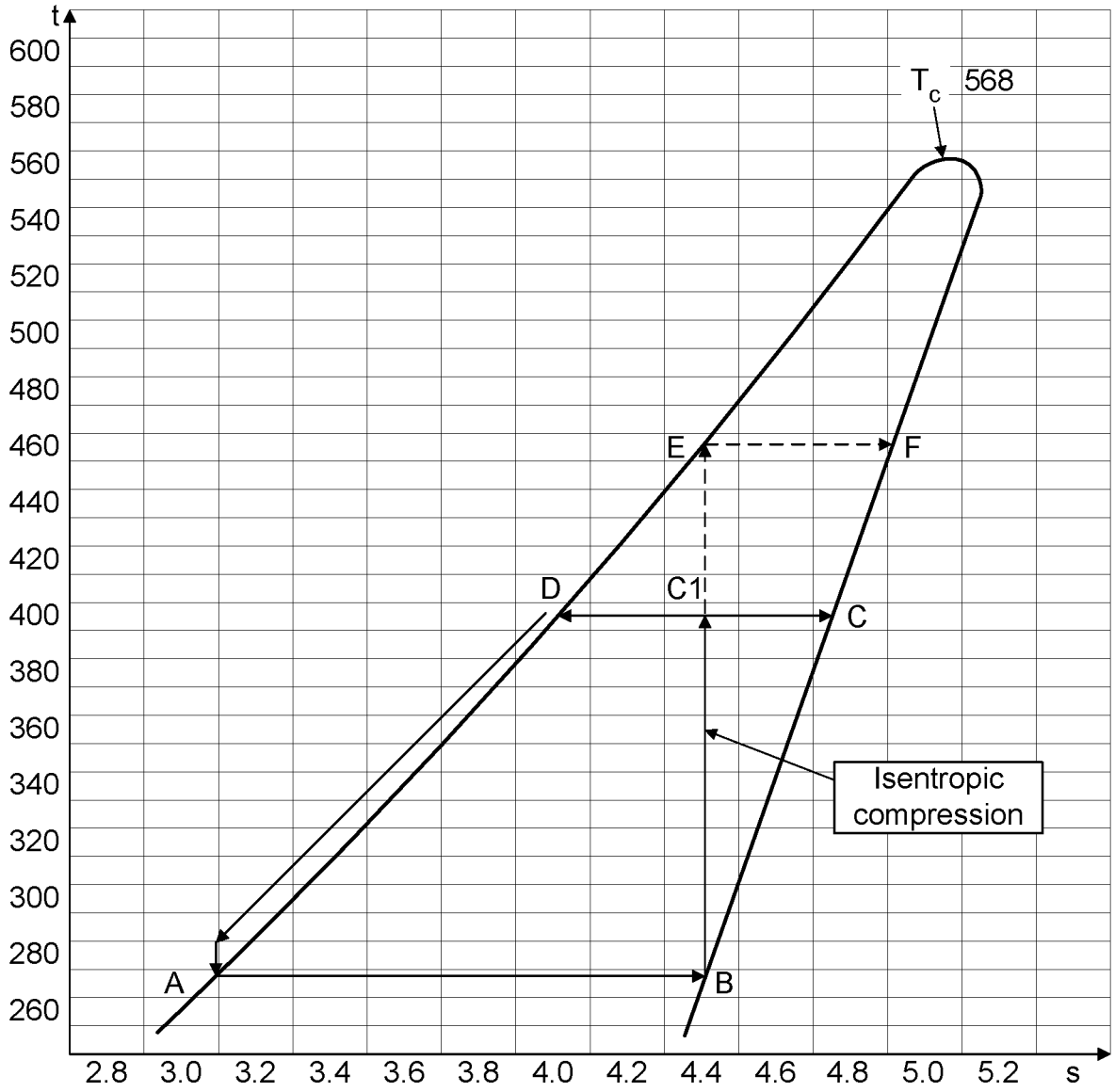
FIG. 21 shows Temperature-Entropy (T-s) diagram of n-Octane showing steps of the energy preservation loop with single stage compression of n-octane.

In FIG. 21, a Temperature-entropy (T-s) diagram of n-octane includes steps of the energy preservation loop with single stage compression of n-octane. Isentropic compression of the saturated vapours from point B along the path to point C1 are shown. Significant condensation of n-octane in a compressor is illustrated.

Figure 22:
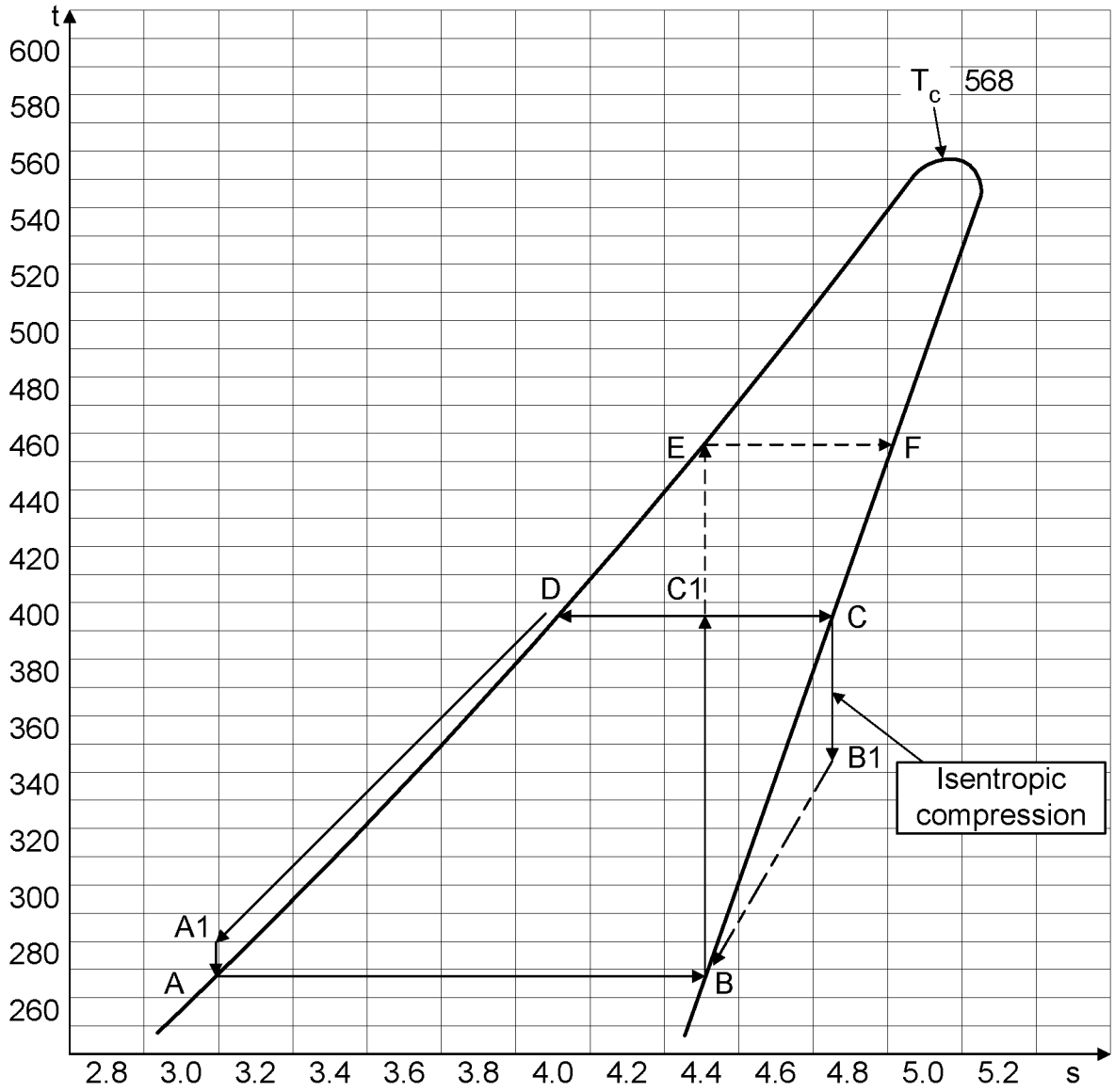
FIG. 22 shows Temperature-Entropy (T-s) diagram of n-Octane showing steps of the energy preservation loop with single stage of n-octane expansion from pressure of point C to pressure of point B.

In FIG. 22, Isentropic Ex compression is shown of the saturated vapours from point C along the path to point B1. Significant superheating of n-octane vapours at point B1 (temperature about 355 K) as compared with the saturation temperature at point B (temperature about 274 K) is shown.

Figure 23:
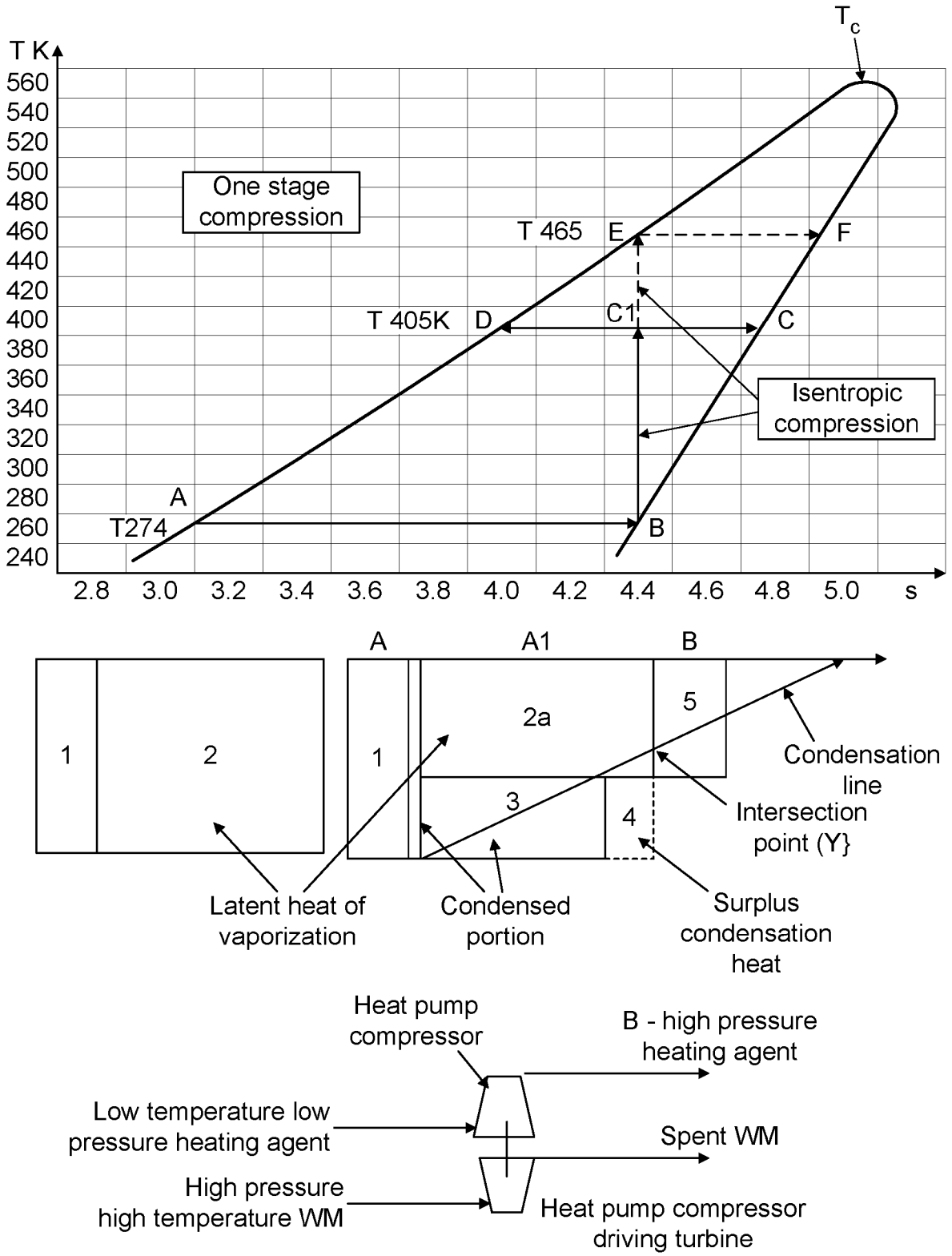
FIG. 23 shows Temperature-Entropy (T-s) diagram of n-Octane showing steps of the energy preservation loop with single stage compression of n-octane from the saturation state at point B, and representation of energy constituents by corresponding areas.

In FIG. 23, a temperature-entropy (T-s) diagram of n-octane shows steps of an energy preservation loop with single stage compression of n-octane from the saturation state at point B, and representation of energy constituents by corresponding areas.

In FIG. 24, a temperature-entropy (T-s) diagram of n-octane shows steps of the energy preservation loop with multi stage (e.g., 4 stages) compression of n-octane from the saturation state at point B and withdrawal of condensate at the end of each stage. Energy constituents are represented by the corresponding areas.

Figure 25:
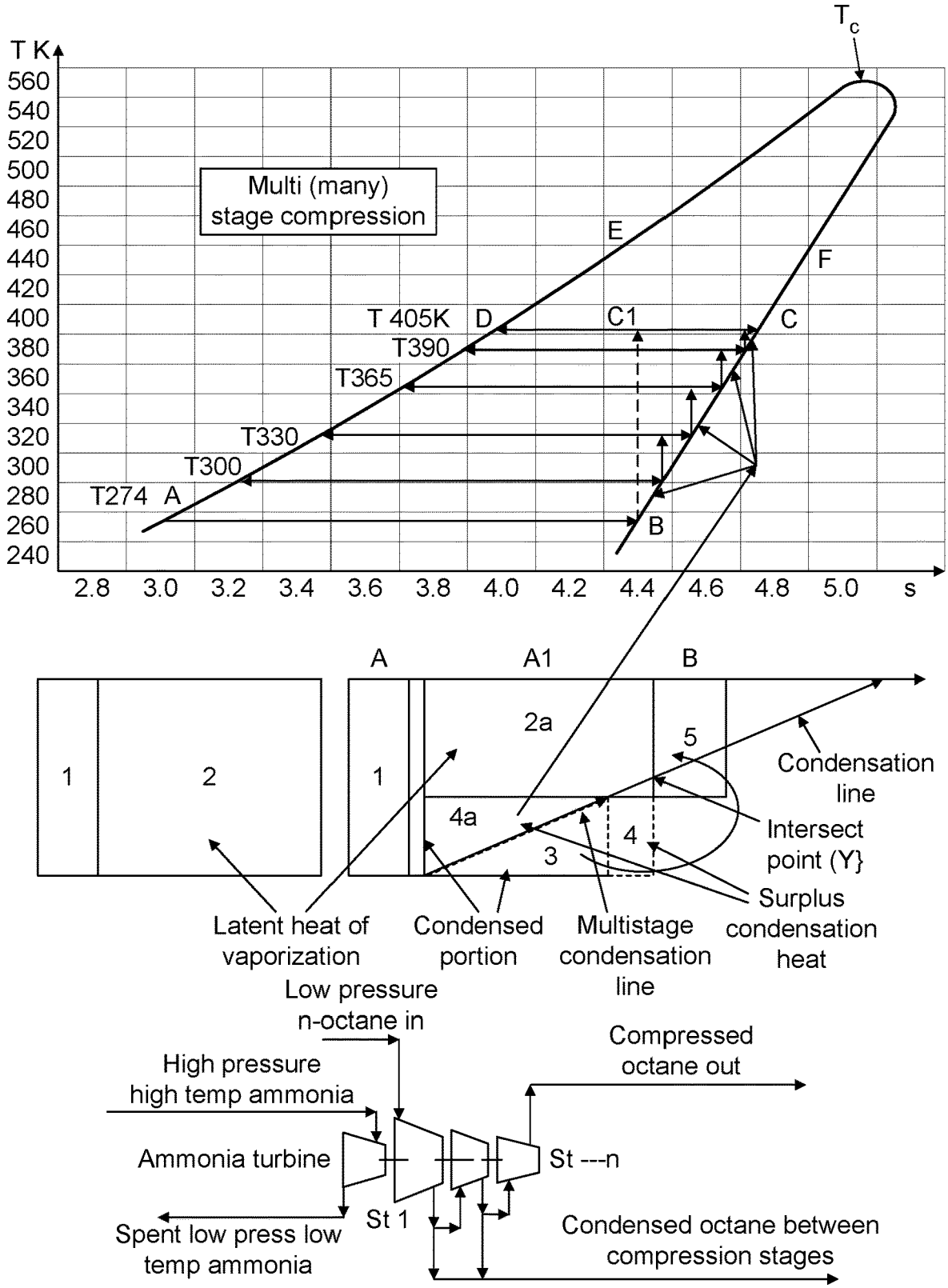
FIG. 25 shows Temperature-Entropy (T-s) diagram of n-Octane showing steps of the energy preservation loop with infinite stages of compression of n-octane from the saturation state at point B and withdrawal of condensate at the end of each stage.

In FIG. 25, a temperature-entropy (T-s) diagram of n-octane shows steps of the energy preservation loop with infinite stages of compression of n-octane from the saturation state at point B and withdrawal of condensate at the end of each stage. Energy constituents are represented by the corresponding areas.

Figure 26:
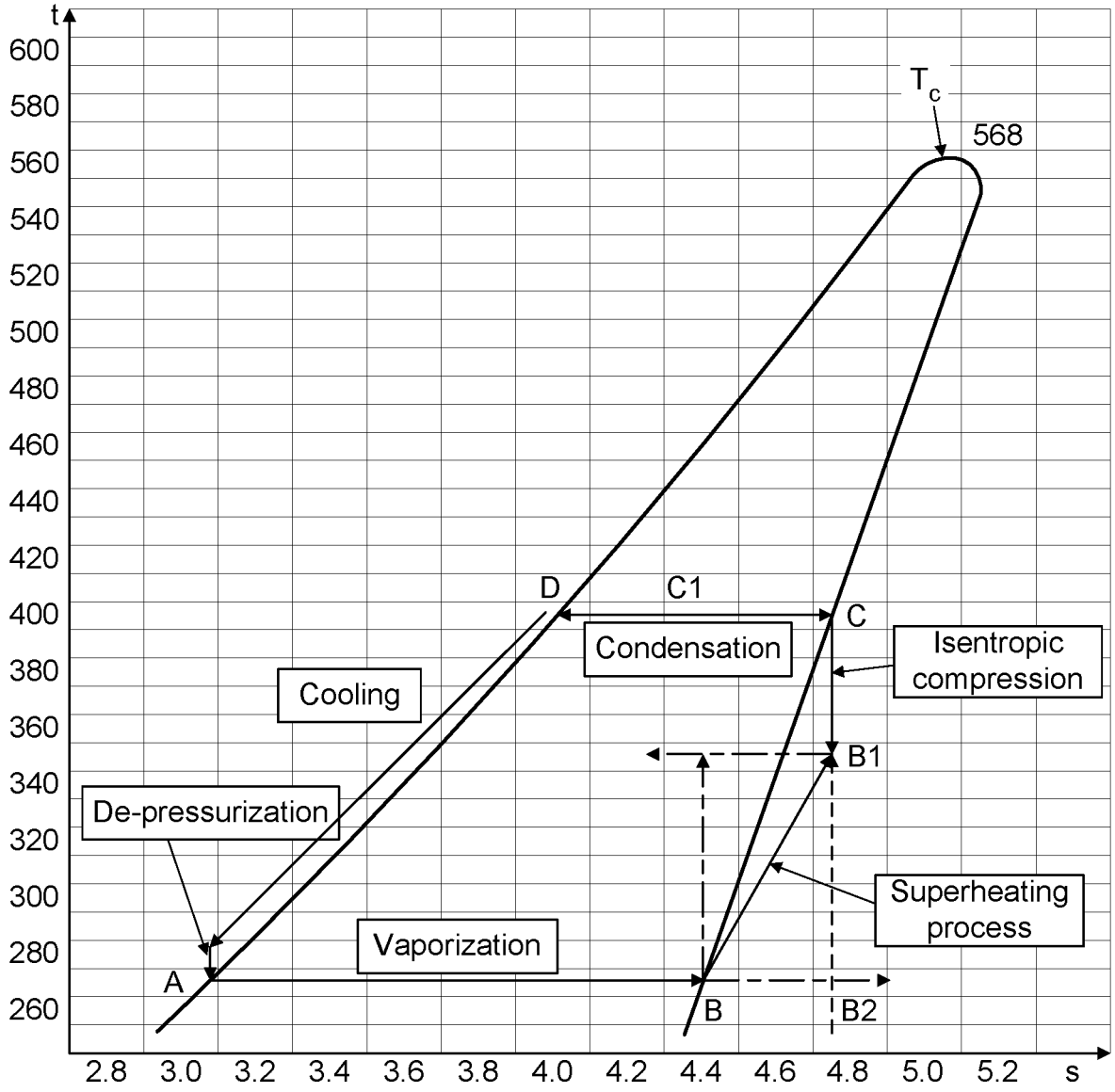
FIG. 26 shows Temperature-Entropy (T-s) diagram of n-Octane showing steps of the energy preservation loop with superheating of n-octane prior to feeding to the compressor.

In FIG. 26, a temperature-entropy (T-s) diagram of n-octane shows steps of the energy preservation loop with superheating of n-octane prior to feeding to the compressor. Superheating of n-octane vapours is shown from point B to point B1. Isentropic compression of the superheated n-octane vapours is shown from point B1 to point C. Minimum or no condensation of n-octane is illustrated inside the compressor.

Figure 27:
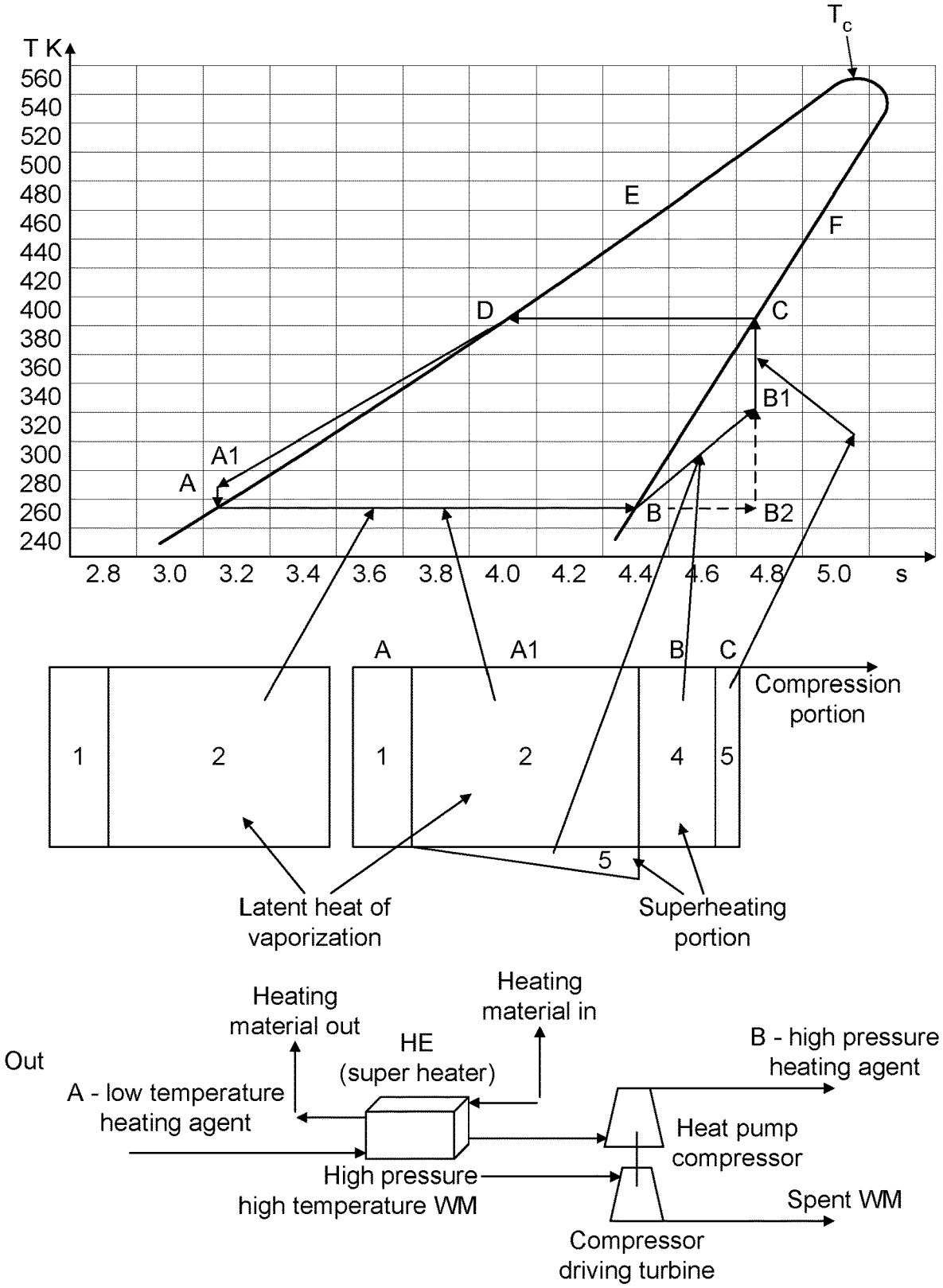
FIG. 27 shows Temperature-Entropy (T-s) diagram of n-Octane showing steps of the energy preservation loop with superheating of n-octane prior to feeding to the compressor.

In FIG. 27, a temperature-entropy (T-s) diagram of n-octane shows steps of the energy preservation loop with superheating of n-octane prior to feeding to the compressor. Energy constituents are represented by the corresponding areas.

Figure 28:
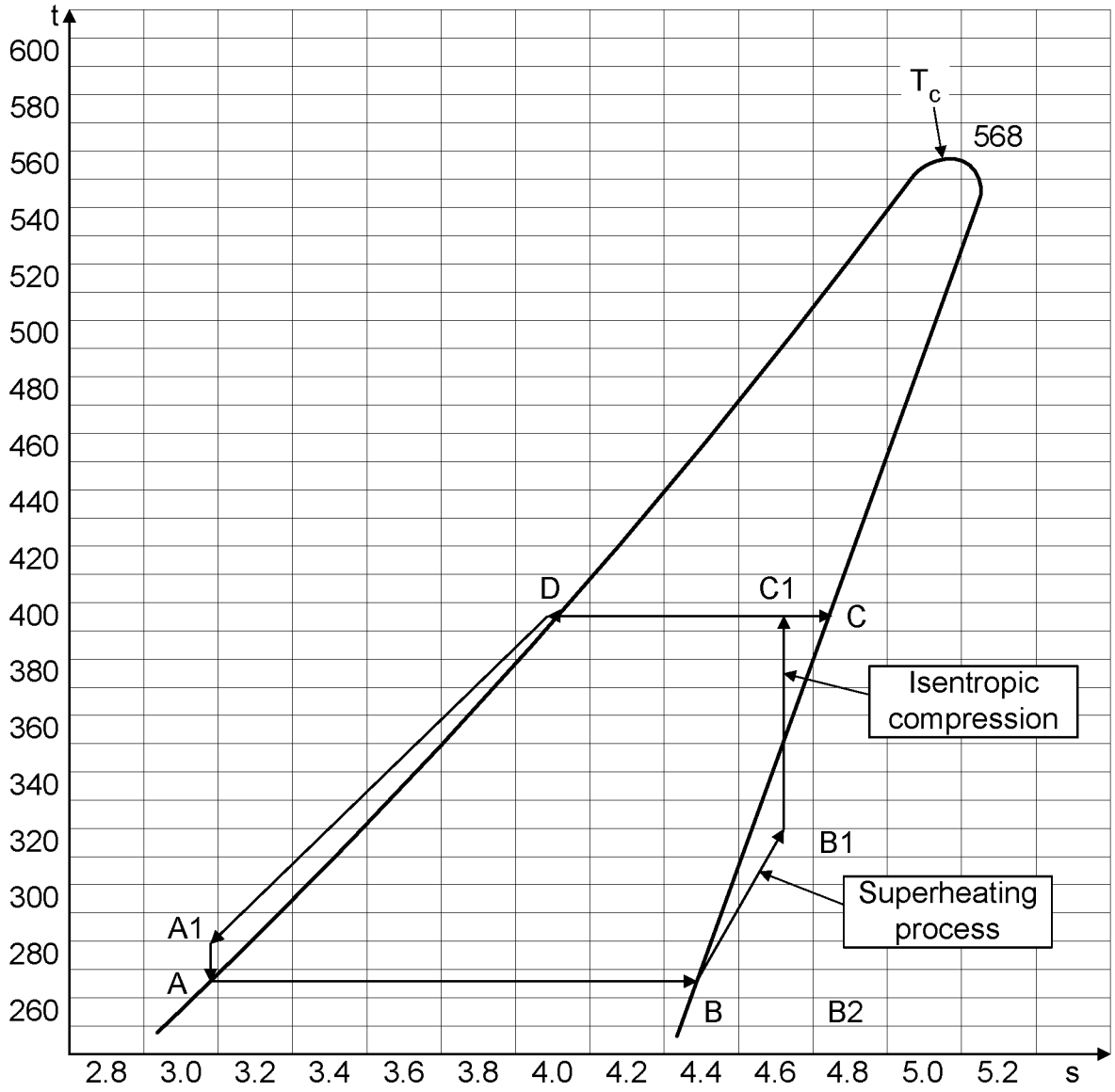
FIG. 28 shows Temperature-Entropy (T-s) diagram of n-Octane showing steps of the energy preservation loop with partially superheating of n-octane prior to feeding to the compressor.

In FIG. 28, a temperature-entropy (T-s) diagram of n-octane shows steps of an energy preservation loop with partially superheating of n-octane prior to feeding to the compressor.

Superheating of n-octane vapours from point B to point B1 is shown. Isentropic compression of the superheated n-octane vapours from point B1 to point C1 (C) is shown. Reduced condensation of n-octane inside the compressor is shown.

Figure 29:
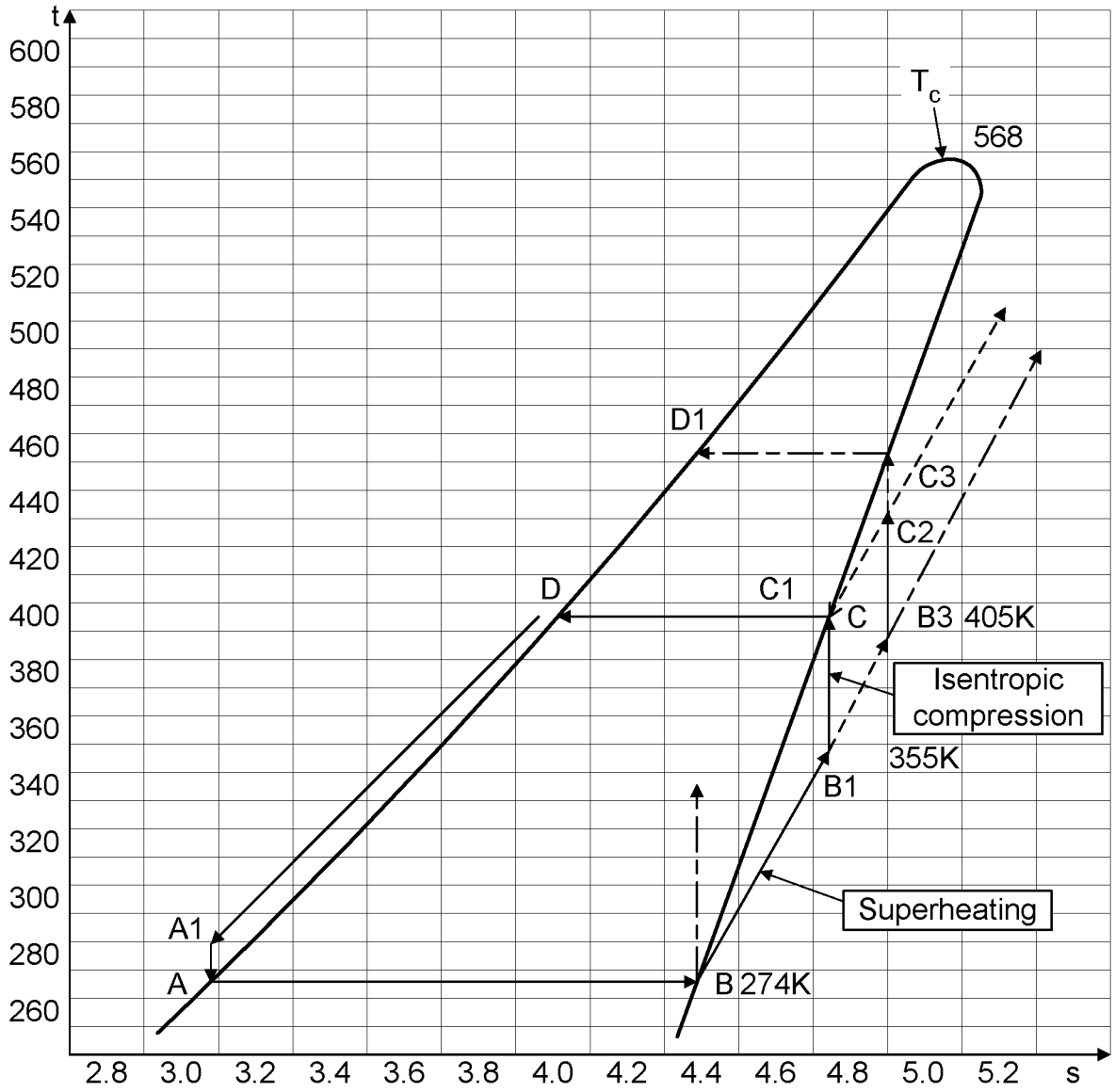
FIG. 29 shows Temperature-Entropy (T-s) diagram of n-Octane showing steps of the energy preservation loop with superheating of n-octane prior to feeding to the compressor.

In FIG. 29, a temperature-entropy (T-s) diagram of n-octane includes steps of the energy preservation loop with superheating of n-octane prior to feeding to the compressor. Superheating of n-octane vapours from point B to point B1 and B3 is shown. Isentropic compression of the superheated n-octane vapours from point B3 to point C2 is shown. Cooling to saturation state at point C is shown. No condensation of n-octane inside the compressor can occur.

Figure 30:
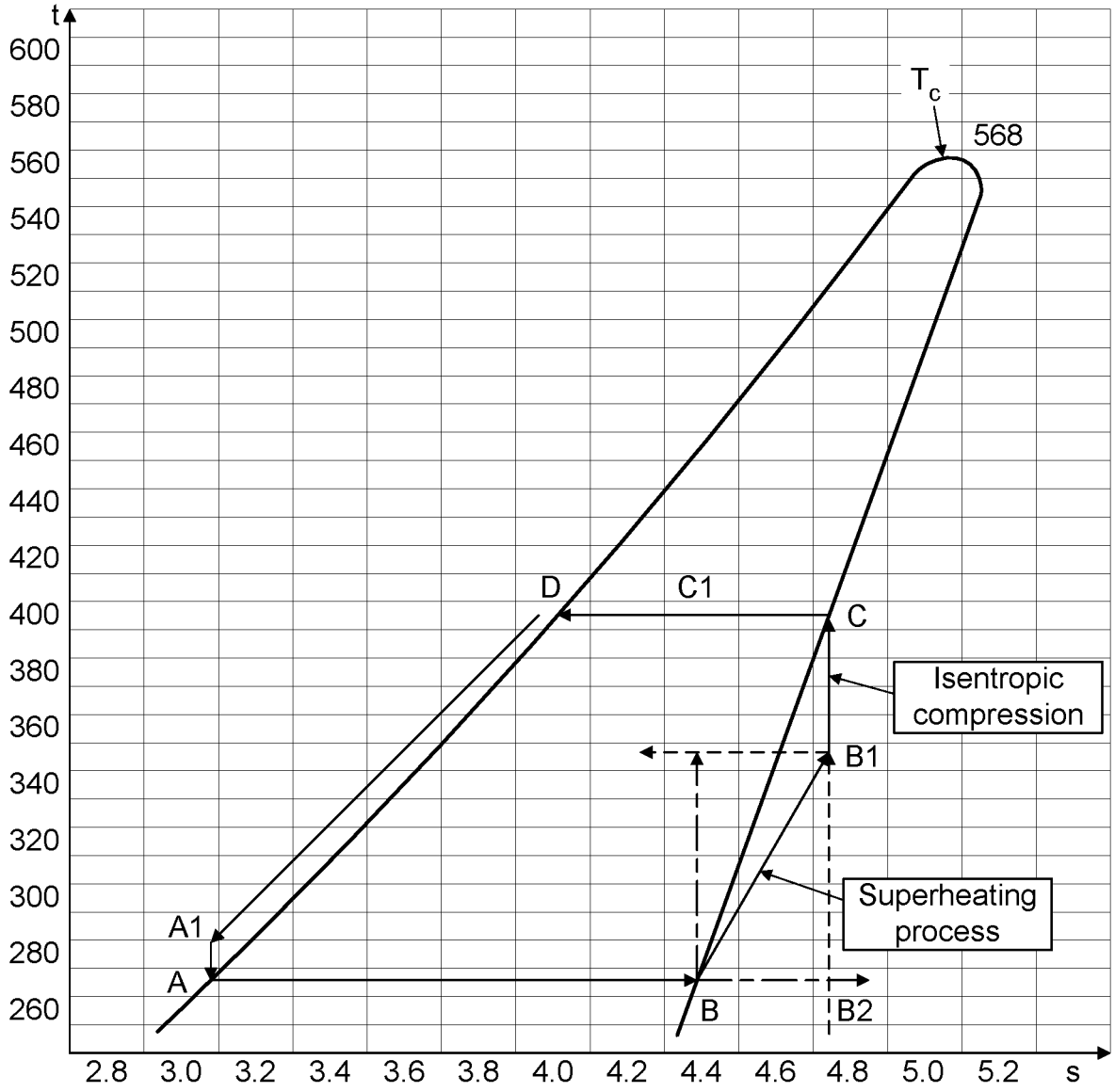
FIG. 30 shows Temperature-Entropy (T-s) diagram of n-Octane showing steps of the energy preservation loop with superheating of n-octane prior to feeding to the compressor.

In FIG. 30, a temperature-entropy (T-s) diagram of n-octane shows steps of the energy preservation loop with superheating of n-octane prior to feeding to the Compressor. Truncated isentropic compression of the superheated n-octane vapours is shown by a significant margin, from point B or B2 to point B1. Compression work required only from point B1 to C is shown, under highly reduced specific heat (Csp) of n-octane, as compared with the specific heat of n-octane under constant pressure (Cp) from point B to point C.

Referring to FIG. 22, it shows temperature-entropy (T-s) diagram of pure n-octane and regions of its phase existence and inter-changes, which are:

d—Liquid phase region, where n-octane is always in liquid form, e—Mixed Liquid-Vapour phase region, where n-octane exists in an equilibrium state of mixed liquid and vapour, phase, f—Vapour phase region, where n-octane is always in vapour form, Referring to FIG. 22, it shows that entropy of n-octane for both liquid (line A-D-$T_{cr}$), and vapours (line B-C-$T_{cr}$), increases with increasing temperature. The entropy path lines of vapour and liquid move in the same direction, but also converge and finally meet at the critical temperature ($T_{cr}$) in an elliptical type (shape) top curve. There is expected therefore, an infinite number of isentropic lines which intersects with both the saturation vapours and saturation liquid lines at different temperatures. Increasing entropy of the vapour phase of n-octane with increasing temperature (thermodynamic property) is in contrast with same property of ammonia and other low molecular weight vapours and gases such as water vapour, methane, carbon monoxide, etc. who's vapour entropy doctresses with increasing temperature FIG. 16, line D-C-$T_{cr}$ (as discussed above in the working medium section). The contrasting directions of entropy of ammonia and n-octane vapours with increasing temperature, entails that they will demonstrate different thermodynamic behaviour and characteristics during compression and expansion vapours and gas processes of these two materials.

As shown earlier and due to the high value of the exponent (n) in the equation of state of ammonia (n=1.312), isentropic compression of ammonia vapours to a higher pressure, results in superheating vapours to a much higher temperature than the saturation temperature at the final compression pressure. As was shown, when ammonia vapours are compressed from the saturation pressure of 5.5077 bar to 71.35 bar, temperature of the compressed vapours will be at 496.5 K, while the saturation temperature of ammonia at 71.35 bar is only 380 K.

However, isentropic compression of n-octane saturated vapours from any specified pressure to a higher pressure, as in FIG. 22, line B-C1, the process will take the vertical direction from any point on the vapour saturation line B-C to near Tcr, and is within the liquid-vapour status area of n-octane. Hence, the compression process will result in condensation of some amounts of n-octane vapours inside the compressor and the final pressurization temperature of the n-octane saturated vapours, is always equal to the saturation temperature of vapour phase at that higher final compression pressure as shown in FIG. 22 points C and C1. Condensation of n-octane vapours, and similar materials, during compression from the saturation conditions, is actually a necessity so that the condensed portion of n-octane, releases its latent heat into the compressed materials to sustain the compression process and continuously raise temperature of the formed vapour-liquid mixture to reach the saturation temperature at the final pressure (thermodynamic necessity).

On the other hand, if n-octane vapours are allowed to undergo isentropic expansion from a higher saturation pressure level, such as point C FIG. 22, to a lower pressure, then the isentropic expansion process will also progress along the vertical direction from any point on the vapour saturation line B-C to near Tcr, such as point C, and is within the all vapour superheated status area of n-octane. Hence, the expansion process will take the path from point C to Point B1 and will terminate at point a on the vertical line such as point B1, if the final expansion pressure is selected as the saturation pressure of point B. Although the isentropic expansion of n-octane vapours results in their relative cooling from the top temperature, but they will be at the superheating state at the final expansion pressure and they will be at a much higher temperature as compared with the saturation temperature of the final expansion pressure at point B. This behaviour of n-octane vapours is in contrast to ammonia behaviour during expansion process, which as was shown, results in significant cooling and condensation of ammonia vapours if expanded from the saturation line point C FIGS. 16 and 17. The contrasting behaviour and effect of expansion of vapours of the two materials can be explained from the adiabatic equation of state No 1, of gases and vapours and application to n-octane also and compare with earlier calculation results of ammonia.

$$PV^n = \text{Constant}, \qquad \text{Eq 1a}$$

Value of exponent n for ammonia is 1.315

Value of exponent n for n-octane is 1.0227

B1—Thermodynamics of Heating Agent n-Octane,

For the energy preservation and recycling loop:

Now, thermodynamic behaviour and characteristics of the heating agent n-octane during compression and expansion processes through the energy preservation and recycling loop compressor, with the corresponding temperature changes, will be described and analysed and results will be compared with those of the ammonia behaviours as applicable. Process temperature changes of n-octane with pressure, are the main indications and criteria of the system operation and possible economics, and are highly dependent on its thermodynamic properties, per the equation of state:

$$PV^n = \text{Constant, and:} \qquad \text{Eq 1a}$$

For n-octane and similar materials, exponent n=about 1.0227

In the temperature range 295 K-400 K

This relatively low value of exponent (n) in the equation of state of n-octane, entails that when compressing n-octane and similar materials vapours, or expanding them though turbines, they will demonstrate different thermodynamic behaviour from that of ammonia which has the exponent (n) value of 1.315.

For example if it is required to compress n-octane vapours from the saturation pressure of 0.000466 MPa (0.00466 bar) which corresponds to saturated vapour temperature of 274 K (1.0° C.) point B FIG. 22, to a pressure where temperature of the compressed saturated vapours is 405 K (132° C.), which is the saturation vapour pressure of 0.12218 MPa (1.2218 bar) point C FIG. 22, thermodynamics of the compression process are defined and analysed, per the equation state of gases and vapours applied for n-octane, as follows:

$$PV^n = \text{Constant, and:} \qquad \text{Eq 1a}$$

$$\frac{P_2}{P_1} = \left\{\frac{V_1}{V_2}\right\}^n \qquad \text{Eq 3}$$

$$\frac{T_2}{T_1} = \left\{\frac{V_1}{V_2}\right\}^{n-1} \qquad \text{Eq 4}$$

Then:

$$\frac{1.2218}{0.00466} = \left\{\frac{V_1}{V_2}\right\}^n$$

$Lg\ 262.18888 = 1.0227 \times Lg(V1/V2)$ $(V1/V2) = 231.70227$

Hence:

$T_2 = 274 \times (231.70227)\hat{}0.0227 = 274 \times 1.1131576$ $T_2 = 310.052$ K However, the saturation temperature of n-octane vapours at pressure of 1.2218 bar is 405 K, which indicates that there is a large deficit of energy in the system to elevate temperature of the compressed materials (n-octane vapour-liquid mixture) to the required 405 K and is not provided by compressor work. There must be therefore, a supplement internal source of energy (reorganization) within the system.

FIG. 22, shows that during the isentropic compression of n-octane from the pressure of 0.00466 bar (point B), to 1.2218 bar along the path B-C1, there is significant condensation of n-octane ($G_{con}$) which is about 47.43%, calculated from entropy change:

$$G_{con} = \frac{\text{Line } C\text{-}C1}{\text{Line } C\text{-}D} = \frac{4.632 - 4.291}{4.632 - 3.913} = \left(\frac{0.341}{0.719}\right) \times 100 = 47.43\%$$

Accordingly, only 52.57% of the initial amount of vapours at point B will remain in vapour phase when the compression process reaches point C. The large condensation of n-octane 47.43%, during compression process and proportionate reduction in the gas volume is expected to affect the required amount of compression work. Required work to compress one kg of n-octane from pressure of 0, 00466 bar to 1.2218 bar can be defined from analysis of FIGS. 22 and 23 through the areas representing compression energy components, associated with the outlet product components from the compressor, and in conjunction with embodiments of the heat engine 200 diagram and FIG. 3, as follows:

Area No 1: Represents the energy status of liquid n-octane at the entrance to the heat exchanger (condenser) 204, FIG. 3, Area No 2: Represents the latent heat of vaporization, which is added to the unit weight of n-octane in the heat exchanger (condenser) 204, FIG. 3, and is the energy status of the fully vaporized and saturated n-octane at the entrance to the energy preservation and recycling compressor 231, when by-passing the super heater 240 and the start of compression process, Area No 2a: Represents the latent heat of the vapour portion of n-octane at the outlet of the energy preservation and recycling compressor 231, Area No 3: Represents the latent heat of the condensed portion of n-octane at the outlet of the energy preservation and recycling compressor 231, which go out of compressor as part of energy of the condensed n-octane energy (not added by compressor 231), Area No 4: Represents the latent heat of the condensed portion of n-octane at the outlet of the energy preservation and recycling compressor 231, which does not go out as part of energy of the condensed portion of n-octane but actually migrates to the vapour portion of n-octane, Area No 5: Represents the added energy to vapour portion of n-octane during compression, and comprises two sources of energy which are:

a—Compressor work of compression b—The migrated portion of latent heat of the condensed n-octane which is represented by the area No 4, described above, Area No 1 represents energy of the liquid n-octane, heating agent, status at conditions of entrance to the heat exchanger 204, which is at the lowest temperature (cold reservoir temperature) of the heat engine 200 operation, and then enters the heat preservation and recycling system compressor 231, and exits compressor 231 in the proportionate amounts with:

Vapour portion

Condensed portion

This amount of energy of the heating agent is associated with the n-octane status at the entrance to the heat exchanger 204 of the low temperature reservoir and does not change while the material n-octane circulate within the energy preservation loop, and when the heating agent completes the full circulation loop (cycle) and reaches back to the entrance of heat exchanger 204, n-octane is always at the same status and is at the low temperature reservoir reference level.

Compressor work (energy) ($W_{com}$) input into the n-octane vapours during compression, can be defined from the energy representation areas:

$(W_{com})$=Area No 5−Area No 4

Compressor work ($W_{com}$) is also defined from the difference between enthalpy of the unit weight of n-octane into the compressor 231, and enthalpy of same unit weight of n-octane out of the compressor as follows: (enthalpy h of n-octane into the compressor and of each component out from the compressor 231 is suffixed by the relating area number of FIG. 23):

$(W_{com})$=(Area No 2)−(Area No 2*a*+Area No 5+Area No 3), Or;

$(W_{com}) = h_2 - (h_2 + h_5 + h_3)$, $(W_{com})$=380−(380×0.5257+234.4×0.5257+(0.4743× Specific heat 2.41×delta *T* 131))

$(W_{com})$=380−(199.61+123.14+149.803)

$(W_{com})$=380−470.87=−92.553 kj/kg (−22.110 kcal/kg)

The required compression work per kg of n-octane, to absorb the condensation latent heat (rejected) of spent ammonia and elevate its temperature from outlet of the turbine 202, for re-use inside the system heater 211, is expected to be relatively high. To absorb the latent heat of condensation of one kg/s of ammonia will require about 3.6 to 3.8 kg of n-octane, and the huge amount of condensation of n-octane inside compressor, may make this option not realistic or practical. Taking system efficiency into account, the required specific energy per one kg of ammonia is:

−92.553×3.6/0.80=−416.488 kj/kg (−99.49 kcal/kg)

This is indeed a very high energy requirement for the compression process and will not make this option realistic or practical, from the economics point of view.

By further analysing FIGS. 22 and 23, they also show that if the isentropic compression process of n-octane is continued along the constant entropy line (B-C1-E), to a temperature of about 465 K (192° C.) with the corresponding pressure of about 0.475 MPa (4.75 bar), then the compression line will intersect with the liquid-vapour saturation line A-D-$T_{cr}$, at point E. Accordingly, entropy of both vapour and liquid phases of n-octane on the constant entropy line B-C1-E are actually equal, and they are:

Entropy of the vapour phase at the start of compression process, point B, at temperature of 274 K and pressure of about 0.000466 MPa, is, s=4.291 kj/kg·K Entropy of the liquid phase at the end of compression process, point E, at temperature of 465 K and pressure of about 0.475 MPa, also is, s=4.291 kj/kg·K At point E of the compression process, the entire amount of n-octane vapours will condense to liquid (full phase change) and therefore, the laws of gas and vapour compression thermodynamic will no longer be applicable (becomes saturated liquid pumping process).

Maximum required work ($W_{cmax}$) of the energy preservation and recycling system compressor is expected therefore to be, when the vapour phase is exhausted and entire amount of n-octane vapours are condensed at point E. Maximum work ($W_{cmax}$) for compressing one kg of n-octane vapours at the inlet into the compressor, can be calculated from enthalpy change of n-octane from point B (full vapour phase $h_B$) to point E (full liquid phase $h_E$), on the constant entropy line, and is:

$$W_{cmax}=(h_E-h_B)=864-970=-106 \text{ kj/kg } (-25.32 \text{ kcal/kg})$$

This is also a relatively high requirement of compression work per kg n-octane and is significantly higher than the required work for compression of one kg of n-octane to 1.2218 bar, which is −92.553 kj/kg (−22.110 kcal/kg) and with condensation of 47.43% of n-octane inside the compressor. Either of these two options may not be a realistic or practical option from the economics point of view, due to the high specific compression work requirement and huge amount of condensation of n-octane inside the compressor.

However, this may still not be (represent) the maximum required work as the large volume of the vapours is no longer a factor of internal energy, due to the phase change to liquid with hugely reduced volume, per the following equation, and needs to be accounted for.

$$h=U+P\partial V \quad \text{Eq. 7}$$

And:

$$\Delta h=\Delta U+P\partial V \quad \text{Eq. 8}$$

Where:

h—is the n-octane enthalpy kj/kg

U—is the n-octane internal energy kj/kg

P—is the n-octane pressure MPa

V—is the n-octane volume $m^3$,

The calculated large percentage of condensation inside the compressor 47.43% may also be difficult to handle in one compression stage. In the industrial applications, gas and vapour compressor's smooth operation and work is mostly conducted without significant condensation of the compressed fluid (agent) inside the compressor, which can cause damage to the compressor parts. There are therefore, condensation tolerances which manufacturers provide along with the operation data for each type and models of their compressors. Some compressors can operate with up to 16% condensation of the heating agent inside them. Hence to utilize heating or cooling agents (materials) with such high condensation portion 47.43% inside the compressor as n-octane, practical technical measures need to be introduced and/or supplemented to ensure a smooth and reliable operation of the compressor.

There are several technical options which can be taken to control or avoid condensation of the compressed fluid (vapour or gas) inside the compressors, such as the use of:

a—Multi stage compressors, and withdrawal of the condensate at the end of each compression stage from the system, b—Multi stage compression with vaporization of the condensed portion of n-octane at the end of each stage, c—Superheating of n-octane vapours prior to feeding to the compressor and compression process, in one stage or multi stage superheating, d—A mixture of measures such as superheating and allowance of some tolerable condensation inside the compressor, Etc.

These options and others are discussed in details in the next section of the report.

8—REQUIRED SPECIFIC ENERGY (POWER) FOR COMPRESSOR OF THE:

Energy Preservation and Recycling System

Required specific energy (power) to compress one kg of the heating agent n-octane vapours (and any other similar heating agents) from any suitable initial pressure, through the energy preservation and recycling system compressor to the final suitable selected pressure, is an important criteria and indicator of the system suitability, operability and is a crucial matter for the economic evaluation and future considerations of this invention. Hence, a more detailed analysis and discussion of the specific power requirement to compress unit weight (for example one kg) of n-octane based on its thermodynamic properties and under different technical conditions, have been made to assist explain and evaluate the proposed system configuration, embodiments (its components), their functions/interaction and other relating aspects of the invention.

The inventor has appreciated that the most crucial subject and matter of energy loss from the conventional power plants is the heat rejection from condensation of spent working medium water vapours from the turbine to the outside coolants and environment, and in this case from ammonia spent vapours to the coolant (if and when used). Attempts and efforts are therefore concentrated on the techno-operational issues and practical proposal of reducing or preferably eliminating the need for the outside coolant to cool and condense the spent ammonia in the condenser 204 (FIG. 3).

Accordingly, an example of the suitable operation conditions is selected to condense the spent ammonia vapours from turbine 202, which is at 280 K (7.0° C.) in the heat exchanger/condenser 204, by utilizing and vaporizing a suitable hearing agent (in this example n-octane) on the other side of the heat exchange surface. It is required therefore, to vaporize liquid n-octane at a lower temperature of—say 274 K (1.0° C.) which corresponds to the saturation pressure of 0.000466 MPa (0.00466 bar), and then lift the vapours temperature to—say 405 K (132° C.) which corresponds to the saturation pressure of 0.12218 MPa (1.2218 bar), to be able to re-use the lifted latent heat energy to heat and vaporize high pressure liquid ammonia. Required power (work) to compress one kg of n-octane within this temperature range and limits (and the corresponding saturation pressures) is calculated, analysed and evaluated using several methods as follows.

8.1 Calculation of Compressor Work:

Calculation of the required compressor work is conducted from the following basic assumptions (conditions) which are suitable and necessary to;

a—Absorb condensation latent heat of spent ammonia (at low temperature and low pressure), and then, b—Re-use of the lifted heat (energy) at high temperature to heat and vaporize the high pressure liquid ammonia from the cold condensation temperature, Basic Assumptions:

| | |
|---|---|
| Fluid (material) | Pure n-octane |
| Flow rate | 1.0 kg/s |
| Compressor inlet pressure | 0.00466 bar |
| Vaporization temperature | 274 K (1.0° C.) |
| Compressor outlet pressure | 1.2218 bar |

Work requirement of the most suitable economic operation option for compressing one 1.0 kg of n-octane is then selected to calculate the required work for satisfying conditions of the flow rate of one kg/s of working medium ammonia through the system and evaluate the total work (or power) and system performance accordingly.

8.2 Compressor Operation Options and Modes

There are several options for selecting and organizing the compressor configuration and operation, and approaches to the calculation of specific power requirement to compress one kg/s of n-octane for each option, and are explained below:

8.2-1 Direct Compression from Saturation Status,

This compression option is performed from n-octane conditions of the saturation line B-C-$T_{cr}$, and is selected from point B FIGS. 22 and 23. Saturated n-octane is fed to the compressor under a pressure of 0,00466 bar and at temperature of 274 K (1.0° C.) and is compressed to the pressure of 1.2218 bar which corresponds to the saturation temperature of 405 k (132° C.). The conventional approach for calculation of the required compressor work (We) to compress any specified flow rate of a gas or vapour, and in this example one kg/s of n-octane, which is commonly used by researchers and designers, is from the difference between inlet enthalpy of n-octane vapours into the compressor ($h_{in}$) and the outlet enthalpy ($h_{out}$) of the vapours from compressed, per the first law of thermodynamics for conservation of energy:

$$W_c = h_{in} - h_{out} \quad \text{Eq 9}$$

Where:

$h_{in}$ Is enthalpy kj/kg of n-octane at the inlet into the compressor (at point B) FIGS. 22 and 23

$h_{out}$ Is enthalpy kj/kg of n-octane at the outlet from the compressor (at point C) FIGS. 22 and 23

However, compression process of n-octane can be performed by:

Single stage compressor and compression, regardless of the condensation portion of n-octane inside the compressor, and both condensate and vapours portions exit compressor at the same temperature of the vapour phase at the end of compression process, FIGS. 22 and 23 (point C), Multi stage compressor and compression and separation (withdrawal) of condensate from the vapour phase at the end of each compression stage per FIGS. 24 and 25, Required compressor work per one kg of n-octane, for each of the two cases is calculated as follows:

A—One stage compression and no separation of the condensed portion of n-octane from vapours to the end of compression.

Required specific compressor work per one kg of n-octane is calculated from the enthalpy of one kg of n-octane at the inlet into and outlet from the compressor and is, (and per energy representing areas of FIGS. 22 and 23) and conditions of n-octane at points B and C, FIGS. 22 and 23:

$$W_c = h_{in} - h_{out}$$

Condensed portion of n-octane through compressor was calculated (earlier) at 47.43%, and the remaining vapour phase portion is then 52.57%, and with reference to the energy representation areas of FIG. 23, then:

$$W_c = h_2 - (h_{2a} + h_5 + + h_3) = 864.4 - ((0.5257 \times 1094.8) + (0.4743 \times 803.7))$$

$$W_c = 864.4 - (575.536 + 381.195) = 864.4 - 956.731$$

$$W_c = -92.331 \text{ kj/kg } (-22.057 \text{ kcal/kg})$$

This value is very close to that calculated earlier from the specific heat of liquid n-octane, which is −92.553 kj/kg (−22.110 kcal/kg)

Required amount of n-octane ($G_{oct}$) to vaporize one kg of ammonia in the heat exchanger 204 is calculated from the latent heats of condensation of ammonia and vaporization of n-octane:

$$(G_{oct}) = \frac{1235}{380} = 3.25 \; kg \text{ n-octane per one kg of ammonia}$$

However, there are other needs within the system which require some further amounts of liquid n-octane to provide 3.25 kg in the heat exchanger 204, such as depressurisation of n-octane from hold tank 235 FIG. 3 and heat and energy balance of the system. Assume the full amount of required n-octane at 3.8 kg per one kg of working medium ammonia through the system (conservative).

Required specific compression work per one kg of n-octane is relatively high, and the total required compressor work for one kg of ammonia ($W_{c\ tot}$) through the system is expected at:

$$(W_{c\ tot}) = 3.8 \times (-92.331) = 350.857 \text{ kj/kg } (-83.82 \text{ kcal/kg})$$

When accounting for the system efficiency of about 80 to 85% while power generated from one kg of ammonia through the turbine is also calculated at about 350 kj/kg, then it may prove that the energy preservation system compression process not to be sufficiently economic if operated on this option. There is no net power generation.

By further analysing the compressor (system) operation, it reveals several factors and particularly of interest, the high energy (work) requirement for the system compressor, is due mainly to the fact that all the condensed n-octane inside the compressor exits at the end of compression process, regardless of the involved internal compression stages, at the same temperature as the vapour temperature of 405 K (132° C.). The condensed n-octane particularly at the initial stages of compression requires more energy to be heated to the final compression temperature, and the total amount of the required heating energy for the condensed portion in this example, is:

$$h_{liq} = 0.4743 \times \text{Specific heat} \times \text{Temp difference}$$

$$h_{liq} = 0.4743 \times 2.41 \times (405 - 274) = 149.803 \text{ kj/kg } (35.787 \text{ kcal/kg})$$

This is a significant amount of energy, although it is fully provided and compensated from the released latent heat of condensation ($h_{lat}$) of the condensed portion of n-octane inside compressor and is not provided as the compressor work. However, the released latent heat energy is a fixed amount for the selected conditions of compressor operation, and for this example, it is:

$$h_{lat}=0.4743\times380=180.234 \text{ kj/kg } (43.056 \text{ kcal/kg})$$

Accordingly, the released latent heat (energy) of the condensed n-octane is split between heating the condensate portion to the final compression temperature and migration to the vapour portion which supplements the compressor work, as follows:

With Condensate (as calculated above) 149.83 kj/kg

With Vapours (internal migration)=180.234-149.803=30.431 kj/kg (7.27 kcal/kg)

Due to the high level of condensation inside the compressor for one stage compression, the use of multi stage compression may become necessary, to reduce the required compressor work. Multi stage compression also provides the opportunity to increase the portion of migrated latent heat to the vapour portion and supplement the compressor work, as explained in the option B below.

B—Multi Stage Compression and Separation of Condensate at the End of Each Stage:

To reduce the required compressor energy for n-octane specific weight compression through the components of the energy preservation system and increase portion of released latent heat of n-octane condensation which supplements compressor work, it is necessary to use a multi stage compressor such as the 4 stage compressor shown in FIG. 13, and separate the condensed portion of n-octane at the end of first, second and third stages of compression, of the four (4) stage compression, while the condensed portion at the end of the fourth stage will exit the compressor with the remaining vapours, FIGS. 13 and 25. The required specific work per one kg of n-octane can then be reduced as follows:

Four stage compressions is adapted for this example, FIGS. 13 and 25. Hence, to achieve the required amount of condensation in four stages of compression, similar to that as with the theoretical one stage compression 47.43%, the condensation level at the end of each compression stage needs to be set (allowed) at about:

| | |
|---|---|
| Stage No 1 | 16% |
| Stage No 2 | 15% |
| Stage No 3 | 14% |
| Stage No 4 | 12% |

When more vapours of n-octane are condensed in each consecutive stage of compression and the condensate is withdrawn from the process, migration of surplus latent heat energy to the vapour phase intensifies and supports (supplements) the compressor work. This is due mainly to fact that no energy (much less) will be required to heat and increase temperature of the condensed n-octane from the previous stages. However, the increased migration and storing of the excess latent heat energy of condensation of n-octane in the vapours (priming of vapours), reduces the need to energy from outside sources for compressor work, it also reduces the need for extensive condensation of n-octane in each subsequent stage.

Hence, to condense 47.43%, of the compressed n-octane in 4 stages, it is likely that the final pressure and temperature at the end of the $4^{th}$ stage will be significantly higher than 1.2218 bar and 405° C. respectively. This is explained in the below similar case of infinite number of stages to condense along the saturation line B-C FIG. 25, and the required specific compression energy for the 4 stage compressor is expected to be higher.

8.2-2, Compression Along the Saturation Line (Vaporization Equilibrium Line):

This compression option is performed from n-octane conditions of the saturation line B-C-$T_{cr}$, and is selected from point B FIGS. 22 and 23. Saturated n-octane is fed to the compressor under a pressure of 0.00466 bar and at temperature of 274 K (1.0° C.) and is compressed along the saturation line B-C to the pressure of 1.2218 bar which corresponds to the saturation temperature of 405 k (132° C.). Theoretical amount of n-octane which will condense along the saturation line B-C, while compressing and continuously withdrawing the condensed portion of n-octane, is expected to be significantly less than 47.43%, and is in the range between 24% to 47%. It is more likely that the condensed portion to be only about 50% of that of a single stage compression 47.43%. This is due to the thermodynamic properties of n-octane and the requirement of maintaining the vapours fraction at 100% during compression process (no condensate to be compressed and heated) through continuously withdrawing the condensed amount of n-octane at the end of each infinite theoretical stage to the outside of compressor. Such operation conditions lead to the relative increased migration of the released latent heat (energy) of the continuously condensing n-octane to the vapour phase and therefore proportionately (significant) reduced need for condensation of n-octane inside the compressor to sustain the compression saturation temperature.

Latent heat ($L_{Th}$) which can be saved per one kg of the compressed n-octane and used to supplement the compressor work, while the compression progresses along the saturation line B-C, FIG. 25, is expected therefore to be significantly reduced and to be within the range of about 24% to 30%. Then the expected portion of the latent heat saving and migration to supplement the compressor work is assumed from condensation of only about 25% of input n-octane inside the compressor, while n-octane is compressed along the vapour-liquid equilibrium line B-C, FIG. 25, and its temperature is increased to 132° C.

Hence it is possible to save arithmetic half amount of the energy which is required to heat up the entire amount of condensate to the top compression temperature of 405 K (132° C.), plus the excess latent heat of condensation, which would not have been required for condensate heating under these selected conditions (FIG. 25, area 4 and 4*a*). The migrated energy ($E_{mig}$) is calculated as follows:

$$(E_{mig})=(0.25\times380)-((0.25\times131\times2.25)\times0.5)=95.00-36.844$$

$$(E_{mig})=58.156 \text{ kj/kg } (13.893 \text{ kcal/kg}) \text{ of } n\text{-octane}$$

Preserving such large amount of the released latent heat energy within the compressed vapours will actively supplement compressor work and contribute to minimizing the need to work from compressor (improve efficiency and economics of compression). Required compressor work to compress one kg of n-octane vapours from point B FIG. 25, is expected to be:

$$W_c=h_2-(h_{2a}+h_5-h_4)$$

$$W_c=h_2-(h_{2a}+h_5+0.25\times484.32-h_4)$$

$$W_c=864.4-((0.75\times1094.8)+(0.25\times484.32))-(0.25\times131\times2.25\times0.5))$$

$$W_c=864.4-(821.1+121.08+(95-36.844))$$

$$W_c=864.4-(821.1+121.08+36.844)$$

$$W_c=864.4-(821.1+36.844+121.08)=864.4-979.024=$$

$$W_c=-114.624 \text{ kj/kg } (-27.383 \text{ kcal/kg})$$

This is also a significantly increased amount of compressor work, as compared with the required work for the single stage compression. However, the amount of compressed n-octane vapours which reaches the final pressure is also significantly increased by a margin ($L_{comp}$) of:

$$(L_{comp})=0.75/0.5257=1.4267$$

It is reasonable to assume therefore for the comparison purposes, that the actual compressor work ($W_1$) required per the 52.53% of vapours reaching the final temperature as that amount with the single stage compression is:

$$(W_1)=114.624/1.4267=80.342 \text{ kj/kg } (-19.193 \text{ kcal/kg})$$

Although this compression work requirement is slightly less than the work required with the single stage compression work which is calculated at −92.331 kj/kg (−22.06 kcal/kg), it is still high and may not prove to be a viable economic option. There are probably other factors also which may affect the compression process along the saturation line, and make it difficult to achieve the assumed condensation amount along the equilibrium line (less or more amount) and therefore may require larger amount of energy.

As for the four stage compression process (compressor) which was discussed earlier, the specific required power is expected therefore, to be between −80.342 kj/kg (−19.193 kcal/kg) and −92.331 kj/kg (−22.057 kcal/kg), and are the two extreme operation cases on the two sides of the 4 stage compression process.

8.2-3, Superheating of n-Octane Prior to Feeding to the Compressor:

To avoid the need for a large number of separate compression stages and withdrawal facilities for the n-octane condensate at the end of each of those stages, while utilizing the entire amount of the theoretical condensation energy for migration to support the compressor work, superheating of n-octane vapours before feeding to compressor 231, can provide a more practical option to reducing the need for compressor work.

FIGS. 26 and 27 show the temperature-entropy (T-s) diagram of the heating agent n-octane. The diagram also show n-octane thermodynamic operation closed loop of energy preservation and recycling with the case (option) of superheating n-octane vapours in the heat exchanger 240 FIG. 3, prior to feeding to the energy preservation and recycling compressor 231. The said operation closed loop includes;

- Vaporization of n-octane in the heat exchanger 204, A-B,
- Superheating of n-octane in the heat exchanger 240, B-B1
- n-octane vapours isentropic pressurization in compressor 231, B1-C,
- Condensation of n-octane in the heat exchanger 211, C-D,
- Cooling of n-octane in the heat exchanger 209, D-A1,
- Depressurization of n-octane in the facilities 236*a*, A1-A
- Complete the energy preservation and recycling cycle and start the next cycle and repeat the cycles over and over again, Combining FIGS. 26, 27 and FIG. 3, they show that n-octane liquid is vaporized in the heat exchanger 204 at the constant temperature of 274 K and under the constant pressure of 0.00466 bar, by condensing the spent working medium ammonia at temperature of 280 K. From heat exchanger 204, n-Octane vapours are fed to the super heater 240 and heated to a temperature of about 355 K (82° C.) also under constant pressure and then fed to the compressor 231 to be pressurized to a preselected suitable pressure (in this case 0.12218 MPa, 1.2218 bar), under which the corresponding condensation saturation temperature of n-octane is lifted to 405 K. This is a relatively high temperature and can be used in the heat exchangers 211 and 209, to heat and partially or preferably fully vaporize the pressurised liquid working medium ammonia. In this configuration it is attempted to minimize, and preferably, eliminate condensation of n-octane vapours inside the energy preservation and recycling compressor (heat pump), to reduce the need for compressor work and also provide conditions for the smooth operation of compressor.

When the low pressure and low temperature n-octane vapours are superheated in the heat exchanger 240, it increases both the enthalpy and entropy of those vapours. Importantly also, specific heat of the low pressure n-octane from point B FIG. 26, under constant pressure ($C_p$), is significantly higher than the specific heat of the saturated n-octane vapours, which increases along the saturation line B-C, and the superheating process path is expected to be along the path (line) B-B1. Selection of the top temperature of superheating process of n-octane at point B1 is important to:

- a—Minimize and preferably eliminate condensation of n-octane inside the compressor of the energy preservation and recycling system during the isentropic compression of n-octane,
- b—Control and minimize the required compressor work input from outside, to compress unit weight of n-octane,
- c—Provide a smooth operation of the energy preservation compressor, Superheating Line B-B1 is expected therefore, to intersect with all the theoretical isentropic compression lines of n-octane on the path from point B to point B1. However, it is preferable that the top superheating temperature of n-octane is selected and controlled at a level where the entropy of the superheated n-octane vapours at the top heating temperature, point B1, is at least very close/equal to the entropy of the saturated n-octane at point C, or little higher. Entropy of n-octane at this superheating temperature 355 K corresponds and is equal to entropy of n-octane at the saturation temperature of n-octane at temperature 405 K (132° C.).

- Entropy of n-octane superheated vapours at point B1, at temperature of 355 K and pressure of about 0.000466 MPa, is, s=4.632 kj/kg·K
- Entropy of n-octane saturated vapours at point C, at temperature of 405 K and pressure of about 0.12218 MPa, is, s=4.632 kj/kg·K Accordingly, the "intersect point" of superheating lines B-B1 and the isentropic compression path (under constant entropy), which is the vertical line through point C, is the point B1. Higher superheating temperature will push the intersect point B1 higher up along the superheating line B-B1-B2, FIG. 28, and can also be suitable for the system operation and compressor work reduction. When the superheated n-octane is compressed (pressurized) isentropically, from point B1, the vertical process path line is expected to intersect with the saturation line at point C, where the pressure is the required top pressure at the corresponding equilibrium status of n-octane full vaporization at point C under the pressure of 0.12218 MPa (1.2218 bar) and temperature of 405 K (132° C.).

The available technical data and information of n-octane properties from the reliable published technical sources indicate that the required superheating temperature increase is about 81-85 K (81-85° C.), which can also be determined from either:

a—Temperature point where entropy of the superheated vapours from point B, is equal to entropy of the saturated n-octane vapour at point C.

Those published technical and thermodynamic data and properties of n-octane, indicate that this temperature is about 81 to 85 K above the temperature of n-octane at point B, which is (conservatively):

274+81=355 K (82° C.), or:

b—Calculated temperature from the isentropic expansion of the higher pressure n-octane vapours from point C to the pressure of point B, which is expected to be along the path C-B1, and is calculated as follows, Equation of state of gases and vapours process with no energy exchange with outside environment is:

$$\frac{P_2}{P_1} = \left\{\frac{V_1}{V_2}\right\}^n$$

and:

$$\frac{T_1}{T_2} = \left\{\frac{V_2}{V_1}\right\}^{n-1}$$

Hence $$\frac{1.2218}{0.00466} = \left\{\frac{V_2}{V_1}\right\}^{1.0227}$$

$$Lg(262.1888)=1.0227\times Lg(V_2/V_1)$$

$$Lg(V_2/V_1)=2.36493$$

$(V_2/V_1)$=231.702, and from the equation:

$$\frac{T_1}{T_2} = \left\{\frac{V_2}{V_1}\right\}^{n-1}$$

$$T2=405/(231.702)\hat{}0.0227=405/1.131576=357\text{ K}$$

$$T2=357\text{ K}$$

The calculated temperature is actually higher than the assumed temperature at point B1 of 355 K, for calculation of the required compressor energy (below), which means that calculation of the required compressor power is on the conservative side.

Superheating of n-octane from point B to point B1 is performed under constant pressure where it has high specific heat $C_p$, which is at the calculated temperature range is about 2.365 kj/kg·K (0.565 kcal/kg.° C.). Superheating energy ($h_{sup}$) input into the n-octane in the heat exchanger 240, is:

$h_{sup}$=Temp increase 81 K×Specific heat 2.365 kj/kg·K=191.565 kj/kg (45.763 kcal/kg).

If the superheated n-octane is then compressed under constant entropy (s) from point B1, the compression line is expected to intersect with the vapour-liquid saturation line at point C. Such a compression process under constant entropy is "isentropic" process and energy input from the compressor is required to increases temperature of the compressed n-octane vapours from 355 K to 405 K. The expected work input from the energy preservation and recycling compressor (heat pump principle) ($W_{cs}$) per one kg of n-octane is (referring to enthalpy h of n-octane, at the relevant points B1 and C from FIGS. 26 and 27) is:

$$(W_{cs})=(h_A+h_{sup})-h_C=(864.4+191.565)-1094.8=$$

$$(W_{cs})=-38.835\text{ kj/kg }(-9.277\text{ kcal/kg})$$

This amount of the required compressor work is significantly lower than the required compressor work input in the cases of single stage or multi stage compression, or along the saturation line B-C FIG. 25, without superheating. The introduced superheating energy into the n-octane vapours in the heat exchanger 240 is aimed to compensate for:

The need for n-octane partial condensation inside the compressor, to sustain the isentropic compression process, The required energy for entropy increase from 4.296 kj/kg·K at temperature of 274 K, to 4.632 kj/kg·K at temperature of 405 K, which requires energy ($E_{entr}$) of:

$$(E_{entr})=(Tc-Tb)(sb-sc)=(405-274)(4.632-4.296)=$$

$$(E_{entr})=44.016\text{ kj/kg }(10.515\text{ kcal/kg})$$

The required energy for entropy increase of n-octane heating from temperature of 274 K to 405 K (to the saturation pressure of 1.2218 bar) is provided from the superheating and there is no need therefore, to be provided by compressor work for compression (from outside the system). Accordingly, the isentropic compression of the superheated n-octane vapours will only add the missing portion of the specific heat for the temperature rise ($T_{rise}$) of:

$$(T_{rise})=405-351=54\text{ K }(54^\circ\text{ C.})$$

Specific heat ($C_{sp}$) of n-octane vapours under those conditions of isentropic compression (mild conditions) is relatively low, due to the fact that there is not required energy input for entropy increase and volume of the superheated n-octane gas tends to shrink fast under the effect of pressure impact. Specific heat of n-octane vapours in these conditions (case) is about 0.72 kj/kg·K (0.172 kcal/kg.° C.). Required work input from the energy preservation and recycling compressor (heat pump compressor) ($W_{com}$) per one kg of n-octane, is:

$$(W_{com})=54\times(-0.72)=-38.88\text{ kj/kg }(-9.288\text{ kcal/kg})$$

This required amount of energy is very close to that calculated from the n-octane enthalpy difference of the start of compression of point B1 and end of compression point C, which was calculated at:

$$W_{cs}-38.835\text{ kj/kg }(-9.277\text{ kcal/kg})$$

As mentioned earlier, entropy of both the saturated n-octane line B-C, FIGS. 26, 27 and 28, and superheated n-octane, line B-B1, increase with increasing temperature and in a close proximity to each other. However, the rate of entropy increase of the superheated n-octane with temperature line B-B, is higher than the rate of entropy increase of the saturated n-octane line B-C, and the superheating process therefore is moved slightly to the right of the equilibrium line B-C, and the intersect point of these two entropy increase lines with temperature, forms a relatively sharp acute angle.

FIGS. 26, 27 and 28 show that superheating of n-octane in this manner, has actually truncated the required isentropic compression process path significantly to a very short distance B1-C, which is also the isentropic expansion path line of the n-octane if expanded from point C and from pressure of 0.12218 MPa (1.2218 bar) to a pressure of 0.000466 MPa (0.00466 bar).

On the other hand, and as shown earlier, superheating of ammonia or water vapours from the saturation liquid-vapour equilibrium line FIGS. 16 and 18 (for ammonia), elongates the isentropic expansion process, line E-D, which is also the isentropic compression lines, if ammonia vapours are compressed from point D. Hence, while entropy of the saturated ammonia vapours decrease with temperature FIG. 16, line C-D, entropy of the superheated ammonia gas increase with temperature, line C-E. Therefore the two lines move away from each other (diverge) and quickly elongate the isentropic path of ammonia expansion, line E-D. The intersect point of the two lines, forms therefore a much wider obtuse angel than the case of n-octane, and can be significantly wider that the straight angel. This behaviour of ammonia is actually a desired property, and for all those materials which are used as working mediums for power generation. The elongated isentropic path provides the opportunity to extract more energy from the expanding vapours such as ammonia.

Isentropic efficiency of ammonia expansion process, particularly with some condensation, is lower than 100% and the net extracted energy is less. In practice, it is always desired and attempted to eliminate condensation of the working medium water inside the power generating turbines, by introducing sufficient superheating of high pressure steam in one stage or with interim superheating (multi stage expansion). As shown through calculations, these are the measures taken to increase the isentropic efficiency of steam or ammonia expansion turbines.

However, such behaviour is exactly what is desired and required for compression process of n-octane, to minimize the required work for compressor. Combined superheating and the truncated isentropic process play a key positive role and contribute to the needed reduction of compression work, and turn the isentropic compression of n-octane into a less energy requiring process. It is desired here that the gas (n-octane) volume is significantly and rapidly reduced with minimal work and the entropy energy is re-organized ($E_{oc\ reor}$) within a much shortened temperature range, which are both achieved with the introduction of the superheating of n-octane prior to compression process.

Efficiency of such an isentropic process is expected to be higher than the efficiency case with ammonia expansion and can actually be significantly higher than 100%!

From the equation of state of gases (as was shown earlier):

$PV^n$=Constant, and:

$$\frac{P_2}{P_1} = \left\{\frac{V_1}{V_2}\right\}^n$$

$$\frac{T_2}{T_1} = \left\{\frac{V_1}{V_2}\right\}^{n-1}$$

Then if n-octane is compressed from the pressure of 0.00466 bar to 1.228 bar, the temperature rise will be:

$$\frac{1.2218}{0.00466} = \left\{\frac{V_2}{V_1}\right\}^{1.0227}$$

$Lg(262.1888)=1.0227\times Lg(V_1/V_2)$ $Lg(V_1/V_2)=2.36493$ $(V_1/V_2)=231.702$, and from the equation:

$(V_1/V_2)=1.0/231.702=0.0043158885$ and from the equation:

Hence:

$$\frac{T_2}{T_1} = \left\{\frac{V_1}{V_2}\right\}^{n-1}$$

$T2=274/(231.702)\hat{}0.0227=274\times 1.131576=310$ K $T2=310$K

This temperature is significantly lower that the saturation temperature ($T_{osat}$) of n-octane vapours under the pressure of 1.2218 bar, which is 405 K. The difference is:

Delta Temperature=405−310=95 K

The low theoretical calculated compassion temperature indicates that the process will get some supporting hand to increase the temperature to 405 K. According to the equation of state, value of the exponent (n) in the equation will need to be higher to elevate compression temperature to 405, and is:

$PV^n$=Constant, and:

$$\frac{T_2}{T_1} = \left\{\frac{V_1}{V_2}\right\}^{n-1}$$

$$\frac{405}{274} = \left\{\frac{V_1}{V_2}\right\}^{n-1}$$

$Lg(1.4781)=(n-1)\times Lg(231.702)$ $(n-1)=0.1697/2.3649297=0.07175689$ $(n)=1.07175689$ This value of exponent (n) in the equation of state indicates that the compressor actually performs significantly less work (provides energy) than the theoretical required energy. The actual required energy to that of the compressor, system compression efficiency ($\eta_{com}$), is calculated from:

$(\eta_{com})=(0.07175689/0.0227)\times 100=316\%$

In actual practice the energy provided from other sources, and in this case, superheating in the heat exchanger 240, to supplement the compressor work and raise temperature of one kg of the compressed n-octane from 207 K to 405 K, Is:

| | |
|---|---|
| From compressor | −38.835 kj/kg |
| From superheating | −191.565 kj/kg |

Then the compressor efficiency in supplementing its work by utilizing n-octane thermodynamic properties and the combined energy sources to increase the compressed n-octane temperature from 274 K to 405 K, without involving material condensation in the compressor is about:

$$(\eta_{com})=((-191.565+(-38.835))/-38.835)\times 100=593\%$$

This result is even higher than the result calculated from the equation of state. It is probably because the formula calculation from the equation of state does not take into consideration the different specific heats of n-octane under different sections (parts) of the operation, which is very high during superheating process. Without the superheating energy in the heat exchanger 240, compressor would have required significant amount of energy ($W_{theor}$) to increase the temperature of n-octane, while also avoiding condensation in the compressor, which is:

$$(W_{theor})=-38.835+(-191.565)=-230.400 \text{ kj/kg (55.04 kcal/kg)}$$

The result clearly indicates huge reduction of the required theoretical compressor work to compress n-octane as compared with the reduced and truncated actual calculated amount, which has positively affected efficiency of the process and compressor.

8.3 Compressor Work Per One Kg of the Working Medium Ammonia:

The most important task (criteria) for any operating power generation plant to increase overall efficiency of the system is to maximize the use of the induced energy into the system for power generation and minimize or preferably eliminate heat (energy) rejection to the outside environment, particularly from the spent working medium to the employed coolant. Hence, for the proposed novel heat engine 200 (FIG. 3) to increase efficiency of the plant, is to properly address this heat rejection issue and minimize or preferably eliminate the energy rejection from the spent ammonia after the outlet from the turbine 202, and avoid the use of an outside coolant. To achieve such an important task, it is required to provide (have) sufficient liquid n-octane to cool and condense one (1.0) (and each) kg/s of the spent saturated ammonia at pressure of 5.5077 bar and temperature of 280 K (7° C.) in the heat exchanger 204. As shown earlier, under these conditions ammonia will require to release (reject) the following amount of thermal energy ($E_{cond}$) in kj/kg (latent heat):

$$(E_{cond})=\text{Enthalpy of vapours } h_{vap}-\text{Enthalpy of Liquid } h_{liq}=506-(-730.9)=$$

$$(E_{cond})=1237 \text{ kj/kg (295.5 kcal/kg) of ammonia}$$

The corresponding required amount of n-octane liquid to be vaporized in the cold side of the heat exchanger 204 under pressure of 0.00466 bar and at temperature of 274 K (1.0° C.), to absorb the released above enthalpy (latent heat condensation) of ammonia, is:

One kg of n-octane will vaporize and absorb ($E_{abs}$):

$$(E_{cond})=\text{Enthalpy of vapours } h_{vap}-\text{Enthalpy of Liquid } h_{liq}=864.4-484.32=$$

$$(E_{cond})=380 \text{ kj/kg (90.779 kcal/kg)}$$

Theoretical required amount of n-octane ($G_{n\text{-}oct}$) is:

$$(G_{n\text{-}oct})=1237/380=3.255 \text{ kg of } n\text{-octane per one kg of ammonia}$$

To account for the n-octane cold liquid depressurization and other un-avoidable energy losses, it is assumed that the required amount of n-octane to satisfy also other needs per one kg of ammonia is 3.8 kg per one kg of ammonia (to be on the conservative side).

Total compressor work (energy) required to compress 3.8 kg of the superheated n-octane ($E_{comp\text{-}tot}$) from pressure of 0.00466 bar to pressure of 1.2218 bar, and allowing for system efficiency of 80%, is:

$$3.8\times(-38.835/0.8)=-184.466 \text{ kj/kg } (-44.067 \text{ kcal/kg})$$

On the other hand, the net amount of energy elevated ($E_{el}$) from the cold reservoir to hot reservoir by the energy preservation and recycling compressor (heat pump) per one kg of ammonia, is calculated as follows:

Gross energy elevated per one kg of n-octane:

$$(E_{el})=1094.8-484.32=610.48 \text{ kj/kg of } n\text{-octane (145.84 kcal/kg)}$$

For 3.8 kg of n-octane, the amount of lifted energy is:

$$3.8\times 610.48=2319.24 \text{ kj (554.19 kcal)}$$

This is much higher than the latent heat of condensation of ammonia which is 1237 kj/kg.

However, some of this energy is used in the heat exchanger 240 for superheating the cold n-octane vapours from 274 K to 355 K, which is actually an internally recycled amount and "forms a free rising and lifting step for temperature of the cold reservoir from 274 K to 355K, without the need for compressor work". As mentioned earlier, this superheating energy supplements (reduces) the compressor work, and the amount is:

$$1055.97-864.4=191.565 \text{ kj/kg of } n\text{-octane (45.763 kcal/kg)}$$

Also allowing for 25 kj/kg n-octane for the de-pressurization process of liquid n-octane from pressure of 1.2218 bar to 0.00466 bar, to be used in the heat exchanger 204, then net amount of energy elevated from the cold temperature reservoir 274 K to the high temperature reservoir of 405 K and used in the system is:

$$610.48-191.565-25=393.91 \text{ kj/kg of } n\text{-octane (94.102 kcal/kg)}$$

Total energy elevated per 3.8 kg of n-octane (required per one kg of ammonia) and sustaining the system energy balance, is:

$$(E_{el})=393.91\times 3.8=1496.858 \text{ kj/kg (357.587 kcal/kg WM)}$$

This energy is a relatively high amount and is also significantly higher than the required energy to heat one kg of ammonia from 280 K to 390 K and vaporize it under pressure of 7.135 MPa (71.35 bar), and further heat it to 400 K, which requires about 1237 kj/kg (295.5 kcal/kg).

However, the excess energy of about 266.86 kj/kg ammonia at high temperature of 405 K, is an important factor of the system operation and is used for a—Interim superheating of the high pressure and high temperature ammonia after $1^{st}$, stage expansion to 25 bar and feeding back to $2^{nd}$ stage of the turbines, and mainly the turbine of the energy preservation and recycling compressor operation (heat pump), which requires about 220/kj per one kg of ammonia, b—Sustain the heat (energy) balance of the system (and general un-avoidable energy losses), (about 46.86 kj/kg ammonia)

8.4—Power Generated from Ammonia Loop:

As calculated earlier, in the ammonia analysis section, when isentropically expanding one kg/s of the superheated ammonia to temperature of 426 K through the two stage turbine, and when ammonia is expanded through $1^{st}$ stage from 71.35 bar to 25 bar, and then superheated again to 400 K and expanded through $2^{nd}$, stage to 5.5077 bar, the amount of energy generated from ammonia, and accounting (assuming) for the relating isentropic efficiencies of the two expansion stages of ammonia, is about: 369.1 kj/s Hence, the net power ($W_t$) in MW, which is generation per the ammonia flow rate of one kg/s through turbines and allowing for another system efficiency of 85%, is:

$$(W_t)=(369.1-184.466/0.85)\times 0.001=0.152 \text{ MW}$$

This is a reasonable net power (energy) generation by the novel system from both high temperature source and low temperature source (sea water) and can be acceptable as attractive economic merits, as compared with the current power generation systems.

The energy sources can be considered as environmentally friendly and also as green energy, which should be a positive indication and criteria for the novel power plants employing this technology.

9—"ATALLA HARWEN CYCLE"

By superimposing the temperature-entropy (T-s) diagram of the heating agent n-octane on the temperature-entropy (T-s) diagram of the working medium ammonia FIG. 32, a novel heat engine for power generation is formulated and established.

The actual operation flow diagram is that shown in FIGS. 2 and 3 and expressed as heat engine 200 and 300, the "Atalla Harwen Cycle" "Atalla Harnesing and Recycling Waste and Water Energy". All the analysis and evaluations made and discussed for the power generation loop and energy preservation and recycling loop are therefore applicable to the heat engines 200 and 300 representing the Atalla Harwen Cycle" and all the relating novel data, information and inventive steps are claimed.

10. NOVEL SYSTEM PERFORMANCE

Coefficient of performance (COP) of the energy preservation and recycling compressor (heat pump principle) at these operation conditions is calculated as follows, and assuming that:

a—The return temperature of the condensed and cooled n-octane to the spent working medium condenser is at 282 k (9° C.) or lower, b—Superheating temperature of n-octane vapours prior to feeding to compressor is 355 K $$COP = \frac{Q_{out}}{Q_{out} - \Delta Q_{in}} \quad \text{Eq. 10}$$

Where:

$Q_{out}$ Is the amount of heat delivered to the hot reservoir at temperature $T_{hot}$ $Q_{in}$ Is the amount of heat extracted from the cold reservoir at temperature $T_{cool}$ and delivered to the hot reservoir at temperature $T_{hot}$ $$COP = \frac{\text{Total elevated heat}}{\text{Compressor power spent to elevate total heat}}$$

$$COP = \frac{(380 + 38.835) - 22}{38.835} \times 0.8 = \frac{396.835}{38.835} \times 0.8 = 8.1747$$

$$COP = 8.1747$$

COP is also calculated from the Excel Model=8.2805588 And is reasonably close to the above calculated COP It is important to mention that these results are for a specific material (n-octane) and under some selected operation conditions. However, there are many suitable and probably better pure chemicals, mixtures, azeotrps, etc, of different materials which can be used and may produce better results for the system (COP).

11 EXAMPLE AND EXCEL MODEL

To explain, substantiate and support all the analysis and calculations made for the parameters and process data of the individual pieces of equipment and components of the novel power plant, an Excel program model was constructed and built for modelling and calculation of a typical example of the process operation parameters, which covered all the system equipment.

Modelling and calculation is based on features of the heat engine 200, with the embodiments shown in the configuration diagram (FIG. 3), and all equipment and material flow streams being given like reference numerals, and the assumed working medium ammonia flow rate of one (1.0) kg/s through the power loop of the novel plant.

The main aim of the example and modelling is to organise, calculate, analyse, define and confirm:

a—Mass balance of the individual components (pieces of equipment) and the overall operational system, b—Energy balance of the individual components (pieces of equipment) and the overall operational system c—Convergence of the assumed data and compliance of the resulting dependant calculated data to the operation conditions, d—Applicability and operability of the proposed novel power plant, e—Produce a full set of the modelling and calculations results.

f—Determine efficiency of the system g—Determine net power production of the system (if found positive and applicable)

h—Determine performance of the system

Conclusions of the modelling,

Calculations were based on a set of realistic assumptions (below) of the novel power plant expected operation conditions and parameters. Table 1, shows the results of the modelling.

Expected cost of the involved equipment and machinery to construct a large economic scale plant on this proposed technology is not made and therefore the full financial and economic calculations and analysis of the power plant are also not made.

Basic Assumptions:

i. Flow rate of the working medium ammonia is set at one (1.0) kg/s through the power generation loop (turbines),
   Flow rate of n-octane is controlled and set to provide the corresponding necessary heat and mass balances of each joint piece of equipment with the working medium ammonia and its flow rate of one (1.0) kg/s,
   The calculated required flow rate of n-Octane (with little excess) through the energy preservation and recycling loop is set at 3.8 kg per one kg of ammonia, ii. Liquid ammonia pumping pressure to the vaporized and superheated ammonia at the inlet into the turbine and spent ammonia pressure from the turbine are randomly selected to suit the operation criteria, and are:

| | |
|---|---|
| Turbines inlet pressure is | 7.155 MPa (71.35 bar) |
| Corresponding saturation vapors pressure | 390 K |
| Spent ammonia pressure is | 0.55077 MPa (5.5077 bar) |
| Corresponding saturation vapors pressure | 280 K |

iii. Definition and fixing of the operation pressure limits of n-octane across the compressor are selected to suit the operation criteria of ammonia loop and provide the required operation conditions for the lower temperature condensation of spent ammonia in the heat exchanger 204, and higher temperature vaporization of the pressurized ammonia in the heat exchanger 211, and are:

| | |
|---|---|
| Compressor inlet pressure | 0.000466 MPa (0.00466 bar) |
| Corresponding saturation vapors pressure | 274 K |
| Compressor outlet pressure | 0.12218 MPa (1.2218 bar) |
| Corresponding saturation vapors pressure | 405 K |

iv. Superheating temperatures of high pressure vaporized ammonia are selected to eliminate condensation of ammonia inside the turbine during expansion processes, and they are:

| | |
|---|---|
| Superheating temperature of the $1^{st}$, stage is | from 390 K to 426 K |
| Superheating temperature of the $2^{nd}$, stage is | from 331 K to 400 K |

v. Superheating temperatures of n-octane is also selected so that minimal or no condensation of material takes place during compression process, and is at
Superheating temperature is from 274 K to 355 K vi. Enthalpies and entropies of both ammonia and n-octane are taken from Perry' "Chemical Engineering Handbook" for the corresponding temperature and pressure vii. Specific heat of n-octane liquid in the temperature range of 274 K to 405 K is assumed at 2.35 kj/kg·K (reasonable)

viii. Specific heat of n-octane vapors in the temperature range of 274 K to 355 K and under constant pressure $C_p$, of 0.00466 bar, is assumed at 2.365 kj/kg·K (0.565 kcal/kg.° C.) (Conservative)

ix. Temperature of the superheated n-octane under constant pressure of 0.00466 bar, where entropy of the superheated n-octane is equal to entropy of the saturated n-octane at 405 K (under the pressure of 1.2218 bar), is 355 K x. Isentropic efficiency of the ammonia expansion turbine (power generation) is assumed at 88% and 90% for the first and second stages of ammonia expansion respectively,
There is not expected condensation of ammonia inside the turbine, during either of the expansion stages, xi. Further overall system efficiency is also assumed at 80% (conservatively), when calculating the energy preservation and recycling system compressor work to compress the heating agent from 0.00466 bar to 1.2218 bar,
Another allowance of 10% was made for mechanical and natural energy losses when calculating final efficiency of the novel system, xii. Additional internal work requirement of 20 kj per one kg ammonia, for the liquid ammonia pump and other pumping and/or recompressions of internal needs
Liquid ammonia pumping from 5.5077 bar to 72.5 bar, requires energy (theoretical) of about 6.5 kj/s (per one kg/s) of ammonia though the system xiii. There is a source of cooling water (Sea or River) for cooling and vaporizing The following numbered clauses are hereby included to give further description of the invention:

1. A heat engine for producing mechanical work using a working medium comprising:
   a. a first heat exchanger (204) comprising:
      i. a first input (i1) for receiving a substantially vapour working medium output from an energy extraction device;
      ii. a second input (i2) for receiving a substantially liquid heating agent, wherein the first heat exchanger is arranged to transfer energy from the working medium to the heating agent to at least partially vaporise the heating agent; and
      iii. a first output (o1) for outputting the vaporised heating agent;
   b. a compressor (231) coupled to the first output of the first heat exchanger for compressing the vaporised heating agent, wherein the compressor compresses the heating agent thereby changing at least a portion of the vaporised heating agent from a vapour state to a liquid state; and
   c. a second heat exchanger (204) comprising:
      i. a first input (i3) for receiving the at least partially liquid heating agent from the compressor;
      ii. a second input (i4) for receiving the liquid working medium output from the first heat exchanger wherein the second exchanger is arranged to transfer energy to the working medium received from the first heat exchanger to at least partially vaporise the working medium received from the first heat exchanger.
2. A heat pump for use with a heat engine for producing mechanical work using a working medium comprising:
   a. a first heat exchanger (204) comprising:
      i. a first input (i1) for receiving a substantially vapour working medium output from an energy extraction device;
      ii. a second input (i2) for receiving a substantially liquid heating agent, wherein the first heat exchanger is arranged to transfer energy from the working medium to the heating agent to at least partially vaporise the heating agent; and
      iii. a first output (o1) for outputting the vaporised heating agent;
   b. a compressor (231) coupled to the first output of the first heat exchanger for compressing the vaporised heating agent, wherein the compressor compresses the heating agent thereby changing at least a portion of the vaporised heating agent from a vapour state to a liquid state; and
   c. a second heat exchanger (204) comprising:
      i. a first input (i3) for receiving the at least partially liquid heating agent from the compressor;
      ii. a second input (14) for receiving the liquid working medium output from the first heat exchanger wherein the second exchanger is arranged to transfer energy to the working medium received from the first heat exchanger to at least partially vaporise the working medium received from the first heat exchanger.
3. A heat engine according to clause 1 or a heat pump according to clause 2 wherein the first heat exchanger is arranged to transfer energy from the working medium to the heating agent to vaporise substantially all of the heating agent.

4. A heat engine according to clause 1 or a heat pump according to clause 2 wherein the specific heat capacity of the heating agent at constant pressure, $C_P$, divided by the specific heat capacity of the heating agent at constant volume, $C_V$, (n) is less than approximately 1.08, and preferably less than approximately 1.065, at a temperature of approximately 270 degrees Kelvin.
5. A heat engine according to clause 1 or a heat pump according to clause 2 wherein the specific heat capacity of the heating agent at constant pressure, $C_P$, divided by the specific heat capacity of the heating agent at constant volume, $C_V$, (n) is in the range of 1.03 and 1.06 inclusive measured at a temperature of between 270 degrees Kelvin and 375 degrees Kelvin inclusive.
6. A heat engine or a heat pump according to any preceding clause wherein the heating agent is selected from the group comprising n-Octane, n-Heptane, Butylformte, Diethylamine, Pentylamine, Pentylalcohol.
7. A heat engine or a heat pump according to any preceding clause wherein working medium has a ratio of specific heat capacities, Cp/Cv which is larger than the ratio of the specific heat capacities, Cp/Cv of the heating agent.
8. A heat engine or a heat pump according to any preceding clause wherein the first heat exchanger is arranged to transfer energy from the working medium to the heating agent at a substantially constant temperature and preferably at a substantially constant pressure.
9. A heat engine or a heat pump according to any preceding clause wherein the second heat exchanger is arranged to transfer energy from the heating agent to the working medium at a substantially constant temperature and preferably at a substantially constant pressure.
10. A heat engine or a heat pump according to any preceding clause wherein the compressor is a multi-stage compressor.
11. A heat engine or a heat pump according to any preceding clause wherein the first heat exchanger comprises a second output (o2) for outputting liquid working medium condensed in the first heat exchanger.
12. A heat engine or a heat pump according to any preceding clause wherein the second heat exchanger comprises a first output (o3) for outputting the at least partially vaporised working medium and a second output (o4) for outputting liquid heating agent condensed in the second heat exchanger.
13. A heat engine for producing mechanical work using a working medium comprising:
    a. a first heat exchanger (204) coupled to a working medium and to a heating agent, wherein the heat exchanger is arranged to extract energy from the working medium and to vaporise at least a portion of the heating agent using the extracted energy;
    b. a compressor (231) coupled to the heat exchanger for compressing at least a portion of the vaporised heating agent from a vapour to a liquid; and
    c. a second heat exchanger (204) coupled to the working medium and to the liquid heating agent, wherein the second heat exchanger is arranged to transfer energy from the liquid heating agent compressed by the compressor to the working medium.
14. A heat pump for use with a heat engine for producing mechanical work using a working medium comprising:
    a. a first heat exchanger (204) coupled to a working medium and to a heating agent, wherein the heat exchanger is arranged to extract energy from the working medium and to vaporise at least a portion of the heating agent using the extracted energy;
    b. a compressor (231) coupled to the heat exchanger for compressing at least a portion of the vaporised heating agent from a vapour to a liquid; and
    c. a second heat exchanger (204) coupled to the working medium and to the heating agent, wherein the second heat exchanger is arranged to transfer energy from the liquid heating agent compressed by the compressor to the working medium.
15. A heat engine according to clause 13 or a heat pump according to clause 14 wherein the first heat exchanger is arranged to vaporise substantially all of the heating agent.
16. A heat engine according to clause 13 or a heat pump according to clause 14 wherein the first and second heat exchangers are coupled to the working medium via an energy generation loop and preferably wherein the first and second heat exchangers are coupled to the heating agent via an energy preservation loop and in particular in which the generation loop and preservation loop flow in substantially opposite directions.
17. A heat engine or a heat pump according to any preceding clause arranged to operate so that the working medium operates in a temperature range of approximately 0 to 220 degrees Celsius.
18. A heat engine or a heat pump according to any preceding clause for use in a closed-loop system

12 RESULTS OF THE MODELLING AND ANALYSIS

Table 1, shows the modelling program components, interaction and calculation results of each individual operation piece of equipment which together form a full one cycle of the heat engine operation, based on the selected basic assumption set, and are repeatable for any further number of cycles. The data can also be approximated and proportionate for any different flow rates of the working medium ammonia and operating conditions. The table shows the following results:

1. The proposed novel power generation heat engine (plant) produces reasonable amount of net energy from the induced energy into the system and achieves high efficiency of over 57%,
   This is a significantly higher efficiency than that of the comparable current conventional power generation systems from the high pressure high temperature steam based power plant, which is generally less than 45%,
2. Proposed novel power generation heat engine (plant) achieves reasonably high Coefficient of Performance (COP), and is 8.2805588,
   This is a much higher COP than the performance of comparable conventional heat (energy) elevating systems under similar operation conditions of very high temperature difference (delta) between cold and hot reservoirs,
   Such a high performance of the novel system operating at such low temperature reservoirs, can provide the opportunity also to absorb more energy from low temperature sources such as sea water and elevate it to be used to vaporize ammonia, 3. By proportionate scaling up of the power plant size, any required capacity plant can be designed and manufactured within the metallurgical and mechanical limits of the employed materials. For example, if a plant capacity of—say 100 MW is required, then the ammonia flow rate ($G_{amm}$) through system is expected to be (approximately):

$$(G_{amm})=100/0.15963=626.449 \text{ kg/s, or.}$$

$$(G_{amm})=626.449\times3600/1000=2255 \text{ ton/h}$$

This is not a very high flow rate of ammonia, particularly volumetric flow rate, as the density of the spent ammonia at the end of expansion is about 4 kg per cubic metre, and the volumetric flow rate is:

$$\text{Turbine inlet}=(2255\times1000)/(55\times3600)=11.39 \text{ m}^3/\text{s}$$

$$\text{Turbine outlet}=(2255\times1000)/(4\times3600)=156.612 \text{ m}^3/\text{s}$$

These are not high volumetric flow rates and the handling mechanical equipment and turbines are not expected to be of excessively large sizes or relative high cost.

For example of a conventional power plant of also 2200 t/h of steam, the volumetric flow rate of the low pressure steam under say 0.15 bar (abs) is expected to be:

$$(2200\times1000)\times15/3600=9200 \text{ m}^3/\text{s}$$

Although capacity of the conventional plant will be about 650 to 800 MW, and taking the allowable linear speed of the gases through pipes and other equipment, size of the involved equipment for the comparable novel power plants can still be significantly smaller (and probably also less costly) apart from the initial stages of the heating agent compressor, 4. Specific cost in terms of US$ per each (one) MW capacity of the installed economic size plant, is not determined, due to the absence of a realistic cost element of the novel technology, However, as there are no un-usual or complicated components of the involved technology, and the equipment is mainly ammonia turbine, n-octane compressor and a number of heat exchanger and hold tanks, plus the usual pipes and valves, the envisaged cost of constructing and installing a power plant on this technology is not expected to be much higher than the current coal fired power plants. It is actually expected that the novel technology to be noticeably less costly and more economic.

5. Should the future actual experimental tests and practice with "Atalla Harwen Cycle", achieve and support the results close to those shown in the table 1, (or preferably exceed), along with supporting economical features and data, then the choice for future power plants technologies may become wider and this novel technology may attract broader (higher) attention and interests.

Future optimization of plant configuration and components of "Atalla Harwen Cycle" can also provide further advantages to the selection process, in terms of:

a—Provision of better heating materials, and to lesser extend working mediums, b—Higher power generation efficiency, c—Provision of practical designs and applied engineering principles and approaches, d—Operability and simplification of equipment e—Provision of less harsh operation conditions f—Reasonable (and competitive) cost of equipment and machinery, g—Adaptability to different geographic locations h—Operational and health safety i—Environmentally friendly choice of technology for long terms power generation Etc.

6. The calculation results indicate also that the proposed novel power generation system is operable in terms of achieving the:

Material balance of the individual pieces of equipment and the overall system,

Energy balance of the individual pieces of equipment and the overall system,

Based on the assumed random set of suitable example of the operation conditions, Interaction and sequential synchronization of operations of the two loops to generate net power, 7. Operation conditions can be further optimized and tuned to suit other:

Working mediums,

Heating agents,

Sets of operation conditions,

System configurations and flow diagrams

Etc

The invention claimed is:

1. A system for recycling heat or energy of a working medium of a heat engine for producing mechanical work or other forms of energy, comprising:

a first heat exchanger for transferring heat from a working medium output from an energy extraction device to a heating agent to vaporize the heating agent;

a second heat exchanger for transferring further heat to the vaporized heating agent;

a compressor coupled to the second heat exchanger, the compressor configured to compress the further-heated heating agent; and one or more outputs from the compressor, wherein the one or more outputs are divided into a first stream and a second stream, wherein the first stream is coupled to a third heat exchanger for transferring heat from the compressed heating agent to the working medium, and wherein the second stream is coupled to the second heat exchanger for transferring further heat to the vaporized heating agent.

2. The system of claim 1 wherein second heat exchanger is arranged to superheat the vaporized heating agent.

3. The system of claim 1 wherein the first heat exchanger is arranged to receive the heating agent and to transfer heat from the working medium output from the energy extraction device to vaporize substantially all of the heating agent.

4. The system of claim 1 wherein the second heat exchanger is arranged to receive vaporized heating agent from the first heat exchanger and to transfer further heat to the vaporized heating agent received from the first heat exchanger.

5. The system of claim 1 wherein the third heat exchanger is arranged to receive compressed heating agent from the compressor and to transfer heat to the working medium and to vaporize substantially all of the working medium.

6. The system of claim 1 wherein the specific heat capacity of the heating agent at constant pressure, $C_P$, divided by the specific heat capacity of the heating agent at constant volume, $C_V$, n, is less than 1.08.

7. The system of claim 1, wherein the first heat exchanger is arranged to extract heat from the working medium output from the energy extraction device.

8. The system of claim 1, wherein the first heat exchanger is arranged to transfer heat from the working medium to the heating agent at a constant pressure and a constant temperature.

9. The system of claim 1 wherein the second heat exchanger is arranged to heat the vaporized heating agent beyond a saturation point of the heating agent.

10. The system of claim 1 wherein the second heat exchanger is arranged to heat the vaporized heating agent at constant pressure.

11. The system of claim 1 wherein the compressor is arranged to isentropicaily compress the superheated heating agent to a saturation vapor pressure at an outlet from the compressor such that there is substantially no condensation of the heating agent inside the compressor or wherein the heating agent compressed within the compressor is substantially only in the vapor phase.

12. The system of claim 1 wherein each heat exchanger is coupled to a first and/or a second closed-loop thermodynamic cycle.

13. The system of claim 1 wherein the compressor is arrange to isentropically compress the heating agent.

14. The system of claim 1 wherein the compressor is arranged to compress the heating agent from a substantially vapor-only phase to a vapor-liquid mixture.

15. The system of claim 1 wherein the third heat exchanger is arranged to transfer heat to the working medium from the heating agent at constant temperature and constant pressure.

16. The system of claim 1 wherein the heating agent comprises at least one of n-Octane, n-Heptane, Butylformate, Diethylamine, Pentylamine, Pentylalcohol or a mixture thereof.

17. The system of claim 1 in which the heating agent is n-Octane and in which the working medium is ammonia or a mixture of ammonia and water.

18. The system of claim 1 wherein working medium has a ratio of specific heat capacities, Cp/Cv Which is larger than the ratio of the specific heat capacities, Cp/Cv of the heating agent, wherein Cp is the specific heat of gas under a constant pressure and Cv is the specific heat of said gas at a constant volume.

19. The system of claim 1 wherein the compressor is a single ormulti-stage compressor.

20. The system of claim 1 further comprising a fourth heat exchanger for superheating a partially expanded working medium received from a first stage of the energy extraction device wherein the fourth heat exchanger is arranged to condense the heating agent and to transfer heat to the partially expanded working medium received from the first stage of the turbine.

21. The system of claim 1 wherein the system is coupled with a further heat exchanger or/and a boiler arranged to receive heat from an additional heat source, such as a boiler, to heat, vaporize and/or super heat the working medium.

22. The system of claim 1 wherein the system is coupled with an additional heat exchanger arranged to receive heat from a further additional heat source such as a seawater or freshwater heat source to heat and/or vaporize the heating agent and to transfer heat to the heating agent.

23. The system of claim 1 wherein the first heat exchanger and third heat exchanger are coupled to a heat recycling loop along with a further heat exchanger for introducing additional heat from one or more outside sources and wherein the energy extraction device is coupled to a first closed loop.

24. The system of claim 1 wherein the heating agent is a single or multi component material or wherein the working medium is a single or multi component material.

25. The system of claim 1 wherein the system for recycling heat of the working medium output from the energy extraction device operates in a second closed loop.

26. A heat pump for transferring heat from a heat source to a heat sink using a heating agent, comprising:

a first heat exchanger for vaporizing the heating agent by transferring heat from the heat source to the heating agent;

a second heat exchanger for further heating the vaporized heating agent by transferring further heat to the vaporized heating agent;

a compressor coupled to the second heat exchanger, the compressor arranged to compress the further-heated heating agent; and one or more outputs from the compressor, wherein the one or more outputs are divided into a first stream and a second stream, wherein the first stream is coupled to a third heat exchanger for transferring heat from the compressed heating agent to condense the heating agent, and wherein the second stream is coupled to the second heat exchanger.

27. The heat pump of claim 26 wherein the second heat exchanger is arranged to receive vaporized heating agent from the first heat exchanger and to transfer further heat to the vaporized heating agent received from the first heat exchanger.

28. The heat pump of claim 26 wherein the heat source is cooler than the heat sink.

29. A method of recycling heat comprising:

transferring heat from a working medium output from an energy extraction device to a heating agent to vaporize the heating agent, transferring further heat to the vaporized heating agent in a heat exchanger; and compressing the further-heated heating agent in a compressor, wherein the compressed heating agent is split and output to:

a) further heat the vaporized heating agent in the heat exchanger, and b) transfer heat from the compressed heating agent to heat the working medium.

30. A method of operating a refrigeration cycle for transferring heat from a heat source to a heat sink using a heating agent comprising:

vaporizing the heating agent by transferring heat from the heat source to the heating agent;

further heating the vaporized heating agent by transferring further heat to the vaporized heating agent in a heat exchanger; and compressing the further-heated heating agent in a compressor, wherein the compressed heating agent is split and output to:

a) further heat the vaporized heating agent in the heat exchanger, and b) transfer heat from the compressed heating agent to condense the heating agent.

* * * * *